US010676304B2

(12) United States Patent
Techlin

(10) Patent No.: US 10,676,304 B2
(45) Date of Patent: Jun. 9, 2020

(54) METHOD AND APPARATUS FOR PRODUCING CORELESS ROLLS OF PAPER

(71) Applicant: Paper Converting Machine Company, Green Bay, WI (US)

(72) Inventor: Michael E. Techlin, De Pere, WI (US)

(73) Assignee: PAPER CONVERTING MACHINE COMPANY, Green Bay, WI (US)

( * ) Notice: Subject to any disclaimer, the term of this patent is extended or adjusted under 35 U.S.C. 154(b) by 114 days.

(21) Appl. No.: 15/938,775

(22) Filed: Mar. 28, 2018

(65) Prior Publication Data

US 2018/0282097 A1 Oct. 4, 2018

Related U.S. Application Data

(62) Division of application No. 15/005,506, filed on Jan. 25, 2016, now Pat. No. 9,975,720, which is a division of application No. 13/623,959, filed on Sep. 21, 2012, now Pat. No. 9,284,147.

(51) Int. Cl.

| | |
|---|---|
| ***B65H 18/04*** | (2006.01) |
| ***B65H 19/22*** | (2006.01) |
| ***B65H 75/24*** | (2006.01) |
| ***B65H 18/28*** | (2006.01) |
| ***B65H 19/28*** | (2006.01) |

(52) U.S. Cl.

CPC ..... *B65H 19/2292* (2013.01); *B65H 18/04* (2013.01); *B65H 18/28* (2013.01); *B65H 19/283* (2013.01); *B65H 75/245* (2013.01); *B65H 2301/41854* (2013.01); *B65H 2301/418526* (2013.01); *B65H 2405/461* (2013.01); *B65H 2405/572* (2013.01); *B65H 2511/172* (2013.01); *B65H 2701/1924* (2013.01)

(58) Field of Classification Search

CPC .. B65H 19/283; B65H 19/2292; B65H 18/04; B65H 18/28; B65H 2301/41854; B65H 2301/418526

See application file for complete search history.

(56) References Cited

U.S. PATENT DOCUMENTS

| | | | |
|---|---|---|---|
| 1,076,189 | A | 10/1913 | Cameron |
| 1,437,398 | A | 12/1922 | Cameron |
| 1,986,680 | A | 1/1935 | Marcalus |
| 2,066,659 | A | 1/1937 | Templeton |
| 2,090,130 | A | 8/1937 | Kittel |
| 2,385,692 | A | 9/1945 | Corbin |

(Continued)

*Primary Examiner* — Sang K Kim

(74) *Attorney, Agent, or Firm* — Thompson Coburn LLP

(57) ABSTRACT

A clasp is configured to engage an end of a tube. The clasp has a shaft that is insertable into a tube. The clasp includes a housing with clamping blocks that are spaced circumferentially around the shaft. The clamping blocks are moveable between a disengaged position in which the clamping blocks are spaced radially outwardly from the shaft at a distance sufficient such that a tube is insertable between the shaft and the clamping blocks, and an engaged position in which the clamping blocks are positioned radially inward of the disengaged position toward the shaft and are configured to press a tube disposed between the blocks and the shaft against the shaft. The clasp has at least one actuator engageable with at least one clamping block of the plurality of clamping blocks to move the at least one clamping block between the disengaged position and the engaged position.

19 Claims, 23 Drawing Sheets

(56) References Cited

U.S. PATENT DOCUMENTS

| | | | | |
|---|---|---|---|---|
| 2,466,974 | A | 4/1949 | Stupakoff | |
| 2,520,826 | A | 8/1950 | Beck | |
| 2,537,492 | A | 1/1951 | Tidland | |
| 2,647,701 | A | 8/1953 | Cannard | |
| 2,749,133 | A | 6/1956 | Rich | |
| 2,769,600 | A | 11/1956 | Kwitek | |
| 2,995,314 | A | 8/1961 | Nystrand | |
| 3,007,652 | A | 11/1961 | Heckman | |
| 3,097,808 | A | 7/1963 | Williams | |
| 3,791,659 | A | 2/1974 | Hardin | |
| 3,865,776 | A | 2/1975 | Gergen | |
| RE28,353 | E | 3/1975 | Nystrand | |
| 4,431,142 | A * | 2/1984 | Kataoka | B65H 19/2292 242/418 |
| 4,516,786 | A | 5/1985 | Lund | |
| 4,697,757 | A | 10/1987 | Nakaya et al. | |
| 4,763,785 | A | 8/1988 | Bradley et al. | |
| 4,802,637 | A | 2/1989 | Williams | |
| 4,828,195 | A | 5/1989 | Hertel et al. | |
| 5,040,738 | A | 8/1991 | Biagiotti | |
| 5,150,848 | A | 9/1992 | Consani | |
| 5,370,335 | A | 12/1994 | Vigneau | |
| 5,402,960 | A | 4/1995 | Oliver et al. | |
| 5,421,536 | A | 6/1995 | Hertel et al. | |
| 5,497,959 | A | 3/1996 | Johnson et al. | |
| 5,505,402 | A | 4/1996 | Vigneau | |
| 5,538,199 | A | 7/1996 | Biagiotti | |
| 5,542,622 | A | 8/1996 | Biagiotti | |
| 5,603,467 | A | 2/1997 | Perini et al. | |
| 5,639,045 | A | 6/1997 | Dorfel | |
| 5,639,046 | A | 6/1997 | Biagiotti | |
| 5,660,349 | A | 8/1997 | Miller et al. | |
| 5,690,296 | A | 11/1997 | Biagiotti | |
| 5,725,176 | A | 3/1998 | Vigneau | |
| 5,762,289 | A | 6/1998 | Suzuki | |
| 5,769,352 | A | 6/1998 | Biagiotti | |
| 5,839,680 | A | 11/1998 | Biagiotti | |
| 5,849,357 | A | 12/1998 | Andersson | |
| 5,979,818 | A | 11/1999 | Perini et al. | |
| 6,056,229 | A | 5/2000 | Blume et al. | |
| 6,199,789 | B1 | 3/2001 | Marco | |
| 6,270,034 | B1 | 8/2001 | Kury et al. | |
| 6,422,501 | B1 | 7/2002 | Hertel et al. | |
| 6,497,383 | B1 | 12/2002 | Daul et al. | |
| 6,565,033 | B1 | 5/2003 | Biagiotti | |
| 6,595,458 | B1 | 7/2003 | Biagiotti | |
| 6,752,345 | B2 | 6/2004 | Betti et al. | |
| 6,945,491 | B2 | 9/2005 | Gambini | |
| 7,011,872 | B2 | 3/2006 | Ding et al. | |
| 7,104,494 | B2 | 9/2006 | Casella et al. | |
| 7,175,126 | B2 | 2/2007 | Perini | |
| 7,175,127 | B2 | 2/2007 | Butterworth et al. | |
| 7,293,736 | B2 | 11/2007 | Recami et al. | |
| 7,641,141 | B2 | 1/2010 | Pellengo Gatti | |
| 7,775,476 | B2 | 8/2010 | Recami et al. | |
| 7,909,282 | B2 | 3/2011 | Wojcik et al. | |
| 7,942,363 | B2 | 5/2011 | Gelli et al. | |
| 7,992,818 | B2 | 8/2011 | Maddaleni et al. | |
| 8,181,897 | B2 | 5/2012 | Tsai | |
| 2004/0026560 | A1 * | 2/2004 | Murachi | B65H 18/04 242/530.3 |
| 2006/0214047 | A1 | 9/2006 | Michel et al. | |
| 2007/0152094 | A1 | 7/2007 | Deacon | |
| 2009/0218435 | A1 | 9/2009 | Morgan | |
| 2009/0272835 | A1 | 11/2009 | Benvenuti et al. | |
| 2011/0095117 | A1 | 4/2011 | Haque et al. | |
| 2011/0177265 | A1 | 7/2011 | Dunn | |
| 2011/0266386 | A1 | 11/2011 | Chen | |
| 2013/0225381 | A1 | 8/2013 | Haque et al. | |
| 2013/0225382 | A1 | 8/2013 | Haque et al. | |
| 2013/0225385 | A1 | 8/2013 | Haque et al. | |
| 2015/0307315 | A1 | 10/2015 | Techlin et al. | |

* cited by examiner

DR SIDE CLASP STOPS. OP SIDE CLASP CONTINUES TO ACCELERATE, RAPIDLY WITHDRAWING THE MANDREL FROM THE LOG.

WHEN THE MANDREL IS NEARLY WITHDRAWN THE DRIVE SIDE CLASP MOVES AWAY FROM THE LOG END. THE LOG PERIPHERAL RESTRAINT DISENGAGES AND TWO CLAMPS ACTUATE TO LIGHTLY PINCH THE MANDREL. THE CLAMPS PROVIDE AXIAL DRAG.

Fig. 27

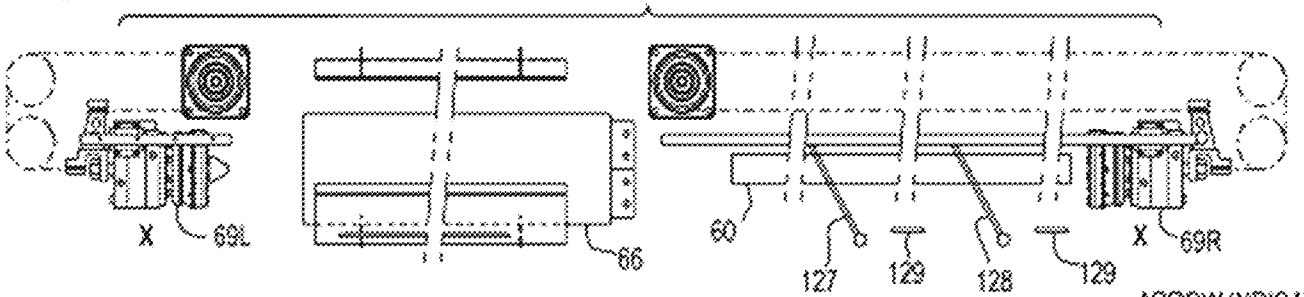

ARROW INDICATES MOTION DIRECTION X INDICATES STATIONARY (NO MOTION)

WHEN THE DR SIDE END OF THE MANDREL IS FULLY WITHDRAWN FROM THE OP SIDE OF THE LOG, THE OP SIDE CLASP DISENGAGES AND CONTINUES MOVING, BUT MORE SLOWLY. THE AXIAL DRAG PROVIDED BY THE CLAMPS CAUSES THE MANDREL TO CEASE MOTION AND THE OP SIDE CLASP TO TO WITHDRAW FROM ITS END. THE PAIR OF CLAMPS HOLD THE MANDREL HORIZONTAL.

Fig. 28

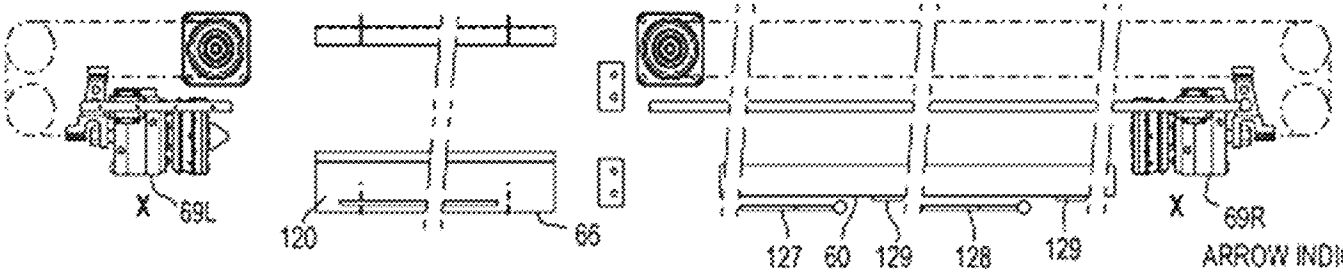

ARROW INDICATES MOTION DIRECTION X INDICATES STATIONARY (NO MOTION)

LOG IS DISCHARGED FROM THE TROUGHS SO THE NEXT LOG CAN ENTER. MANDREL IS DROPPED BY THE CLAMPS INTO RETURN GUIDES FOR RECIRCULATION (OR COULD BE TAKEN DIRECTLY BY CONVEYOR). OP SIDE CLASP BEGINS RETURN MOTION FOR THE NEXT LOG AFTER THE MANDREL HAS MOVED OUT OF THE WAY.

METHOD AND APPARATUS FOR PRODUCING CORELESS ROLLS OF PAPER

PRIORITY CLAIM AND REFERENCE TO RELATED APPLICATIONS

This application is a divisional application of Ser. No. 15/005,506, filed Jan. 25, 2016, which is a divisional application of Ser. No. 13/623,959, filed Sep. 21, 2012, now U.S. Pat. No. 9,284,147, both herein incorporated by reference.

BACKGROUND

This invention relates to rolls of convolutely wound paper, such as bathroom tissue and kitchen towel (also called household towel). More particularly, the invention relates to a coreless roll of such paper.

It is well known in the art that rolls of convolutely wound paper are typically formed on a machine known as a rewinder. A rewinder is used to convert large parent rolls of paper into smaller sized rolls of bathroom tissue, kitchen towel, hardwound towel, industrial products, and the like. A rewinder line consists of one or more unwinds, modules for paper finishing (e.g., embossing, printing, perforating), and a rewinder at the end for winding the paper into a long roll, commonly referred to as a log. Typically, the rewinder produces logs which are about 90 to 180 mm in diameter for bathroom tissue and kitchen towel and about 100 to 350 mm in diameter for hardwound towel and industrial products. Log length is usually about 1.5 to 5.4 m, depending on the width of the parent roll. The logs are subsequently cut transversely to obtain small rolls about 90 to 115 mm long for bathroom tissue and about 200 to 300 mm long for kitchen towel and hardwound towel.

Traditionally these types of paper products are produced and supplied to the end user with a cardboard core at the center. However, as evidenced by numerous patents on the subject, there is a compelling interest in a good way to produce and supply these products without cores. The reasons generally entail potential greater efficiency and less material usage. In the case of center-pull products, the core must be discarded before the product is even used.

Recently the European Union issued a directive stating that, cardboard cores inside tissue products are to be considered part of the packaging. They are therefore subject to a tax proportionate to their weight. This is a government program to incentivize the use of less packaging materials. Converters who can supply coreless products will gain a competitive advantage.

Nonetheless, despite their appeal, coreless products remain only a niche in the market. Wider adoption is stalled due to the limitations of coreless production, primarily the overall inefficiency of current coreless rewinders.

Ideally the market would like a coreless production system with the following attributes:

- Can produce both low firmness and high firmness rolls, i.e., has a large operating window.
- Has capital cost and space requirements similar to machines that run with cores.
- Has operating costs (consumables and maintenance) similar to machines that run with cores.
- Requires operator training and skill level similar to machines that run with cores.
- Can operate reliably at high web speed and cycle rate.

- Can be quickly and easily switched between production with and without cores.

DESCRIPTION OF THE PRIOR ART

U.S. Pat. Nos. 5,660,349, 5,725,176, and 6,270,034 describe turret winders, also called center winders, which are intended for production of coreless tissue products. Turret winders suffer from the same drawbacks in both coreless production and production with cores. They cannot produce very firm products because their only control is incoming web tension. Higher web tension will make a firmer log, but also correlates with more frequent web blowouts due to bursting of perforations or tearing from defects along the edges of the web. Also, they cannot run high speeds at very wide widths due to the slenderness of the mandrel inside the log which allows excessive vibration. Lastly, they cannot run high cycle rates due to the time in the cycle required to index the turret, decelerate the log, and then remove the log from the mandrel.

Additionally, turret winders of significant width must use rigid mandrels to support the winding log. They thus are subject to the same limitations as surface winders that use rigid mandrels and have a relatively narrow operating window: logs wound too tight (high firmness) cannot be stripped off the mandrel due to the resistance induced by high interlayer pressure, and logs wound too loose (low firmness) may telescope or crumple when log stripping is attempted. Telescoping is when the external wraps of paper in the log move axially relative to the internal wraps of paper, which may even remain stationary on the mandrel. Crumpling is when the log breaks free only locally and collapses like an accordion.

U.S. Pat. Nos. 5,538,199, 5,542,622, 5,603,467, 5,639,046, 5,690,296, and 5,839,680 describe a system for producing solid rolls. U.S. Pat. Nos. 5,402,960 and 5,505,402 describe another system for producing solid rolls. Though these systems achieve the goal of having no core, the products also have no hole, and therefore cannot be used with the universal and nearly ubiquitous dispensers that require a hole for a shaft to pass through.

U.S. Pat. No. 7,992,818 describes a system for producing solid rolls with a layer of separator material in the wind so that the inner nucleus can be expelled axially from the roll, forming a hole in the finished product. Though this system achieves the goal of having no core, it has little material savings because of the separator material, glue to attach the separator material, and the likely wastage of the nucleus. Also, this approach does not overcome the narrow product range problem. The nucleus cannot be pushed out of loosely wound rolls because the rolls telescope severely instead. And the nucleus cannot be pushed out of tightly wound rolls because its resistance, induced by the high interlayer pressure, is too great.

Patents IT 1,201,390, U.S. Pat. Nos. 5,421,536, 5,497,959, and 6,056,229 describe surface winders with recirculating mandrels, i.e., the mandrels are removed from the rolls to produce coreless product, and the mandrels are reused. In each case the mandrels are cylindrical in shape and extend the full-length of the web width. U.S. Pat. No. 5,421,536 discloses the use of extensible material for the mandrel in column 4, line 65 to col. 5, line 7:

"The invention also is advantageous in that an extensible material such as rubber, plastic and the like can be used as the material for construction of the mandrel 15 so as to facilitate roll stripping. Through the use of an extensible material, longitudinal elongation caused by the stripping forces is accompanied by a reduction in radius. The relationship of the two depends upon Poisson's ratio. In any event, the compressive grip of the convolutedly wound web on the mandrel is successfully reduced and overcome by the stripping force in combination with the elongation and reduction in radius."

U.S. Pat. Nos. 1,986,680 and 6,565,033 describe machines with split winding mandrels. The mandrels are split in two pieces with half extracted from each end of the log to reduce the force necessary to perform extraction from tightly wound logs. U.S. Pat. No. 1,986,680 has the advantage that the mandrel pinches the web at transfer and does not require transfer glue or vacuum. However, its split tapered design requires the machine to be triple the width of the web, and, because it has only one mandrel set, it can function solely in the start-stop mode.

U.S. Pat. Nos. 5,660,349, 6,270,034, 5,497,959, and 6,595,458 describe using vacuum in conjunction with mandrels that have perforated shells in order to transfer the web in continuous motion rewinders. This eliminates the need for transfer glue and the attendant complications which glue presents for stripping coreless products. The major difficulty in using vacuum is the porosity of the tissue web, which allows a large volume of air to flow through it. The air flow is limited by the inside diameter of the mandrel and its length. The use of vacuum mandrels at a reasonable production speed is limited to large diameter mandrels and products with large diameter hole size, typically more than 48 mm, and narrow web widths, typically less than 2.6 m. Vacuum is also a poor solution when acting directly on tissue webs because infiltrating dust clogs the system and deteriorates the performance over time. Cleaning the system out is laborious and requires substantial machine down time.

U.S. Pat. No. 6,752,345 describes a surface winder with the split mandrel design of U.S. Pat. No. 6,565,033 that additionally has mandrel washers. Column 2, lines 26-42 explain various means to transfer the web onto mandrels without using high tack glue which is typically used on cores. These means are employed because high tack glue makes the extraction of the mandrel from the log more difficult. Column 2, lines 43-48 explain that these means are simply not reliable enough to run at high speed. Column 3, lines 23-34 teach that the purpose of the washers is to clean off residual adhesive and paper debris as part of the recirculation process, thereby making the use of high tack transfer glue feasible, enabling high speed converting.

The approach described in U.S. Pat. No. 6,752,345 does address several major issues with coreless production. However, using split mandrels increases the machine complexity, cost, and floor space required, relative to running with cores. The various extra mechanisms also reduce the sight lines into the machine and hamper accessibility for operation and maintenance. The mandrel washers also increase the cost, machine complexity, floor space, and maintenance effort, relative to running with cores. Lastly, the statements in column 3, lines 24-26 that the provision of washing makes it possible to "eliminate from the surface of the mandrels any residues of paper or other material that may continue to adhere to the mandrel after extraction" and lines 43-45 that "in the absence of a washing system . . . debris would accumulate on the extractable mandrels" suggest that the system allows tearing and other damage to occur within the log during mandrel extraction.

Patent Publication US 2009 0272835 A1 describes mechanical web tucking devices that can be used instead of glue to transfer the web. Paragraph 0011 mentions its adaptability to the production of coreless rolls. While the devices may eliminate the need for transfer glue and mandrel washers, the utility and efficiency of the system are hampered by extremely precise timing requirements and inertia of mechanical actuators that restrict its operation to relatively low speed.

State of the art coreless rewinders use relatively rigid mandrels. The description of rigid applies to both the radial direction and along the longitudinal axis. This description of rigidity is relative to the typical cardboard cores which are used in rewinders to produce rolls with cores. Though these cores can range from very compliant single ply cores to very stiff cores with three, four, or five plies, they all are nonetheless far less rigid than mandrels made from metallic alloys (aluminum, titanium, steel, etc.) or fiber-reinforced polymer composites (with aramid fibers, carbon fibers, etc.). Winding mandrels made of these high modulus materials are relatively rigid. Mandrels are constructed of various combinations of these high modulus, high strength materials because they must be very strong to withstand the high forces they are subjected to during repeated instances of extraction from logs without suffering damage.

Machine designers have to make accommodations for the high radial stiffness of rigid mandrels when designing coreless rewinders. This may be accomplished with an oscillating cradle, as taught in U.S. Pat. No. 5,769,352 (col. 2, lines 2-12), a deformable cradle as taught in same (col. 5, lines 42-48), or compliant surfaces, as taught in U.S. Pat. No. 6,056,229 (col. 5, lines 50-52 and col. 6, lines 1-5). However, oscillating, deformable, and compliant accommodations are not predisposed to operation at high speed without premature wear and failure.

Alternatively, the high radial stiffness mandrels may be used with a rigid cradle, as depicted in FIG. 1 (item 11) of U.S. Pat. No. 5,769,352. This requires precision mandrels, precision setup of the gap between the cradle elements and upper roll, and a gap which is precisely uniform across the width of the machine. These requirements tend to increase the machine cost, parts cost, and level of operator skill that is necessary.

Patents IT 1,201,390, U.S. Pat. Nos. 6,565,033, 6,752,345, 5,421,536, and 6,056,229 depict mandrel extractors and log strippers which are typical of coreless rewinders. In all cases the log is supported by a trough, below, and restrained in the axial direction solely by a plate against its end face as either the mandrel is pulled out or the log is pushed off. Additionally, in all cases the actuator moving the log or the mandrel is laterally offset from the mandrel centerline, so large extraction/strip forces produce large moment loads on the guide tracks for the clasp pulling the mandrel or the paddle pushing the log. Substantial frames, brackets, and guide ways are required to oppose this moment, which increases the cost and space required, and reduces the practical speed at which they operate. And it is a frequent complaint that the guide ways wear out prematurely.

Patent Publication US 2006 0214047 is an example of a mechanically expansible mandrel that can be used to wind coreless products. It is characteristic of expansible mandrels in that it is a complex assembly composed of many intricate parts, and the expanding parts that contact the inside of the product are essentially a shell around the elements within the mandrel that bear the flexural and axial loads.

Patent Publication US 2007 0152094 is an example of a fluidically inflatable mandrel that can be used to wind coreless products. It is characteristic of fluidically inflatable mandrels in that the inflated portion that contacts the inside of the product is either a skin wrapped about, or a tire set upon, the elements within the mandrel that bear the flexural and axial loads.

U.S. Pat. No. 2,520,826 describes pressurizing winding cores and the means by which it can be done. Its objective is to temporarily increase the radial stiffness of the cores, so they are not crushed by the caging rollers, which may apply a high nip force. It makes no mention of withdrawing the core or otherwise producing coreless product.

U.S. Pat. Nos. 2,066,659, 2,466,974, 2,647,701, 2,749,133, 3,007,652, 3,097,808, 3,791,659, 4,516,786, and 7,942,363 describe various chucks that can be used to hold the ends of hollow tubes. They are characteristic of their technical field in that they expand inside the tube to secure it. Implicit in all the designs is the assumption that the tube behaves relatively rigidly, and thus will not deform, under the working loads.

Plastic core tubes have proven to be a reliable key component for many products, particularly those in the film, tape and cloth industries where the core cost is an insignificant part of the overall cost of the product. However, plastic core tubes are not used in bathroom tissue or kitchen towel due to the significantly higher cost over conventional cardboard cores, and also because the plastics are not produced in the paper mills which typically make both the cardboard and tissue products from wood pulp and recycled paper. Additional extrusion equipment and additional transportation of materials would be required to make sufficient plastic cores that could be shipped with the product. This, however, would not be a concern if the plastic cores are removed from the wound product and recycled to wind another product as described hereinafter.

GENERAL COMMENTS ON THE CURRENT STATE OF THE ART

The following is a summary of the state of the art in rewinding coreless tissue/towel products using removable mandrels. These drawbacks constitute the primary reasons coreless production remains a niche market, despite its intrinsic appeal.

- The maximum cycle rates are very low, due to the log stripping sequence.
- The precision rigid mandrels used are expensive, as are their coatings which wear off.
- Mandrels made from metals are heavy. Therefore, they have relatively high mass and polar inertia, which present the following problems:
  - The high mass causes parts on the inserter and infeed portion of the cradle to deteriorate rapidly due to impacts and/or abrasion when running high speed.
  - The high mass and polar inertia cause the mandrel to resist the very sudden changes to its translational and rotational velocity required when it is pushed into the channel between the upper roll and the stationary rolling surface of the rewinder. Failure of the mandrel to properly accelerate causes poor and unreliable web transfers. The worst case is an outright failure to transfer, which crashes the machine.
  - The high mass and polar inertia cause the mandrel to resist the very sudden changes to its translational and rotational velocity required when it leaves the stationary rolling surface and enters the nip between the upper and lower rolls. Failure to properly accelerate causes poor quality winding. The worst case is that the mandrel slides through the nip out of control and crashes the machine.
  - The high mass and stiffness of these mandrels combine to give them the capacity to do serious damage to other parts of the machine during a high speed crash.
- Though mandrels made of fiber-reinforced polymer composites have reduced mass and polar inertia, relative to metal mandrels, they present the following problems:
  - They are very expensive. This comes into play not only regarding the initial purchase of the machine, but also its ongoing operating costs because the mandrels have a finite life and must be replaced when worn out or broken.
  - During severe crashes carbon fiber composite mandrels break into pieces. The debris is akin to splinters and can be dangerous to operators cleaning them up and to end users if bits get into the finished product.
  - The high stiffness of these mandrels gives them the capacity to do serious damage to other parts of the machine during a high speed crash. The goal of using these very expensive composite mandrels is to run faster, so the damage caused is often just as great as with a heavier metal mandrel running slower.
- Coreless surface winders can successfully run only a narrow range of products:
  - Low firmness (loosely wound) products lack the radial stiffness to support the relatively heavy mandrel during high speed winding. They also lack the interlayer pressure to resist telescoping during mandrel extraction or log stripping. And they lack the column strength to resist localized axial collapse (crumpling like an accordion) during mandrel extraction or log stripping.
  - Very firm (tightly wound) products have excessive interlayer pressure and can stall the actuator during mandrel extraction or log stripping.
  - Only a narrow range of products has adequate firmness to support the relatively heavy mandrels during winding and resist collapse during stripping, and high enough interlayer pressure to prevent telescoping during stripping, but also low enough interlayer pressure that the stripper does not stall.
- Web transfer in coreless rewinders is done at relatively low speeds, compared to machines running with conventional cores. Web transfer is the step of attaching the web to the core or mandrel. There are several reasons for the relatively low speeds:
  - When the machine crashes, or web breaks, the relatively rigid mandrels cause less severe damage to the other parts of the machine and themselves if running lower speed.
  - The transfer glue tack must be lower than a machine with cores to make log stripping possible, especially if mandrel washers are to be avoided. Web transfer is less reliable with low tack glues at high speeds.
  - The mandrels have higher mass and inertia than cores, and thus cannot do abrupt speed transitions like cores (as described above), so the transfer sequence is more difficult to control and less reliable.
- Coreless machines have higher operating costs due to more frequent maintenance, replacement of damaged mandrels, replacement of worn specialty parts, and higher level of operator skill required.
- Though machines can be switched between core and coreless operation, it is a major changeover effort, not a simple grade change.
- Even after the finished roll is successfully produced, there is still the danger of it internally unraveling while in transit to the end user if the interior tail is not secured.

Challenges of Coreless Roll Production

Significant obstacles must be overcome to make an efficient coreless rewinder. The following two critical areas must be addressed. The issues appear complex, because a solution in one area can cause difficulty in another area. The most elegant solution would positively address both areas simultaneously.

1. Mandrel Material and Design

The mandrel is the starting point and central element. Ideally it would have all the following properties, some of which are countervailing, if not mutually exclusive:

- Low mass and inertia (for rapid accelerations at high web speed).
- Low polar inertia (for rapid accelerations at high web speed).
- Low cost.
- Adequate flexural stiffness (to be conveyed).
- Low coefficient of friction (to promote extraction).
- Adequate tensile strength (for extraction).
- Abrasion and wear resistance (to be durable).
- Adequate fatigue life (for longevity).
- Available in custom sizes (to match various hole diameter requirements).
- Natural corrosion resistance (to resist transfer glue, water spray, and washing).
- Non-toxic (preferably food contact compliant).
- Some ductility (to maintain integrity during a crash).
- Recyclability (disposal after it has worn out or broken).
- Ends can accommodate some means to securely grasp them (for extraction).
- Surface that mates with the grasping means is not larger than the mandrel OD (to allow various length mandrels (web widths) to be run in a single rewinder).
- Practically uniform radial stiffness for the full length, including the ends (to allow various length mandrels (web widths) to be run in a single rewinder).

Ideally the mandrel would be just like a circular, tubular cardboard core regarding its radial stiffness and uniformity of cross-section, and it would be similar regarding its mass and inertia. It could then be used to make the same range of products as are made with cores. And this could be done in essentially the same rewinders as use cores. But, how could such a mandrel ever be successfully extracted from a wound log?

2. Transfer Reliability and Speed Vs. Mandrel Extraction

High wet tack glue is recommended for reliable web transfers at high speed. But, less sticky glue is better for easier and cleaner mandrel extraction. Though these two interests may always compete, making the transfer work with lower tack glue, or the extraction work with higher tack glue, would produce an area of convergence where both interests are satisfied.

Ideally, the following accommodation could be reached:

- Transfer glue has high enough wet tack for reliable transfers at high web speed.
- Transfer glue releases well enough for easy extraction—no damage to mandrel or to product.
- Mandrel is completely clean when removed from the log.
- If mandrel is not completely clean, only a fine residue or film of the transfer glue remains (no paper) and can be ignored, or otherwise easily cleaned off, preferably with dry wiping, not washing.
- If any glue residue or film is too substantial to be ignored, and cannot be easily dry wiped off, it is water soluble so it can be wiped away when wetted.
- Transfer glue is an existing off-the-shelf variety, not exotic new formulation.
- Transfer glue can be applied by existing applicator methods such as extrusion or daubing.

SUMMARY OF THE INVENTION

The first subject of the invention is a novel lightweight, low inertia mandrel comprised of a relatively thin walled, flexible plastic tube that behaves much like a cardboard core. In addition to being radially compliant, like a core, the mandrel is also axially elastic, to facilitate removal from the roll or log of paper which is wound on the mandrel. The goal of this mandrel is to replace cardboard cores in new and existing rewinders that currently wind rolls of paper with cores. Exemplary surface rewinders of this type are described in U.S. Pat. Nos. 6,056,229, 6,422,501, 6,497,383, 5,370,335, 4,828,195, and 7,104,494, which issued to Paper Converting Machine Company. The mandrel can also be used in other models of surface rewinders from this supplier, both continuously operating and start-stop.

The mandrel can also be used in surface rewinders from other suppliers, for example, and not limited to, rewinders described in U.S. Pat. No. 5,150,848 (Consani), U.S. Pat. No. 5,979,818 (Perini), U.S. Pat. No. 6,945,491 (Gambini), U.S. Pat. No. 7,175,126 (Futura), U.S. Pat. No. 7,175,127 (Bretting), U.S. Pat. No. 8,181,897 (Chan Li), and others.

The mandrel can also be used in turret rewinders or center rewinders, both continuously operating and start-stop. Exemplary center rewinders of this type are described in U.S. Pat. Nos. 2,769,600, 2,995,314, 5,725,176, and U.S. RE 28,353. The mandrel can also be used in turret winders from other suppliers.

The mandrel can also be used in center-surface rewinders, both continuously operating and start-stop, for example, and not limited to, rewinders described in U.S. Pat. Nos. 7,293,736, 7,775,476, and 7,942,363.

The second subject of the invention is a novel lightweight, low inertia mandrel comprised of a relatively thick-walled plastic tube, or solid rod, that may have high radial stiffness, but is axially elastic, to facilitate removal. The goal of this mandrel is to replace the relatively rigid winding mandrels in new and existing rewinders that make coreless products with holes. An exemplary surface rewinder of this type is the coreless embodiment described in U.S. Pat. No. 6,056,229. The mandrel can also be adapted for use in coreless surface rewinders from other suppliers, for example, and not limited to, rewinders described in Patents IT 1,201,390, U.S. Pat. Nos. 6,565,033, 6,595,458, 6,752,345, and Publication US 2009 0272835 A1.

Each of the foregoing novel mandrels is used in a rewinder to form a new product, namely, a roll or log of wound paper comprising the novel mandrel and a web of paper which is convolutely wound around the mandrel. Optionally and preferably, the first layer of the convolutely wound paper is adhesively attached to the mandrel, a step which is referred to as transfer. After the foregoing new product exits the rewinder, the mandrel is withdrawn or extracted from the log by pulling on one or both ends of the mandrel. The withdrawn mandrel can be recycled, i.e., recirculated to the rewinder for use in forming another log by winding the web of paper around the mandrel.

The purpose of the axial elasticity of the two novel mandrels is to allow the mandrel to elongate longitudinally during the step of extracting the mandrel from the log of paper. Longitudinal elongation of the mandrel results in localized progressive breakaway of the mandrel from the log, greatly reducing the peak extraction force. This effect is believed to be more important than diameter reduction of the mandrel. Longitudinal elongation of the mandrel also results in diameter reduction of the mandrel, which facilitates withdrawal of the mandrel from the log. The relationship between the amount of longitudinal elongation and the amount of diameter reduction depends on the Poisson's ratio of the material of the mandrel.

As an alternative to winding the log on an elastic mandrel and then stretching the mandrel to extract the mandrel, a tubular elastic mandrel can be pressurized before or during winding to expand the mandrel and increase its diameter and, if the ends are not restrained, to decrease its length. After winding, the pressure can be removed, resulting in a reduction of the diameter of the mandrel and an increase of its length, which facilitates withdrawal of the mandrel. This method can also be used with stretching of the mandrel during extraction. The methods are not mutually exclusive and both can be employed to achieve greater reduction of the peak extraction force together than either does alone.

Another subject of the invention is a mandrel chuck for gripping one or both ends of the foregoing tubular mandrel and withdrawing the mandrel from the log. The chuck includes an undersized rigid shaft which is inserted inside of the tubular mandrel to provide internal support. Discrete, radially movable blocks are arrayed about the external perimeter of the tube. When the blocks are moved against the tube, the elastic tube deforms into lobes between the blocks. The lobes are mild deformations that are temporary in nature because the stress within the tube material is well below the yield point of the material.

DESCRIPTION OF THE DRAWINGS

The invention will be explained in conjunction with illustrative embodiments shown in the accompanying drawings, in which:

FIGS. 19-28 illustrate the steps of extracting a mandrel from a log;

DESCRIPTION OF SPECIFIC EMBODIMENTS

Prior Art Winding of Rolls or Logs

Figure 1:
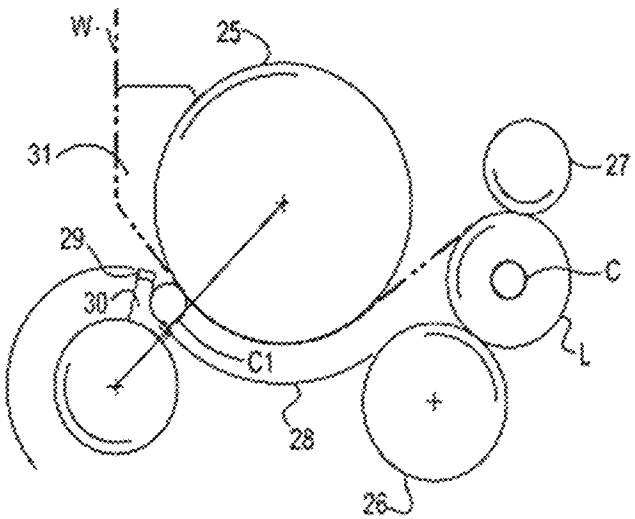
Fig. 1 PRIOR ART
FIG. 1 is a reproduction of FIG. 2 of prior art U.S. Pat. No. 6,056,229 which illustrates a surface rewinder winding a web of paper around a cardboard core.

FIG. 1 illustrates a conventional and well known prior art method of winding a web of paper around cardboard cores to form elongated rolls or logs of convolutely wound paper. The apparatus illustrated in FIG. 1 is a surface rewinder, and the details of the structure and operation of the rewinder are described in U.S. Pat. No. 6,052,229.

As described in the '229 patent, the rewinder of FIG. 1 includes three rotating winding rolls 25, 26, and 27 which rotate in the direction of the arrows to wind a web W onto a hollow cardboard core C to form a log L of convolutely wound paper such as bathroom tissue or kitchen towel. The first and second winding rolls 25 and 26 are also referred to as upper and lower winding rolls, and the third winding roll 27 is also referred to as a rider roll. A stationary plate 28 is mounted below the first winding roll 25 upstream of the second winding roll 26 and provides a rolling surface for the cores. Before the log is completely wound, a new core C1 is introduced into the channel between the first winding roll 25 and the rolling surface 28 by a rotating pinch arm 29. Circumferential rings of adhesive have already been applied to the core C1 in the conventional manner. Alternatively, the adhesive can be applied to the core in the form of a longitudinally extending stripe, which is also conventional. The pinch arm 29 includes a pinch pad 30, and continued rotation of the pinch arm causes the pinch pad to pinch the web against a stationary pinch bar 31 to sever the web along a perforation line in the web. The core C1 is moved by the pinch arm along the rolling surface 28 to a position in which it is compressed by the first winding roll 25 and begins to roll on the rolling surface. As the core C1 rolls on the rolling surface 28, the rings of adhesive on the core pick up the leading portion of the severed web so that the web begins to wind onto the core as the core rolls over the rolling surface. The attachment of the web to the core is referred to as transfer. The tail end of the severed web continues to be wound up onto the log L. The core C1 continues to roll on the rolling, surface 28 and winds the web therearound to form a new log. When the core C1 and the new log reach the second winding roll 26, the log moves through the nip between the first and second winding rolls 25 and 26 and is eventually contacted by the third winding roll 27. The three winding rolls 25-27 form a winding nest or winding cradle for the log.

Figure 2:
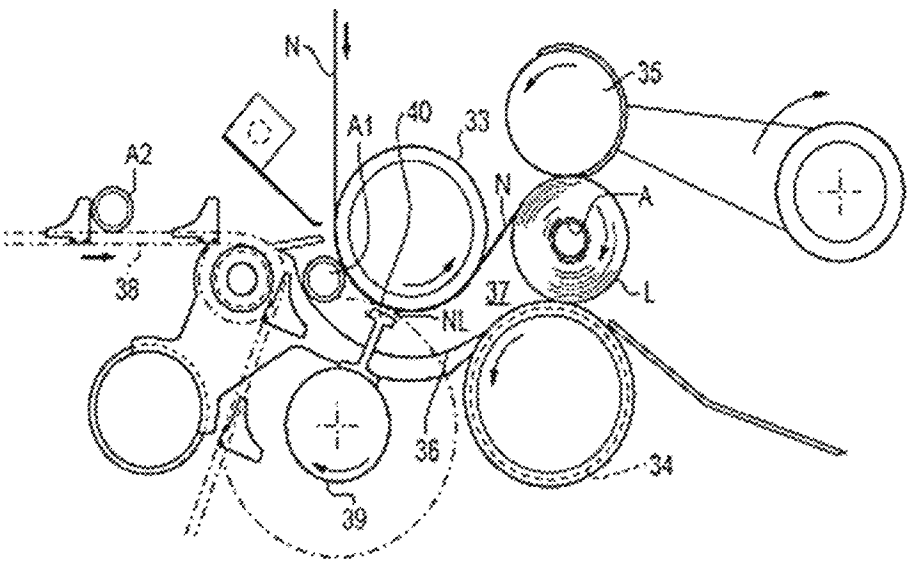
Fig. 2 PRIOR ART
FIG. 2 is a reproduction of FIG. 3 of prior art U.S. Pat. No. 5,979,818 which illustrates another surface rewinder winding a web of paper around a cardboard core.

FIG. 2 illustrates another prior art surface rewinder which winds a web of paper around cardboard cores to form elongated rolls or logs of convolutely wound paper. The details of the structure and operation of the rewinder of FIG. 2 are described in U.S. Pat. No. 5,979,818.

The rewinder described in the '818 patent also includes three rotating winding rolls 33, 34, and 35 which rotate in the direction of the arrows to wind a web N onto a hollow cardboard core A to form a log L. A curved surface or track 36 extends below the first winding roll 33 toward the second winding roll 34 and provides a rolling surface. The rolling surface 36 forms a channel 37 between the first winding roll and the rolling surface. Before the log L is completely wound, a new core A1 is introduced into the channel 37 by a conveyor 38 and begins to roll on the rolling surface 36. A rotating unit 39 rotates clockwise to cause a pinch pad 40 to pinch the web against the first winding roll 33, causing the web to sever along a perforation line. As the core A1 continues to roll between the surface 36 and the first winding roll 33, adhesive on the core picks up the leading portion of the severed web so that the web begins to wind up on the core to form a new log. The tail end of the severed web continues to be wound up onto the log L. When the new core A1 and the new log reach the second winding roll 34, the log moves through the nip between the first and second winding rolls 33 and 34 and is eventually contacted by the third winding roll 35, which is also called a rider roll. Again, the three winding rolls 33-35 form a winding nest or winding cradle for the log.

A rolling surface like the rolling surface 28 in FIG. 1 and the rolling surface 36 in FIG. 2 which forms with the first or upper winding roll a channel for inserting the core has become common in the consumer sized tissue and towel converting industry and is practiced by many rewinder suppliers. The use of this rolling surface causes the rotation of the core to be accelerated in two abrupt steps. The first step takes place between the first winding roll and the rolling surface immediately upon insertion of the core into the channel. The second step takes place between the first and second winding rolls, when the log rolls off the end of the rolling surface into the nip formed by the winding rolls. Cores are pushed into the channel with only slight, if any, rotational velocity. In the first step, the first winding roll and rolling surface abruptly accelerate the rotational and translational velocities of the core. The first winding roll drives the core along the rolling surface at substantially ½ web speed. In the second step, when the core rolls into the nip between the two winding rolls, it immediately loses most of its translational velocity, which is abruptly converted to additional rotational velocity by the spinning rolls. The first roll rotates at the web feeding speed and the second roll rotates slightly slower so that the core will move through the nip.

The dimension of the channel between the rolling surface and the first winding roll is less than the dimension of the core so that the core is compressed as it rolls. Compression of the core in the channel is required for abruptly accelerating the core and for driving the core along the rolling surface. The dimension of the nip between the first and second winding rolls is less than the diameter of the core and the initial windings of paper, so the core is compressed as it passes through the nip. Compression of the core in the nip is required for abruptly accelerating the core rotation and controlling its movement through the nip.

The cardboard cores which are used with the rewinders of FIGS. 1 and 2 are radially compliant and resiliently compressible so that the core can be compressed as it rolls on the rolling surface and as it passes through the nip. As previously discussed, coreless rewinders which use rigid mandrels must make accommodations for the radial stiffness of the mandrels so that the mandrels can roll over the rolling surface and pass through the nip without being compressed.

Figure 3:
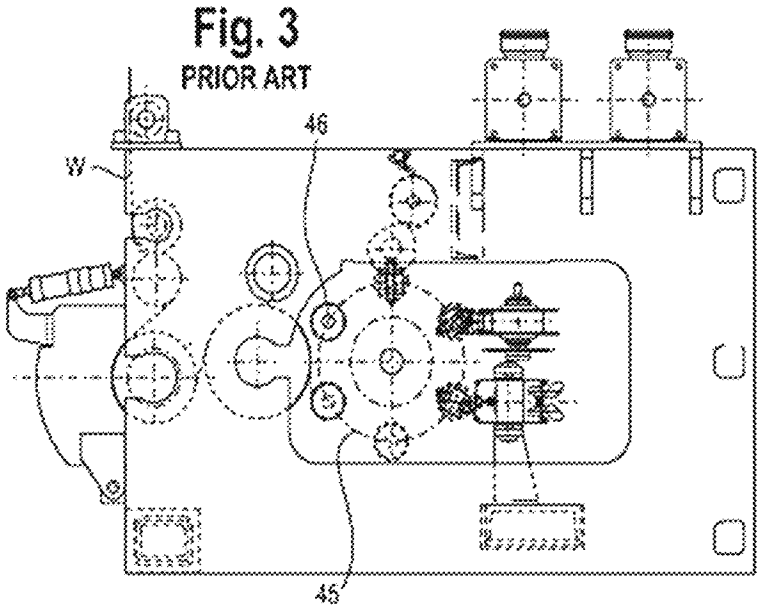
Fig. 3 PRIOR ART
FIG. 3 is an illustration of a prior art center rewinder or turret rewinder winding a web of paper around a cardboard core.
Figure 5:
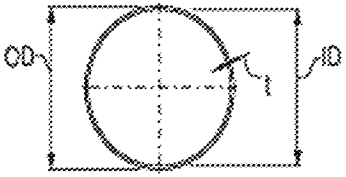
FIG. 5 is an end view of the mandrel of FIG. 4.
Figure 7:
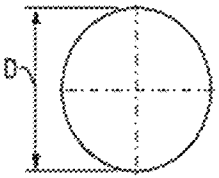
FIG. 7 is an end view of the mandrel of FIG. 6.

FIG. 3 illustrates another conventional and well known prior art method of winding a web of paper around cardboard cores to form elongated rolls or logs of convolutely wound paper. The apparatus illustrated in FIG. 3 is a center rewinder or turret rewinder which is sold by Paper Converting Machine Company ("PCMC") under the name Centrum.

The center rewinder in FIG. 3 includes a rotatable turret 45 on which are mounted six mandrels 46. In a center rewinder the term "mandrel" refers to a solid rod over which a conventional cardboard core may be inserted. Circumferential rings of adhesive are applied to the core, and a paper web W is adhesively attached to the core. The mandrel on which the core is mounted is rotatably driven to wind up the paper onto the core, and the turret rotates to move the mandrel and core to a position in which the wound roll or log is removed from the mandrel.

Novel Mandrels for Replacing Cores

Figure 4:
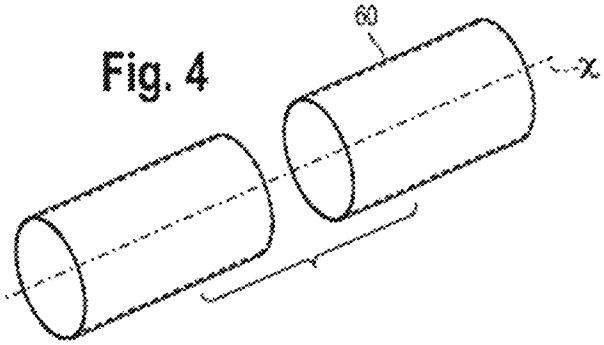
FIG. 4 is a perspective view, partially broken away, of an axially elastic, tubular plastic mandrel formed in accordance with the invention.
Figure 6:
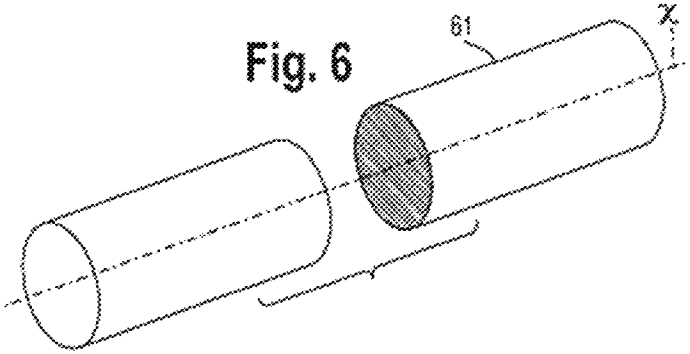
FIG. 6 is a perspective view, partially broken away, of an axially elastic, solid plastic mandrel formed in accordance with the invention.

FIGS. 4 and 6 illustrate novel elongated mandrels 60 and 61 which can be used in place of the cardboard cores which have been described with respect to the prior art rewinders of FIGS. 1-3 or in place of the rigid mandrels described with respect to prior art coreless rewinders. Each of the mandrels includes a longitudinal axis x and is formed from flexible and axially elastic material which will be described in detail hereinafter. The mandrel 60 in FIG. 4 is a relatively thin walled tube and has an outside diameter OD, and inside diameter ID, and a wall thickness t. The mandrel 61 in FIG. 6 is a solid rod and has a diameter. D. Alternatively, the mandrel could be a relatively thick walled tube or a rod with a small diameter opening. The flexible and axially elastic material of the mandrels 60 and 61 contrast with the material of prior art mandrels.

Prior Art Mandrel Materials Versus Novel Mandrel Materials

State of the art coreless rewinders use relatively rigid mandrels. Material alternatives abound, but selections are generally made from one of the following two categories: metallic alloys (aluminum, titanium, steel, etc.) and fiber-reinforced polymer composites (usually glass, carbon, or aramid fibers in a thermosetting resin matrix of polyester or epoxy). Mandrels are constructed of various combinations of these high modulus, high strength materials because they must be very strong to withstand the high forces they are subjected to during repeated instances of extraction from logs, without suffering damage.

The mechanical properties of materials are subject to wide variation based on alloy content, processing, fiber grade, wrap angles, curing, etc. However, Table 1 illustrates typical properties of some commonly available metallic alloys and fiber-reinforced polymer composites.

TABLE 1

| | | Metallic Alloys | | | | Fiber Reinforced Composites | | | |
|---|---|---|---|---|---|---|---|---|---|
| | | | | | | Extruded | Filament Wound | | |
| | | | | | | Glass | Glass | | |
| | | Aluminum Alloy | Steel Alloy | Nickel Alloy | Titanium Alloy | Fiber in Polyester | Fiber in Polyester | Carbon Fiber Epoxy Resin | Aramid Fiber Epoxy Resin |
| Tensile Elastic Modulus | ksi | 10,400 | 30,000 | 30,000 | 16,500 | 2,500 | 4,000 | 15,000 | 11,000 |
| Tensile Yield Strength | psi | 45,000 | 60,000 | 45,000 | 120,000 | 30,000 | 50,000 | 70,000 | 65,000 |
| Mass Density | $g/cm^3$ | 2.70 | 7.85 | 8.47 | 4.43 | 1.85 | 1.95 | 1.60 | 1.40 |
| Poisson's Ratio | | 0.32 | 0.30 | 0.32 | 0.34 | — | — | — | — |
| Tensile Yield Strength divided by Elastic Modulus | % | 0.4 | 0.2 | 0.2 | 0.7 | 1.2 | 1.3 | 0.5 | 0.6 |

The metallic alloys and fiber-reinforced polymer composites are characterized by relatively high elastic modulus and yield strength. The fiber-reinforced polymer composites are differentiated by their lower mass density, which affords them a high strength-to-weight ratio.

In contrast to the materials used to make the relatively rigid prior art mandrels, there is another material category, characterized by lower stiffness, lower strength, and lower cost, that can be used to make a novel elastic mandrel. They are often referred to as engineering or commodity plastics and are thermoplastic polymers. The following information is from the Engineering Plastic, Commodity Plastics, Thermoplastic, and Polyethylene entries on Wikipedia.

Engineering plastics are a group of plastic materials that exhibit superior mechanical and thermal properties in a wide range of conditions over and above more commonly used commodity plastics. The term usually refers to thermoplastic materials rather than thermosetting ones. Engineering plastics are used for parts rather than containers and packaging. Examples of engineering plastics:

Ultra-high Molecular Weight Polyethylene (UHMWPE)
Polytetrafluoroethylene (PTFE/Teflon)
Acrylonitrile Butadiene Styrene (ABS)
Polycarbonates (PC)
Polyamides (PA/Nylon)
Polybutylene Terephthalate (PBT)
Polyethylene Terephthalate (PET)
Polyphenylene Oxide (PPO)
Polysulphone (PSU)
Polyetherketone (PEK)
Polyetheretherketone (PEEK)
Polyimides (PI)
Polyphenylene Sulfide (PPS)
Polyoxymethylene (POM/Acetal)

Commodity plastics are plastics that are used in high volume and a wide range of applications, such as film for packaging, photographic and magnetic tape, beverage and trash containers and a variety of household products where mechanical properties and service environments are not critical. Such plastics exhibit relatively low mechanical properties and are of low cost. The range of products includes plates, cups, carrying trays, medical trays, containers, seeding trays, printed material and other disposable items. Examples of commodity plastics:

Polyethylene (PE)
Low Density Polyethylene (LDPE)
Medium Density Polyethylene (MDPE)
High Density Polyethylene (HDPE)
Polypropylene (PP)
Polystyrene (PS)
Polyvinyl Chloride (PVC)
Polymethyl Methacrylate (PMMA)
Polyethylene Terephthalate (PET)

The distinction between engineering and commodity plastics is informal. The distinction between them, however, is not important for this discussion. The important point is that their material properties are markedly different from metallic alloys and fiber-reinforced polymer composites.

Thermoplastics encompass a huge range of materials with extraordinarily diverse properties. Some are brittle, some are tough. Some are rigid, some are flexible. Some are hard, some are soft. Some are foam. Some are like rubber. But, regardless of the exact natures of specific thermoplastic polymers, they are, as a category, markedly different from metallic alloys and fiber-reinforced polymer composites. In contrast to composite materials which are heterogeneous because of the fiber in the matrix, thermoplastic materials are homogeneous.

The mechanical properties of plastics are subject to wide variation based on additives and processing methods. However, Table 2 illustrates typical properties of some commonly available thermoplastic polymers.

TABLE 2

| | | Thermoplastic Polymers | | | | | |
|---|---|---|---|---|---|---|---|
| | | Low Density Polyethylene | High Density Polyethylene | GS Nylon | Polycarbonate | Polypropylene | Polyvinyl Chloride |
| Tensile Elastic Modulus | ksi | 30 | 150 | 480 | 320 | 175 | 420 |
| Tensile Yield Strength | psi | 1,400 | 4,000 | 12,500 | 9,500 | 5,000 | 7,450 |
| Mass Density | $g/cm^3$ | 0.92 | 0.95 | 1.16 | 1.20 | 0.90 | 1.40 |
| Poisson's Ratio | | — | 0.42 | 0.40 | 0.37 | 0.45 | 0.41 |
| Structure | | semi-crystalline | semi-crystalline | semi-crystalline | amorphous | semi-crystalline | amorphous |
| Glass Transition Temp. | ° F. | −190 | −120 | 150 | 300 | 10 | 170 |
| Tensile Yield Strength divided by Elastic Modulus | % | 4.7 | 2.7 | 2.6 | 3.0 | 2.9 | 1.8 |

These materials are characterized by relatively low elastic modulus, yield strength, and mass density. The values for Poisson's ratio are relatively high.

The values listed for polyvinyl chloride are the specification for PVC pipe, also known as rigid PVC. The values listed for polypropylene, polycarbonate, nylon, and high density polyethylene are average values for extrusion grades.

Of the many thermoplastic polymers available there is a subset that is suited for use as a flexible and axially elastic material. There is no scientifically nor commercially accepted name for this category. It is a novel category and has not been used for winding mandrels in coreless rewinders. Definition of the attributes and range of properties that show which materials are in this category is an object of the invention and will be explained in detail. While many attributes play a role, the most important properties are those listed in the chart.

Of the properties listed in the chart, the most important is tensile yield strength divided by elastic modulus, because it indicates suitability of the mandrel material to the novel extraction means which is also part of this invention. It is not commonly used to specify materials, so a detailed explanation is provided in the next section.

Mechanical Properties of Mandrel Materials

The elastic modulus is sometimes called modulus of elasticity or Young's modulus. Its value is the slope of the stress-strain curve in the elastic region. This relationship is Hooke's Law.

$$E=\sigma/\varepsilon$$

E is elastic modulus.

σ is tensile stress.

ε is axial strain.

The stress-strain curve for an aluminum alloy is illustrated on page 148 of *The Science and Engineering of Materials,* $2^{nd}$ Edition, by Donald R. Askeland, 1989, by PWS-KENT Publishing Company. ISBN 0-534-91657-0. The elastic modulus is indicated as the slope of the curve in the elastic region, i.e., between zero load (and strain) and the yield strength. If a material is loaded to a stress value less than the yield strength it will return to approximately its original length. The yield strength of this material corresponds to 0.0035 in/in strain. So another way of expressing the yield limitation is if the material is strained less than 0.35% it will return to approximately its original length. If strained (stretched) to a greater length, it will plastically deform and not return to its original length. A goal for any mandrel in a rewinder is that it not permanently deform, but rather return to the same length and shape and thus be reusable for many cycles.

The elastic modulus is an indication of the stiffness of a material. The higher the modulus value, the greater its resistance to elongation. Abbreviated stress-strain curves for steel and aluminum are shown on page 153 of *The Science and Engineering of Materials,* $2^{nd}$ Edition, by Donald R. Askeland, 1989, by PWS-KENT Publishing Company. ISBN 0-534-91657-0. The curve for steel has a steeper slope and thus a higher modulus value.

Tables 1 and 2, which summarize typical material properties, have calculated values in the bottom row which are identified as Tensile Yield Strength divided by Elastic Modulus. They are obtained when the yield strength is divided by the elastic modulus, in a rearrangement of Hooke's Law.

$$\varepsilon_o=S_y/E$$

E is elastic modulus.

$S_y$ is yield strength.

The tensile yield strength divided by elastic modulus values for the metallic alloys are relatively low. The values for the fiber-reinforced polymer composites are also generally low, though they can be manipulated higher by altering the fiber grade, wrap angles, fiber-to-matrix ratio, etc. Nonetheless, it is clear that the values for the thermoplastic polymers are relatively high. The higher this value, the more the material can be elongated without permanent deformation, so materials with higher values are predisposed to work better as axially elastic mandrels.

Preferred Mandrel Properties

Various thermoplastic polymers may be used as winding mandrels. Some will work better than others. Narrowing the selection down to the best alternatives requires some insight.

LDPE is attractive because of its high value of tensile yield strength divided by elastic modulus. Its elastic modulus is so low that a thin-walled mandrel, with typical outside diameter, that is long enough for use in a production width rewinder, may be flimsy. Nonetheless, it may work very well in a narrow machine, or with special design considerations to accommodate its flexibility, or for large diameter mandrels. The very low glass transition temperature indicates it is extremely tough.

PVC pipe may have been used as a winding mandrel in start-stop rewinders and is known to have been used as a winding mandrel to make coreless logs in at least one continuous-running rewinder. Rigid PVC is not well suited for use as an axially elastic mandrel, however, because of its low tensile yield strength divided by elastic modulus value. And it cannot be used as a flexible, radially elastic mandrel due to its brittle nature, as indicated by the high glass transition temperature and amorphous structure. Its relatively high density is also a drawback.

Nylon is superior to rigid PVC in terms of tensile yield strength divided by elastic modulus and its density. But, it is not flexible enough to be a radially elastic mandrel, as indicated by its high glass transition temperature.

Polycarbonate is an unusual thermoplastic in that it exhibits good toughness even though it is amorphous and has a very high glass transition temperature. It has a high value for tensile yield strength divided by elastic modulus and a fair value for mass density. In its most common forms it is not flexible enough to be a radially elastic mandrel, as indicated by its glass transition temperature; but, if plasticizers can be added to lower its glass transition temperature, without adversely affecting its strength, and other attractive properties, too greatly, it may be viable for an elastic mandrel.

Polypropylene and HDPE have high values of tensile yield strength divided by elastic modulus, good toughness, and low density. They also have good stiffness and strength values. The lower glass transition temperature of HDPE indicates it is extremely tough and has good flexibility.

Though HDPE is the preferred embodiment for reasons touched on here and explained in depth in the following sections, other materials—both existing and those not yet invented nor discovered—that exhibit similar behavior can also be used.

Based on the foregoing, compliant, axially elastic, low inertia mandrels which are formed in accordance with the invention advantageously have the following physical properties:

Tensile Yield Strength Divided by Elastic Modulus (%):
greater than 1.5, preferably greater than 2.0, more preferably greater than 2.5

Glass Transition Temperature (° F.):
less than 60, preferably less than 40, more preferably less than 0

Mass Density (g/cc):
less than 1.50, preferably less than 1.25, more preferably less than 1.00.

Tensile Elastic Modulus (psi):
less than 2,000,000, preferably less than 1,000,000, more preferably less than 500,000.

Tensile Yield Strength (psi):
less than 50,000, preferably less than 25,000, more preferably less than 15,000.

Structure (% Crystallinity):
greater than 25, preferably greater than 50, more preferably greater than 75.

Poisson's Ratio:
greater than 0.30, preferably greater than 0.35, more preferably greater than 0.40.

Preferred Material for Mandrels

HDPE is the material choice for the preferred embodiment. Though other engineering or commodity plastics could be used, and most of them share at least some of these advantages, HDPE has the best overall combination of advantages and benefits, listed below.

- Relatively inexpensive.
- Readily available worldwide.
- Expertise widely available for extruding, molding, and forming
- Can be cold and/or hot worked after initial forming
- Can be heat fused with joints as strong as the base material.
- Excellent corrosion resistance.
- Excellent chemical resistance.
- Good impact strength.
- Good fatigue resistance.
- FDA approved for food contact.
- Readily recyclable (no. 2 plastic).
- Low coefficient of friction.
- Low mass density.
- Good abrasion and wear resistance.
- Adequate tensile strength.
- Adequate flexural modulus of elasticity.
- Good tensile modulus of elasticity.
- Available extruded to custom sizes.
- Good toughness—mix of appropriate strength and ductility.

Recommended Shape of Mandrel

HDPE can be extruded to have the same circular, tubular, uniform cross-section as a conventional cardboard core. Such tubes happen to have very similar radial stiffness to the core equivalents, which is desirable for a core replacement. However, the HDPE tube can have a thicker wall, to have greater cross-sectional area to bear the tensile load, thereby keeping the peak stress lower, and still exhibit radial stiffness similar to that of a cardboard core with a commensurate outside diameter.

Though the density of HDPE is higher than typical core board, so the mass and polar inertia of the plastic tubes is greater, they are still far lower, and much closer to a core equivalent, than rigid mandrels. See Table 3 for a comparison of typical cardboard cores to HDPE tubes. The table includes values for typical aluminum alloy, steel alloy, carbon fiber-reinforced polymer composite, glass fiber-reinforced polymer composite, and polyvinyl chloride tubes. These values are best case because they are for simple uniform cross-section circular tubes and do not include the mass of the end features on the tubes which are used to cooperate with a grasping means.

TABLE 3

| | | 1-Ply Core | 2-Ply Core | HDPE Tube | Aluminum Alloy Tube | Steel Alloy Tube | Carbon Fiber Tube | Glass Fiber Tube | Polyvinyl Chloride Tube |
|---|---|---|---|---|---|---|---|---|---|
| Specific Gravity | — | 0.66 | 0.75 | 0.95 | 2.70 | 7.85 | 1.60 | 1.95 | 1.40 |
| Specific Weight | #/in$^3$ | 0.024 | 0.027 | 0.034 | 0.097 | 0.283 | 0.058 | 0.070 | 0.051 |
| Outer Diameter | in | 1.700 | 1.700 | 1.700 | 1.700 | 1.700 | 1.700 | 1.700 | 1.700 |
| Wall Thickness | in | 0.018 | 0.020 | 0.036 | 0.060 | 0.060 | 0.060 | 0.060 | 0.100 |
| Inner Diameter | in | 1.665 | 1.661 | 1.628 | 1.580 | 1.580 | 1.580 | 1.580 | 1.500 |
| Section Area | in$^2$ | 0.094 | 0.104 | 0.188 | 0.309 | 0.309 | 0.309 | 0.309 | 0.503 |
| Length | in | 105 | 105 | 105 | 105 | 105 | 105 | 105 | 105 |

TABLE 3-continued

| | | 1-Ply Core | 2-Ply Core | HDPE Tube | Aluminum Alloy Tube | Steel Alloy Tube | Carbon Fiber Tube | Glass Fiber Tube | Polyvinyl Chloride Tube |
|---|---|---|---|---|---|---|---|---|---|
| Weight | # | 0.24 | 0.30 | 0.68 | 3.16 | 9.20 | 1.87 | 2.28 | 2.67 |
| Mass | $\# \cdot s^2/in$ | 0.00061 | 0.00077 | 0.00176 | 0.00820 | 0.02383 | 0.00486 | 0.00592 | 0.00691 |
| Polar Inertia | $\# \cdot in \cdot s^2$ | 0.00043 | 0.00054 | 0.00122 | 0.00552 | 0.01604 | 0.00327 | 0.00399 | 0.00444 |

Some of the numerous advantages of using as mandrels thin-walled, flexible plastic tubes that behave much like cardboard cores are listed below:

- Lightweight and flexible mandrels do not cause catastrophic machine damage during crashes at high speeds as rigid mandrels do.
- Mandrels can be bent, crumpled, and crushed during a high speed crash or web blowout, but do not shatter or splinter into small pieces. Nearly always the mandrel remains a large single piece, so it is easy to remove, poses no hazard to the operator, and does not leave debris behind that can enter subsequent products.
- Lightweight and flexible mandrels do not require expensive and easily damaged rubber coatings on the wind nest rolls and cradle fingers. Instead, as with cores, the compliance is in the tube.
- Can be used in rewinders that also make products with cores, with only minor modifications to the rewinders necessary to achieve this. This affords the following benefits, and addresses the major obstacles to making coreless rewinding economical.
  - Has capital cost and space requirements similar to machines that run with cores.
  - Has operating costs (consumables and maintenance) similar to machines that run with cores.
  - Requires operator training and skill level similar to machines that run with cores.
  - Can operate reliably at high web speed and cycle rate.
  - Can be quickly and easily switched between production with and without cores.
- Low mass and low polar inertia mandrels afford good control at high web speeds.
- Lightweight and flexible mandrels expand the operating window of coreless surface winders to include low firmness, loosely wound products that have never before been possible on coreless surface winders.
- Their simple tube geometry allows the use of standard core position guides, i.e., idling core plugs which are inserted into the ends of a core to maintain its axial position during winding (the same as used with cores).
- Due to the low coefficient of friction and good release characteristic of HDPE, the mandrels are self-cleaning with many codes of transfer glue, so periodic washing is not required.
- If periodic washing is required for a chosen transfer glue, the washing is very simple because (a) HDPE will not corrode, and (b) its single-piece construction of constant cross-section has no ledges nor seams to trap water.
- Mandrels are inexpensive.
- Mandrels can be custom extruded to specified diameter and wall thickness. Therefore, the tube wall can be defined according to the needs of the process and the tube outside diameter can be adjusted if necessary to meet a customer request.
- Mandrels have excellent corrosion resistance.
- Mandrels have excellent chemical resistance.
- Mandrels have good impact strength.
- Mandrels have good fatigue resistance.
- Mandrels are FDA approved for food contact.
- Mandrels are readily recyclable (no. 2 plastic). They are especially simple to recycle because they have no dissimilar material component (metal inserts, etc.) to be disassembled or removed.
- Mandrels have low coefficient of friction.
- Mandrels have good abrasion and wear resistance.

It may seem the mandrels would be too weak, given their low tensile yield strength. But, they have a very low coefficient of friction and the strip forces for consumer grade (low firmness) and commercial grade (medium firmness) BRT (bathroom tissue) are rather low. The strip forces only get high when the log firmness (wind tightness) increases.

Typical consumer and commercial grades of BRT wound on a 1.70 inch OD×0.036 inch wall×114 inch long HDPE tube require between 30 to 350 pounds force for mandrel extraction from a log wound from a 105 inches wide web. The extraction force varies greatly depending on the tightness of the wind, drying time of the transfer glue, coefficient of friction of the substrate on HDPE, and other factors. Nonetheless, the tensile stress induced by 350 pounds is only 1,863 psi, which is well below the tensile yield strength of 4,000 psi. The safety factor is 4,000/1,863=2.1. This is a good safety factor, as will be explained later.

So far this looks good. But, it gets even better. As will be explained in subsequent sections, using a radially and axially elastic mandrel, for instance of HDPE, affords further advantages.

Forming Coreless Rolls with Elastic Mandrels

Figure 8:
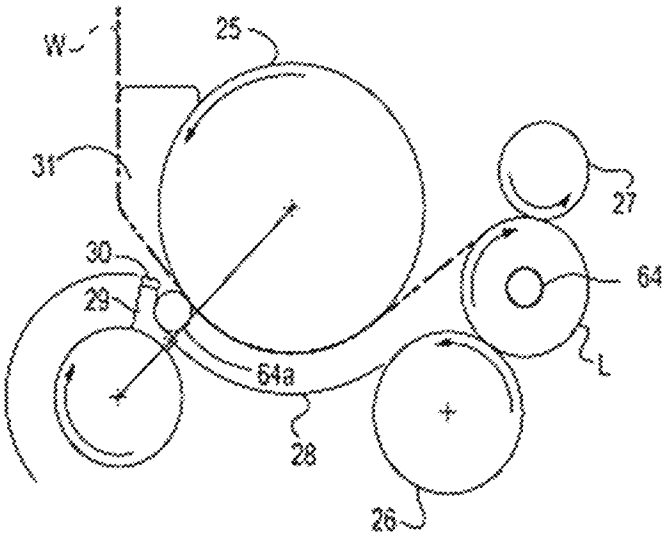
FIG. 8 illustrates the surface rewinder of FIG. 1 winding a web of paper around mandrels which are formed in accordance with the invention.

FIG. 8 illustrates the prior art surface rewinder of FIG. 1, but rather than using cardboard cores, the web of paper is wound on lightweight, low inertia, radially compliant, axially elastic mandrels 64 which are formed in accordance with the invention, for example, the tubular mandrel 60 of FIG. 4. In FIG. 8 the mandrels 64 are used to wind paper logs or rolls L in the same way as the cardboard cores which are described in U.S. Pat. No. 6,056,229.

FIG. 8 illustrates a web of paper W forming a first log L which is being wound on a first mandrel 64 between the second and third winding rolls 26 and 27. Before the log L is completely wound, a new mandrel 64*a* is introduced into the channel between the first winding roll 25 and the rolling surface 28 by the rotating pinch arm 29. A linear stripe of transfer glue or adhesive has already been applied to the mandrel 64*a* in the conventional manner. Alternatively, circumferential rings of adhesive can be applied in the conventional manner Continued rotation of the pinch arm 29 causes the pinch pad 30 to pinch the web against the stationary pinch bar 31 to sever the web along a perforation line in the web. The mandrel 64*a* is moved by the pinch arm along the rolling surface 28 to a position in which the radially compliant and low inertia mandrel is compressed and accelerated by the first winding roll 25 and begins to roll on the rolling surface at approximately ½ of the web speed. As the mandrel 64*a* rolls on the rolling surface 28, the adhesive on the mandrel picks up the leading portion of the severed web so that the web begins to wind onto the mandrel as the mandrel rolls over the rolling surface. The tail end of the severed web continues to be wound up onto the log L. The mandrel 64*a* continues to roll on the rolling surface 28 and winds the web therearound to form a new log. When the mandrel 64*a* and the new log reach the nip between the first and second winding rolls 25 and 26, the radially compliant, low inertia mandrel compresses and accelerates as the log moves through the nip in a manner similar to a cardboard core. The complete winding method is described in U.S. Pat. No. 6,056,229.

Mandrels 64 can also be used in place of cardboard cores in the prior art rewinders which are illustrated in FIGS. 2 and 3, as well as other rewinders which wind a paper web onto a cardboard core. In each case, the rewinder can wind the paper onto the mandrels in the same way as the rewinder winds paper onto cardboard cores.

The axially elastic solid mandrel 61 of FIG. 6, or an axially elastic thick-walled version of the tubular mandrel 60 that is radially stiff, can be used to wind coreless paper logs or rolls L in the same way as the rigid mandrels which are described in U.S. Pat. No. 6,056,229 with the same transfer and winding depicted in FIGS. 13 and 14 of that patent.

Figure 9:
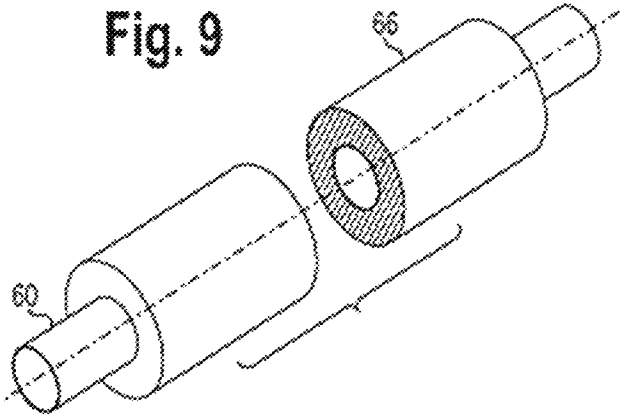
FIG. 9 is a perspective view, partially broken away, of a roll or log of paper convolutely wound around the mandrel of FIG. 4.
Figure 11:
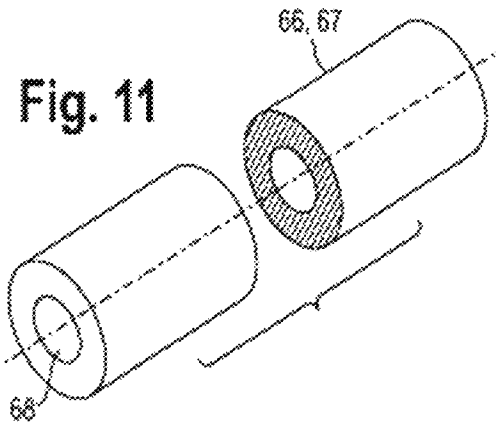
FIG. 11 is a perspective view, partially broken away, of the roll or log of paper of either FIG. 9 or 10 after the mandrel has been extracted from the roll or log.
Figure 10:
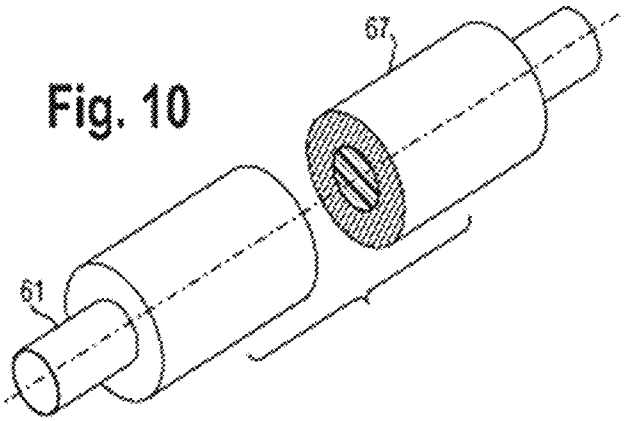
FIG. 10 is a perspective view, partially broken away, of a roll or log of paper convolutely wound around the mandrel of FIG. 6.

FIG. 9 illustrates a log 66 of paper which has been convolutely wound on a tubular mandrel 60 by any of the rewinders which have been discussed herein. Similarly, FIG. 10 illustrates a log 67 of paper which has been convolutely wound on a solid mandrel 61 by such a rewinder. In each case the mandrel preferably extends beyond one or both ends of the log of paper so that the mandrel can be extracted or withdrawn from the log by grasping one or both ends of the mandrel. FIG. 11 illustrates the log 66,67 of either FIG. 9 or FIG. 10 after the mandrel has been withdrawn. An axially extending central opening 68 extends through the log.

Mandrel Extraction

The force to extract a rigid mandrel from a log (or push a log off a rigid mandrel) is linear with respect to the length of the mandrel-log engagement after relative motion is established. The force to initiate relative motion is actually much greater, so the graph of the force profile has steps in it.

The following values are provided as an example to illustrate the point. The measured extraction forces will vary greatly depending on tightness of the wind, drying time of the transfer glue, coefficient of friction of the substrate on the mandrel surface, and other factors. Measurements of the force required to strip logs were recorded on the PCMC coreless machine described in U.S. Pat. No. 6,056,229. The product was a tightly wound, very dense bathroom tissue. The log length (web width) was 1.00 inches. The mandrel was of the rigid type, made of alloy steel tube, with outside diameter of 0.688 inches.

Figure 42:
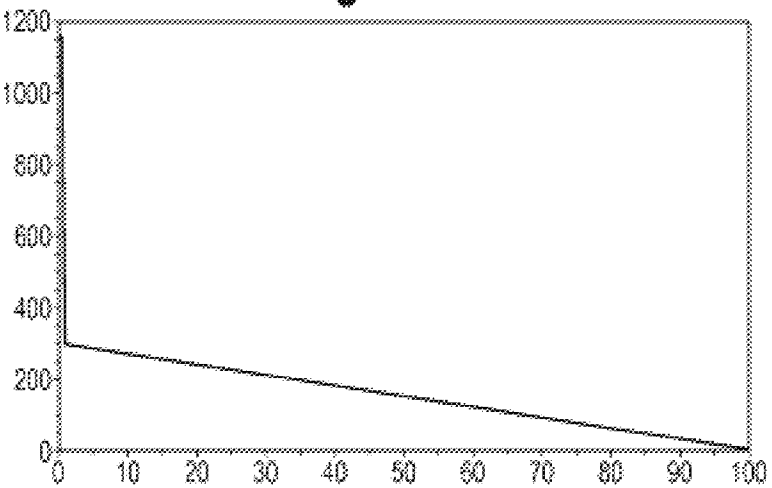
FIGS. 42-45 illustrate forces required to break a mandrel free from a log under various conditions.

The force to break the log free of the mandrel, initiating relative motion, was about 1,160 lbs. This force level was of very brief duration, exhibiting the appearance of an upward spike in the graph. The force immediately dropped to 300 lbs, which was the level to maintain relative motion with 100 inches of mandrel-log engagement. The force decreased linearly as the mandrel withdrew until it reached zero at the moment the mandrel end exited the log (no mandrel-log engagement). FIG. 42 shows actuator force vs. actuator position for this case of rigid mandrels. Less tightly wound products require less stripping force, and thus have lower force values on their graphs, but the general shape of their graphs is the same.

The breakaway force is very high relative to the stripping force. It is 3.87 times larger. The stripping force, after relative motion is underway, is only 26% as much as the breakaway force. When rigid mandrels are used, the mandrels, the stripping (or extraction) hardware, actuator drive train, and actuator must be designed to accommodate the very high initial force to initiate relative motion. However, when elastic mandrels are used, the peak force can be greatly reduced. Instead of breaking free of the mandrel all at once, as with rigid mandrels, elastic mandrels break free progressively and smoothly as they stretch within the log. The mandrels can be stretched in this fashion, due to their relatively low elastic modulus values. And because the peak force is far less, the peak stress is far less, so the relatively low strength plastic mandrels are strong enough.

Figure 43:
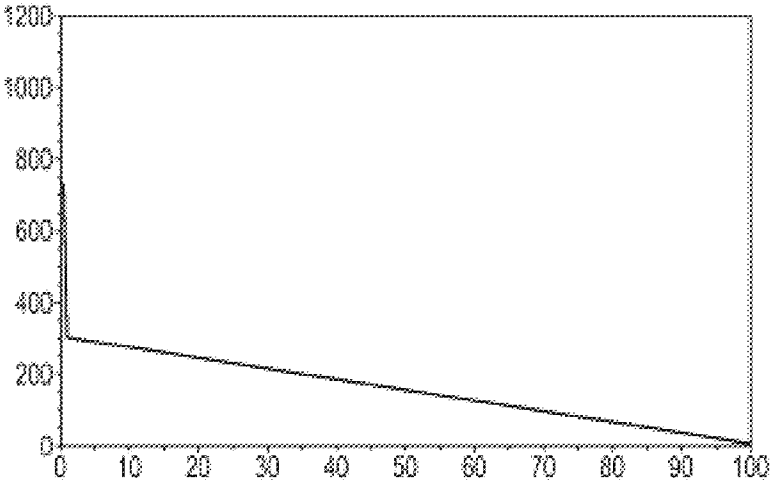

FIG. 43 shows the case of an axially elastic mandrel being withdrawn from the same product discussed with respect to FIG. 42. The graph assumes the same coefficient of friction, though the value for HDPE could be lower. It shows the case of the mandrel being pulled from just one end, where mandrel elongation causes it to progressively and smoothly break free over one-half of the log length before the other half breaks free suddenly. The height of the spike above the 300 lbs stripping force is reduced by one-half, from 1,160 lbs to 730 lbs.

If the 730 lbs peak force is acceptable for the mandrel cross-section, because the induced tensile stress is low enough relative to the yield strength of the material, then this simple pulling method may be utilized.

Figure 44:
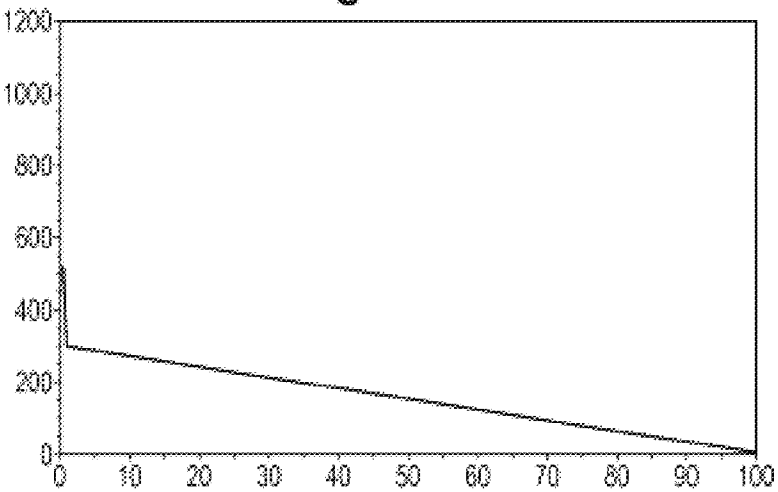

If, however, the reduced peak force is still too great, then an actuator may be added to push the other end of the mandrel. FIG. 44 shows the case of an axially elastic mandrel being withdrawn from the same product. The graph assumes the same coefficient of friction, though the value for HDPE could be lower. It shows the case of the mandrel being solely pulled from one end until mandrel elongation has caused it to progressively and smoothly break free over nearly one-half of the log. Then, before the other half breaks free suddenly, an actuator at the other end of the mandrel begins to push the mandrel in the same direction. The other one-half of the mandrel still breaks free suddenly, but the load is shared nearly evenly between the two actuators. This can be assured by timing the pushing actuator to move when the pulling actuator nears a preset travel distance or a preset torque level, both of which are known due to electronic feedback signals. Thus, the height of the spike above the 300 lbs stripping force is reduced by three-quarters, from 1,160 lbs to 515 lbs. If the 515 lbs peak force is acceptable for the mandrel cross-section, because the induced tensile stress is low enough relative to the yield strength of the material, then this pulling-pushing method may be utilized.

Figure 45:
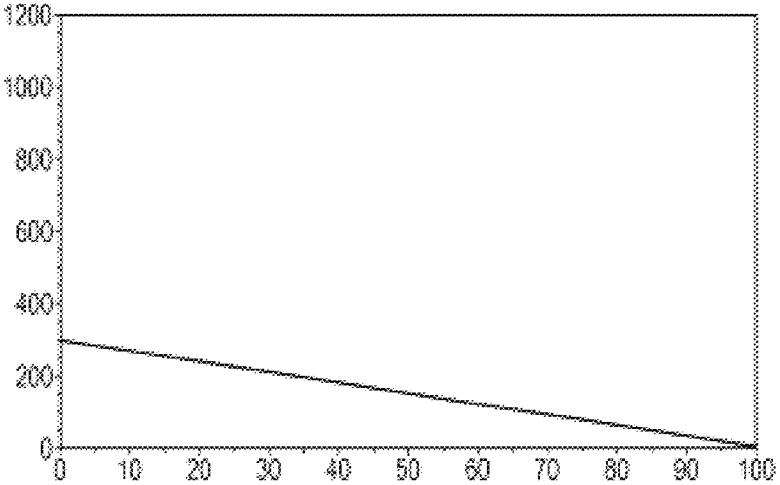

If, however, the reduced peak force is still too great, then an actuator may be added to pull the other end of the mandrel. FIG. 45 shows the case of an axially elastic mandrel being withdrawn from the same product. The graph assumes the same coefficient of friction, though the value for HDPE could be lower. It shows the case of the mandrel being pulled from both ends until mandrel elongation has caused it to progressively and smoothly break free over the entire length of the log, so no segment breaks free suddenly. The load is shared nearly evenly between the two actuators. After the entire length of mandrel is in motion relative to the log the second puller reverses direction and releases before touching the face of the log. This sequence can be precisely timed and controlled because both actuators have servo motion control with electronic feedback signals. Thus the spike above the 300 lbs stripping force can be eliminated.

If the 300 lbs peak force is acceptable for the mandrel cross-section, because the induced tensile stress is low enough relative to the yield strength of the material, then this mandrel stretching method may be utilized. If it is not, then additional measures can be employed to further reduce the peak force, such as implementing pressurized expansion during winding, as described later in this document.

The preceding values are comparative illustrations extrapolated from measured values, not absolute values. It was stipulated, for instance, that pulling the mandrel from one end would cause it to progressively and smoothly break free within one-half the length of the log. In reality, the proportion that breaks free gradually in this fashion may be more or less, depending on the cross-section of the mandrel, the tightness of the wind, and other factors.

The preceding values were a comparative illustration of rigid mandrels versus elastic mandrels. In fact, elastic mandrels have another advantage not included in the comparison, which considered only the axial elasticity of the mandrels. Many engineering and commodity plastics have relatively high Poisson's ratio values. Thus a mandrel undergoing axial elongation will simultaneously undergo small, but significant, diameter reduction. The reduction in diameter serves to further reduce the extraction/stripping force by reducing the contact pressure between the log and the mandrel.

Stretching a 100 inches long HDPE tube, or solid rod, by 1.35%, which is one-half its tensile yield strength divided by elastic modulus, increases its length by 1.35 inches. The accompanying diameter reduction of a 0.688 inches OD tube, or solid rod, is 0.0039 inches. The accompanying diameter reduction of a 1.700 inches OD tube, or solid rod, is 0.0096 inches.

HDPE Behavior

The stress-strain curves for many materials differ from that cited earlier in this document for aluminum alloy, in that they do not have a well-defined corner at the transition from elastic to permanent deformation (yield point). Instead, after the initial linear portion, the curve arcs gradually into the region of permanent deformation. This is the case for most homogeneous polymers, and is the case for HDPE, as shown in Azom.com: http://www.azom.com/article.aspx?ArticleID=510, which has stress-strain curves for various polymers.

The offset yield strength method is often used to define the yield point for highly ductile metals. A construction line is drawn parallel to the initial portion of the stress-strain curve. Its intersection with the horizontal axis is offset by 0.002 from the origin. The 0.2% offset yield strength is the stress at which the construction line intersects the stress-strain curve as shown on page 151 of *The Science and Engineering of Materials,* $2^{nd}$ Edition, by Donald R. Askeland, 1989, by PWS-KENT Publishing Company. ISBN 0-534-91657-0

It seems suppliers of polymer resins and products rarely use this method, or do not use it at all. Most tables of tensile data for polymer resins cite ASTM D638 or ISO 527, which define standard tensile testing methods. The standards give the reported values context, so they can be compared, but actual stress-strain curves contain more data and thus are the most comprehensive and useful. Unfortunately, stress-strain curves for any specific combination of polymer formulation and processing method are rarely available.

The following information is taken from IDES:

http://www.ides.com/property_descriptions/ISO527-1-2.asp

IDES is a plastics information management company that provides a searchable online data sheet catalog and database of material properties of plastics called Prospector. IDES also manages technical polymer data for several plastic manufacturers and nearly all resin distributors. IDES is headquartered in Laramie, Wyo.

Tensile Testing According to ISO 527

Tensile testing is performed by elongating a specimen and measuring the load carried by the specimen. From a knowledge of the specimen dimensions, the load and deflection data can be translated into a stress-strain curve. A variety of tensile properties can be extracted from the stress-strain curve.

| Property | Definition |
|---|---|
| Tensile Strain at Break | Tensile strain corresponding to the point of rupture. |
| Nominal Tensile Strain at Break | Tensile strain at the tensile stress at break. |
| Tensile Strain at Yield | Tensile strain corresponding to the yield (an increase in strain does not result in an increase in stress). |
| Tensile Stress at Break | Tensile stress corresponding to the point of rupture. |
| Tensile Stress at 50% Strain | Tensile stress recorded at 50% strain. |
| Tensile Stress at Yield | Tensile stress corresponding to the yield point (an increase in strain does not result in an increase in stress). |
| Tensile Modulus | Often referred to as Young's modulus, or the modulus of elasticity, tensile modulus is the slope of a secant line between 0.05% and 0.25% strain on a stress-strain plot. Tensile modulus is calculated using the formula: $E_1 = (\sigma_2 - \sigma_1)/(\varepsilon_2 - \varepsilon_1)$ where $\varepsilon_1$ is a strain of 0.0005, $\varepsilon_2$ is strain of 0.0025, $\sigma_1$ is the stress at $\varepsilon_1$, and $\sigma_2$ is the stress at $\varepsilon_2$. |

Figure 46:
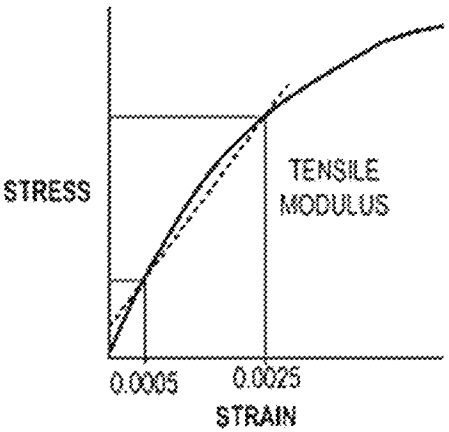
FIG. 46 illustrates the points on a stress-strain curve that are used to calculate tensile modulus.

FIG. 46 illustrates the points that are used to calculate tensile modulus.

The two most important things to take from this explanation of ISO 527 are (a) the definition of the yield point and (b) the method of elastic modulus calculation.

The yield point is defined as when an increase in strain does not result in an increase in stress. This means the yield point coincides with the first inflection point on the HDPE stress-strain curve. This is well beyond both the proportional limit and elastic limit of the material.

The elastic modulus (slope of the curve) is calculated between 0.05% strain and 0.25% strain. This is very close to the origin, at relatively low strain values, compared to how much thermoplastic polymers can stretch, and how much the elastic mandrels are expected to safely elongate in service.

Figure 47:
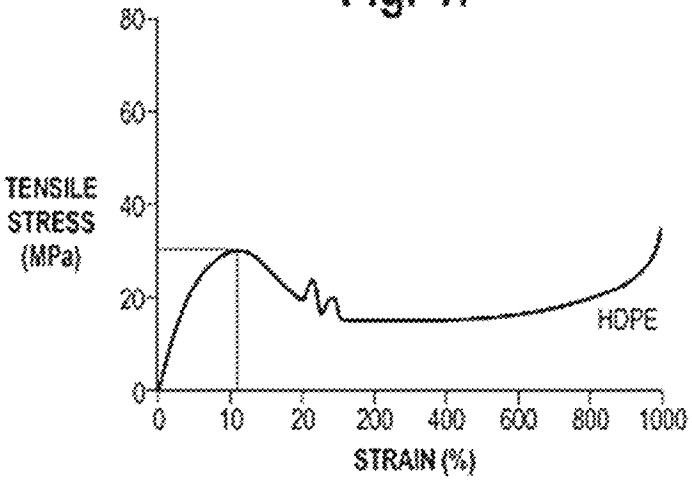
FIG. 47 illustrates the yield point of HDPE on a stress-stain curve.

FIG. 47 identifies the yield point of HDPE on a stress-strain curve. The horizontal line is the yield strength ($S_y$), drawn at about 30 MPa (4,350 psi). The vertical line is the strain at yield ($\varepsilon_y$), drawn at nearly 11%.

The proportional limit of a material is the point beyond which the linear relationship of Hooke's Law is no longer valid. The elastic limit of a material is the point beyond which the material does not fully recover to its original length when the load is removed. Some materials, particularly many metallic alloys, have stress-strain curves that are linear nearly all the way to the yield point, causing the proportional limit, elastic limit, and yield strength to nearly coincide. This graph correctly illustrates that is not remotely the case for HDPE—both the proportional limit and elastic limit of HDPE are reached well before the yield point, so the yield strength is not a good criterion to use when designing elastic mandrels with this material, because the mandrels must return to approximately their original lengths after each cycle to be reusable (recirculated).

Figure 48:
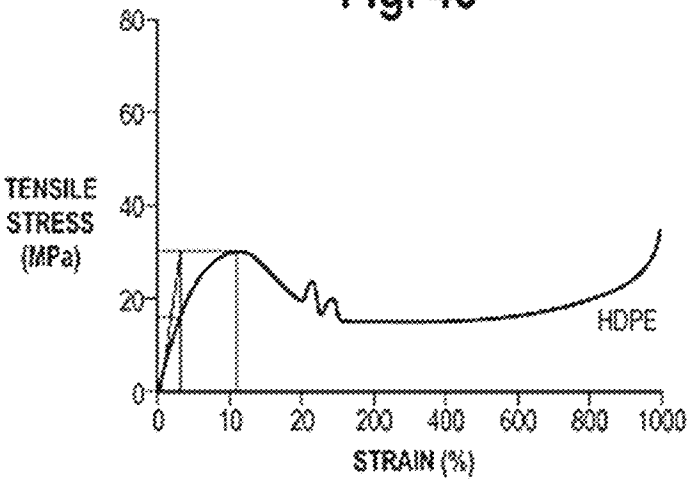
FIG. 48 is similar to FIG. 47 and identifies additional properties of HDPE.

FIG. 48 is similar to FIG. 47 but has additional lines drawn on it. The diagonal line is drawn tangent to the curve at the origin and represents the modulus of elasticity (E). The vertical line is drawn where the diagonal line intersects the yield strength line and represents the yield strength divided by elastic modulus ($\varepsilon_o$). The short horizontal line is drawn from where the new vertical line intersects the stress-strain curve and represents the stress ($\sigma_0$) corresponding to the yield strength divided by elastic modulus ($\varepsilon_o$).

$S_y$=30 MPa=4,350 psi $\varepsilon_y$=0.11=11%

$\varepsilon_o$=0.029=2.9%

$\sigma_o$=16.5 MPa=2,400 psi $E=S_y/\varepsilon_o$=150,000 psi

Therefore, if this HDPE is elongated 2.9% it will initially experience stress of 2,400 psi. The safety factor of this stress level relative to the yield strength is 4,350/2,400=1.8. The narrowly defined, and usual, meaning of this safety factor is that the induced stress is 55% of the yield strength, so localized draw (necking) and gross elongation will not occur. However, because this strain is technically beyond the elastic limit, a guideline to the magnitude of strain that can be imposed and still have the mandrel return to its original length when the load is removed is required. This is addressed next.

Properties of HDPE vary depending on supplier and processing method. The amount of information they provide regarding the mechanical properties of their resins also varies. Nearly every supplier can provide at least values for the elastic modulus (E) and yield strength ($S_y$), however. Our experience with HDPE tubes has shown that the following guidelines are good when designing elastic mandrels.

The yield strength is divided by the elastic modulus using the following equation:

$60=S_y/E$

The elastic portion of the mandrel can be elongated by one-half to two-thirds of $\varepsilon_o$ during extraction from the log and still return close enough to its original length, rapidly enough, to be recirculated in a continuously operating coreless rewinder. (This is possible because the machine must accommodate some tolerance in mandrel length anyway, and the variation falls within the tolerance of the machine. Machines operating at higher cycle rates may require a greater quantity of mandrels in circulation, or that mandrels be elongated less during extraction. This is a reasonable requirement because shorter products that can be run at high cycle rates typically are loosely wound and thus have relatively low extraction forces.) A mandrel strained to this degree does not immediately return to its original length because it was strained, beyond the elastic limit of the material. However, it does eventually return to its original length. The return to original length occurs most rapidly at first and more slowly as the mandrel approaches its original length. It may take several hours for the mandrel to restore itself completely to its original length because the last millimeters take the longest.

The elastic portion of the mandrel can be subjected to greater elongation without permanent deformation nor damage when it is loaded (stretched) more slowly. When loaded more rapidly it is more likely to experience localized draw or even tearing.

HDPE and other thermoplastic polymers respond to stress with the behaviors of both elastic solids and viscous fluids. This characteristic is referred to as viscoelasticity. The properties of viscoelastic materials are subject to change based on the variables of load application rate, load duration (time), and temperature. The viscoelastic behavior of HDPE explains the behaviors outlined in the paragraphs above.

Load application rate is quite simple. When the load is applied more rapidly, the material appears to be stiffer (reacts with higher elastic modulus). When the load is applied less rapidly, the material reacts with lower elastic modulus. This behavior is illustrated on page 151 of *History and Physical Chemistry of HDPE*, by Lester H. Gabriel, Ph.D., P.E. http://www.plasticpipe.org/pdf/chapter-1_history_physical_chemistry_hdpe.pdf Because the load application rate influences the elastic modulus of the mandrel material, a computerized servo system with feedback should be used to properly control, and allow adjustments to, the motion profiles applied to the mandrel, for both stretching and extracting.

The effect of time is a little more complicated. Viscoelastic materials creep under constant stress and relax under constant strain. This means that a winding mandrel composed of a viscoelastic material subjected to a fixed load will continue to elongate. It means that the same mandrel subjected to a fixed elongation will undergo a reduction in stress. It is as though the elastic modulus of the material decreases over time. Therefore, to maintain constant elongation an actuator must reduce the applied force over time.

Because the applied load must be reduced over time if a constant elongation is to be maintained, a computerized servo system with feedback should be used to properly control, and allow adjustments to, the force applied to the mandrel, for both stretching and extracting.

The effect of temperature within the operating range of the mandrels is straightforward. When its temperature is lower, the material appears to be stiffer (reacts with higher elastic modulus). When its temperature is higher, the material reacts with lower elastic modulus. But, there are some insights that can be gained by also looking at the behavior of the material over much larger temperature range.

HDPE is a semi-crystalline thermoplastic with a low glass transition temperature. In this regard it is not unique, but it is unusual. Illustrations of the effect of temperature change on the elastic modulus of thermoplastics over a large temperature range may be found at http://www.azom.com/articie.aspx?ArticieID=83 and section 2.3, page 28 of *Thermoplastics—Properties*, by J. D. Muzzy, Georgia Institute of Technology, Atlanta, Ga., USA. This document is available at the following web site: http://www-old.me.gatech.edu/jonathan.colton/me4793/thermoplastchap.pdf These illustrations show the glass transition temperature, $T_g$, and the melting point temperature, $T_m$. Both are drawn for comparison, implying the $T_g$ values and $T_m$ values are the same for the amorphous and the semi-crystalline materials. In reality the values for $T_g$ and $T_m$ vary widely not only between these material types, but also among materials of the same type.

Some semi-crystalline polymers exhibit a well-defined glass transition region, as illustrated in *Thermoplastics—Properties*, while others do not, as illustrated in the azom.com article. The values presented earlier in this document are approximate and representative. Precise values are not necessary for this discussion, however. The main relevance of these values is whether they reside above or below the operating temperature of the winding mandrels. For the most part this means ambient temperature in converting factories, usually 60 to 100° F.

Glass transition temperature and melting point temperature for semi-crystalline and amorphous polymers are explained at the below web site. Paraphrased excerpts are provided in this section.

http://www.articlesbase.com/technology-articles/polymer-science-1653837.html

- Above the melting point temperature, the polymer remains as a melt or liquid.
- Between the glass transition temperature and melting point temperature, the polymer behaves much like a rubber. They appear leathery or rubbery. In common usage a useful rubber is a polymer having its $T_g$ well below room temperature.
- As they approach the glass transition temperature from above, polymers become stiffer and pass through a temperature called the brittle point, slightly higher than the glass transition temperature. By this point their flexible nature and rubbery properties have gradually been lost. The material is stiffer and harder and will break or fracture on sudden application of load.
- Below the glass transition temperature, polymers are relatively harder, stiffer, and more brittle. $T_g$ is a common reference point for polymers of diverse nature, below which all of them behave as stiff rigid plastics (glassy polymer). In common usage a useful plastic is one whose $T_g$ is well above room temperature.
- Molecular weight and molecular weight distribution; external tension or pressure, plasticizer incorporation, copolymerization, filler or fiber reinforcement, and cross linking are some of the important factors that influence the glass transition and melting point temperatures. External plasticizer incorporation is very effective at lowering the glass transition temperature and can be used to reformulate polymers that are stiff and rigid at room temperature into polymers that are flexible and rubbery at room temperature.

As suggested in the excerpts above, most plastics are utilized in formulations that have glass transition temperatures well above ambient. In fact, many engineering plastics were developed specifically with elevated glass transition temperatures to remain stiff and strong in elevated temperature service. This point is illustrated for various commercially available polymers in a Products And Applications Guide published by the following plastics supplier and is available at the web address below:

Quadrant Engineering Plastic Products
2120 Fairmont Avenue
PO Box 14235
Reading, Pa. 19612-4235 http://www.quadarantplastics.com/fileadmin/quadrant/documents/QEPPNA/Brocures_PDF/General/Products_Applications_Guide.pdf The publication plots dynamic modulus (stiffness) versus material temperature for loads of short duration. The points of rapid drop-off on the curves coincide with the glass transition temperatures. For the most part these points lie between 100° F. to 500° F., with the majority above 150° F.

The glass transition temperature for HDPE is about −120 to −130° F. Its brittle point temperature is below −80° F. Its softening point temperature is about 250° F. Its melting point temperature is 265° F. Thus, the operating temperature of a mandrel composed of HDPE is well above the glass transition and brittle point temperatures, and well below the softening and melting point temperatures. This explains why the material has such a good combination of pliability, stretch-ability, durability, and toughness that make it well suited for use as a winding mandrel, especially the radially compliant, thin-walled variety that can act as a core equivalent.

The *SECOND EDITION HANDBOOK OF PE PIPE* from the Plastic Pipe Institute is an excellent introduction to HDPE material and its application. Paraphrased excerpts, taken from pages 55-56 of chapter 3, are provided in this section. The handbook is available at the following web site.

http://plasticpipe.org/publications/pe_handbook.html

- PE piping material consists of a polyethylene polymer (commonly designated as the resin) to which has been added small quantities of colorants, stabilizers, antioxidants and other ingredients that enhance the properties of the material and that protect it during the manufacturing process, storage and service. PE piping materials are classified as thermoplastics because they soften and melt when sufficiently heated and harden when cooled, a process that is totally reversible and may be repeated. In contrast, thermosetting plastics become permanently hard when heat is applied.
- Because PE is a thermoplastic, PE pipe and fittings can be fabricated by the simultaneous application of heat and pressure. And, in the field PE piping can be joined by means of thermal fusion processes by which matching surfaces are permanently fused when they are brought together at a temperature above their melting point.
- PE is also classified as a semi-crystalline polymer. Such polymers (e.g., nylon, polypropylene, polytetrafluoroethylene), in contrast to those that are essentially amorphous (e.g., polystyrene, polyvinylchloride), have a sufficiently ordered structure so that substantial portions of their molecular chains are able to align closely to portions of adjoining molecular chains. In these regions of close molecular alignment crystallites are formed which are held together by secondary bonds. Outside these regions, the molecular alignment is much more random resulting in a less orderly state, labeled as amorphous. In essence, semi-crystalline polymers are a blend of two phases, crystalline and amorphous, in which the crystalline phase is substantial in population.
- A beneficial consequence of PE's semi-crystalline nature is a very low glass transition temperature ($T_g$), the temperature below which a polymer behaves somewhat like a rigid glass and above which it behaves more like a rubbery solid. A significantly lower $T_g$ endows a polymer with a greater capacity for toughness as exhibited by performance properties such as: a capacity to undergo larger deformations before experiencing irreversible structural damage; a large capacity for safely absorbing impact forces; and a high resistance to failure by shattering or rapid crack propagation. These performance aspects are discussed elsewhere in this Chapter. The $T_g$ for PE piping materials is approximately −130° F. (−90° C.) compared to approximately 221° F. (105° C.) for polyvinyl chloride and 212° F. (100° C.) for polystyrene, both of which are examples of amorphous polymers that include little or no crystalline content.

Other Mandrel Materials

Though HDPE is an excellent choice of material for an elastic mandrel, other materials can be used. For example, polypropylene has a fair amount of pliability, stretchability, durability, and toughness because it also has a glass transition temperature below ambient.

Materials with glass transition temperatures above ambient, such as nylon and polycarbonate, may also work, for instance, as axially elastic mandrels. These would be useable in rewinders that accept radially rigid mandrels and they would offer at least the advantages of low cost, low mass, low polar inertia, and reduced extraction force. It may be favorable to use them in a case, for instance, where greater flexural stiffness than HDPE is desirable for mandrel handling and conveyance (for example, GS Nylon (460,000 psi) and polycarbonate (350,000 psi) both have flexural elastic moduli significantly higher than HDPE (180,000 psi)) or when a stronger mandrel is required (for example, GS Nylon (12,500 psi) and polycarbonate (9,500 psi) both have significantly greater yield strength than HDPE (4,000 psi)). The main drawback of these other materials is their relative brittleness, so they may rupture into many pieces during a machine crash or jam. Alternatively, plasticizers may be added to some of these materials to shift $T_g$ from above ambient to below ambient, if this does not also reduce the strength, and other attractive properties, too greatly.

Polyvinyl Chloride

A section on polyvinyl chloride (PVC) is warranted because PVC pipe may have been tried in the past on some rewinders and may even be in use now on some rewinders. PVC pipe may have been tried as an alternative to the metallic alloy mandrels used in start-stop coreless rewinders and is known to have been used as a winding mandrel to make coreless logs in at least one continuous-running rewinder. Rigid PVC pipe is appealing relative to metallic alloys and fiber-reinforced composites because it is readily available, machinable, low friction, inexpensive and relatively lightweight.

The following web sites list commercially available metric PVC pipe sizes.

http://www.epco-plastics.com/pdfs/pvc%20-%2057-87.pdf
http://wvw.epco-plastics.com/PVC-U_metric_technical.asp The following web sites list commercially available imperial PVC pipe sizes.

http://www.professionalplastics.com/professionalplastics/PVCPipeSpecifications.pdf
http://www.sd-w.com/civil/pipe_data.htm PVC pipe is an amorphous thermoplastic with a high glass transition temperature. Because its glass transition temperature is far above ambient, it is stiff and relatively brittle in service, especially when subjected to sudden loads. Table 2 that shows typical mechanical properties for various polymers, presented earlier in this document, lists values for 'rigid' PVC (low plasticizer content) that is used in commercially available pipe. These values are from the following web sites.

http://www.professionalplastics.com/professionalplastics/PVCPipeSpecifications.pdf
http://www.sd-w.com/civilpipe_data.htm The following paraphrased excerpts are taken from pvc.org, which is available at the following web site.

http://www.pvc.org/en/p/pvc-strength

The glass transition temperature of PVC is over 70° C. (158° F.). The result is low impact strength at room temperature, which is one of the disadvantages of PVC.

There are many ways to measure impact strength. The foregoing web site has a chart showing the energy absorbed by test pieces of various plastic materials when they are fixed and hammered to break (failure). Higher values indicate higher impact strength. Rigid PVC is at the low end of the scale.

The foregoing web site also has charts showing comparisons of PVC tensile elastic modulus to other plastics, and comparisons of PVC tensile strength to other plastics.

The primary drawbacks of PVC are its brittleness and its higher density. Because of its brittleness PVC mandrels may rupture into many pieces during a machine crash or jam. Due to its brittleness it cannot be used to make thin-walled, radially compliant mandrels as HDPE, and perhaps polypropylene, can. The tube wall must be thicker, especially when the mandrel OD is larger. Thicker tube wall, combined with the higher material density, ensure mandrels made from PVC will have higher mass and polar inertia than mandrels made from HDPE, and thus be more difficult to control in a rewinder, especially at high speeds.

Perhaps PVC pipe material could work as a radially rigid, somewhat axially elastic mandrel. But, its lower value of tensile yield strength divided by elastic modulus makes it less well suited to this application because, for many products, high stress levels would be reached before adequate elongation is achieved.

Plasticizers can be added to PVC to shift its glass transition temperature from above ambient to below ambient. PVC readily accepts plasticizers and this is commonly done. If this does not also reduce the strength, and other attractive properties, too greatly, it may be viable for an elastic mandrel. Use of this material would also then lie within the novelty of the present invention.

Plasticizers can shift the glass transition temperature so far that PVC becomes softer, flexible, even rubbery. In these forms it is used in clothing and upholstery, electrical cable insulation, inflatable products, automotive parts, and many applications in which it replaces rubber. With the addition of impact modifiers and stabilizers, it has become a popular material for window and door frames, also vinyl siding. It seems feasible that a formulation may exist, or be created, that could meet the requirements of an acceptable radially and axially elastic mandrel.

The following paraphrased excerpts are taken from pvc.org. They are available at the following web site.

http://www.pvc.org/en/p/pvc-additives

Polyvinyl chloride (PVC) is a versatile thermoplastic with the widest range of applications of any of the plastics family making it useful in virtually all areas of human activity.

Without additives PVC would not be a particularly useful substance, but its compatibility with a wide range of additives—to soften it, color it, make it more processable, or longer lasting—results in a broad range of potential applications from car underbody seals and flexible roof membranes to pipes and window profiles. PVC products can be rigid or flexible, opaque or transparent, colored and insulating or conducting. There is not just one PVC but a whole family of products tailor-made to suit the needs of each application.

Before PVC can be made into products, it has to be combined with a range of special additives. The essential additives for all PVC materials are stabilizers and lubricants. In the case of flexible PVC, plasticizers are also incorporated. Other additives which may be used include fillers, processing aids, impact modifiers and pigments. Additives will influence or determine the mechanical properties, light and thermal stability, color, clarity and electrical properties of the product. Once the additives have been selected, they are mixed with the polymer in a process called compounding.

Amorphous PVC Vs. Semi-Crystalline HDPE

The following excerpts were taken from the *Encyclopedia of PVC*, Second Edition, Volume 3: Compounding Processes, Product Design, and Specifications, edited by Leonard I. Nass, 1992, by Marcel Dekker. INSB 0-8247-7822-7. Portions of the book can be viewed at the following web site.

http://books.google.com/books?id=mDe7EidmgllC&pg=PA238&lpg=PA238&dq=PVCU+strain+at+yield&source=bl&ots=ITBi2RakPv&sig=90G7PuHtxMfmmUq_uzX45zHRpQ&hl=en&sa=X8ei=HTiiT_myK-jW2AXL3LHMDq&ved=0CHwQ6AEwBA#v=onepage&q=PVCU%20strain%20at%20yield&f=false The following excerpt is from the first full paragraph on page 233.

The past 16 years has also been marked by the rapid spread throughout the industry of an increased understanding of the fundamental importance of the particulate nature and crystallinity of PVC developed during the 1960s and 1970s. The changes in the morphology of rigid PVC and the way its partial crystallinity is developed in the final product by the amount of fusion (gelation*) obtained during compounding and processing have been shown to be of critical importance in achieving good quality products. Test methods to assess these properties are still under development, but the current status is reported. The performance of rigid PVC in standard tests is interpreted, wherever possible, in the light of this new knowledge, to encourage the reader to take a fundamental approach to product design, testing, problem solving, and setting performance specifications.

The following excerpt is from the last paragraph on page 234. It states that 7-10% of the volume of rigid PVC is crystalline. Apparently the remainder, which is a preponderance of the volume, is amorphous, rendering the overall composition to be termed amorphous.

Each primary particle is an independent unit containing a cluster of entangled PVC molecules. The spatial arrangement of chlorine atoms Wong the hydrocarbon backbone of the molecules is such that only about 50-70% of commercial polymer is syndiotactic [37, 38], so that long uninterrupted runs of stereospecific polymer are rare. When sufficiently long stereospecific regions become close together during polymerization (or during cooling from a melt hot enough to be amorphous), they join to form a crystalline region, binding together different regions of the same molecule and parts of adjacent molecules. The structure of these crystallites varies in perfection depending on the amount, size, regularity, and thus compatibility of the stereospecific regions. They are believed to be spaced on average about 10 nm apart and usually constitute about 7-10% of the polymer structure [6]. Each primary particle is an independent "packet," about 1 nm in diameter, comprising a three-dimensional network of these entangled PVC molecular chains, joined at about 10 nm intervals by crystalline regions of varying sizes and degrees of perfection.

The following excerpt was taken from the Handbook of Vinyl Formulating, Second Edition, edited by Richard F. Grossman, 2008, by John Wiley & Sons. INSB 978-0-471-71046-2. Portions of the book can be viewed at the following web site.

http://books.google.com/books?id=1eBbloL0bgAC&pg=PA17&lpg=PA17&dq=pvc+percent+crystallinity&source=bl&ots=pz9rStMSEE&sig=qpxRaqCQwa8o4Sq6iFkmu8Rz_g&hl=en&sa=X&ei=9ErjT9aHM6ai2gW73NWoDA&ved=OCH0Q6AEwBQ#v=onepage&q=pvc%20percent%20crystallinity&f=false The following excerpt is from the first full paragraph on page 17. It states that 5-10% of the volume of rigid PVC is crystalline.

In the world of thermoplastics, PVC is a unique polymer. Unlike many of the commodity thermoplastics competing against it, PVC is primarily an amorphous material. However, most of the commercially available PVC resins contain crystalline regions ranging from 5 to 10 percent of the polymer. Although many of these crystalline regions melt at normal PVC processing temperatures, some remain intact at temperatures well over 200° C.[8] The fact that some of these regions exist in plasticized PVC give polymer characteristics reminiscent to those of thermoplastic elastomers. These regions of crystallinity, along with the relatively narrow molecular weight distribution of PVC, help impart superior melt strength during extrusion and calendaring processes versus other polymers.[9] The mostly amorphous nature of PVC also permits the cost-effective fabrication of clear articles in thicknesses exceeding 0.250 in (10 mm) with proper additive selection.

The following paraphrased excerpts are taken from an article entitled *Polymer Science* available at Articlesbase.com. They are available at the following web site.

http://www.articlebase.com/technology-articles/polymer-science-1653837.html

Polymer morphological studies primarily relate to molecular patterns and physical state of the crystalline regions of crystallizable polymers. Amorphous, semi-crystalline and prominently crystalline polymers are known. It is difficult and may be practically impossible to attain 100% crystallinity in bulk polymers. It is also difficult according to different microscopic evidences, to obtain solid amorphous polymers completely devoid of any molecular or segmental order, oriented structures or crystallinity A whole spectrum of structures, spanning near total disorder, different kinds and degrees of order and near total order, may describe the physical state of a given polymeric system, depending on test environment, nature of polymer and its synthesis route, microstructure and stereo-sequence of repeat units, and thermo-mechanical history of the test specimen. Further, the collected data for degree of crystallinity may also vary depending on the test method employed. The degree of crystallinity data shown in Table 2 must therefore be taken as approximate.

Polymers showing degrees of crystallinity greater than 50% are commonly recognized to be crystalline. The predominantly linear chain molecules of high-density polyethylene (HDPE) show a degree of crystallinity that is much higher than any other polymer known (even substantially higher than that for the low-density polyethylene (LDPE). For HDPE, the attainable crystallinity degree is close to the upper limit (100%). Atactic polymers in general (including those of methyl methacrylate and styrene bearing bulky side groups), having irregular configurations fail to meaningfully crystallize under any circumstances.

TABLE 2

Approximate Degree of Crystallinity (%) for Different Polymers.

| Polymer | Crystallinity (%) |
|---|---|
| Polyethylene (LDPE) | 60-80 |
| Polyethylene (HDPE) | 80-98 |
| Polypropylene (Fiber) | 55-60 |
| Nylon 6 (Fiber) | 55-60 |
| Terylene (Polyester Fiber) | 55-60 |
| Cellulose (Cotton Fiber) | 65-70 |

Section Area and Stress of Mandrel and their Relationship to Extraction

When the mandrel extraction forces are low, sizing of the mandrel cross-section is not critical and is usually done to produce desired radial compliance. However, when the mandrel extraction forces are large, such as with very tightly wound products, it is helpful to optimize the section area.

The mandrel outer diameter (OD) is dictated by the required hole diameter in the finished product. The mandrel inside diameter (ID), and thus the wall thickness, are determined by the required cross-section area. The goal is to fully utilize the recommended maximum strain of one-half to two-thirds of the yield strength divided by elastic modulus ($\varepsilon_o$). This strain corresponds to an initial induced stress of somewhat less than one-half to two-thirds of the yield strength ($S_y$), because of the nonlinear response of stress to strain. If actual stress-strain curve data are available it is best to use that. However, the linear relationship of Hooke's Law is used below for simplicity.

Suppose $\varepsilon_o$=0.027 and $S_y$=4,000 psi. Then one-half×$\varepsilon_o$=0.0135 and one-half×$S_y$=2,000 psi. The target stress to produce the desired strain of one-half to two-thirds $\varepsilon_o$ is approximately 2,000 psi.

$$\sigma=F/A$$

The target value for $\sigma$ is defined. The applied force is not an independent variable. The force is dictated by the interaction of the log and mandrel. The only independent variable in the equation is the area of the cross-section.

Choosing a mandrel ID with a corresponding cross-section area A that produces the target stress $\sigma$ for extraction force F yields an optimized mandrel design because the strain of the mandrel is fully utilized. The optimization process may be iterative, because the magnitude of the extraction force is not precisely predictable, and therefore may have to be measured. Nonetheless, the process makes mandrel optimization possible. In some cases it may lead to the conclusion that a solid shaft is preferable to a tubular shape, or a different material selection is warranted.

It may be worth noting at this juncture that stretching the mandrel does not add to the magnitude of the extraction force. If it did, then this method of stretching an elastic mandrel during extraction could be self-defeating and thus less useful in practice. But, it does not. It is akin to lifting a 100 pound weight with an elastic strap instead of an inelastic steel chain. The lift force remains unchanged at 100 pounds. Perhaps more work is done because the strap is elongated in addition to the weight being lifted, but the force is the same.

Log Restraint During Mandrel Extraction

In state of the art coreless rewinders the log is supported by a trough, below, and restrained in the axial direction solely by a plate against its end face as either the mandrel is pulled out or the log is pushed off. This works with rigid mandrels where the log suddenly breaks free substantially simultaneously, as a unit, along its entire length.

However, this arrangement does not work well with an axially elastic mandrel, especially for loosely wound logs that have little axial column strength. After a first short segment of the log has locally broken free from the elastic mandrel inside, for instance in the near several inches of log length, the log has only its own internal resistance to axial collapse to support it because the mandrel no longer offers axial support in this region. It offers only radial support in this region. The extraction force applied to the mandrel is transmitted to the log through their interface in the segment that has not yet broken free. This force draws the far end of the log toward the fixed plate at the end face of the log. This compression load acting axially on the log, within the region where the mandrel is free to slide within the log, can collapse and crumple this region of the log (like an accordion).

A means to prevent this axial collapse of the log is required. The preferred solution is to provide axial restraint at the periphery of the log. It need not extend the full length of the log. However, having it extend at least most of the length of the log is more robust to tolerate variations from log to log and among product formats. And having it extend at least most the length of the log distributes the restraining force over a greater area of the log periphery, reducing the chances of any surface damage to the log. It is most usefully applied along the segment of log where the mandrel has not yet broken free, because the axial force transmitted from the mandrel to the log in this region is thus counteracted immediately, in the same region, with less possibility of damage to the log compared to having the opposing forces applied at greater axial distance apart, and hence the force transmission taking a longer path through the log.

Peripheral restraint of the logs is still recommended when stretching of the mandrel by pulling both ends is utilized to greatly reduce the extraction force, for the following reasons. Low density logs and/or those with high cross-direction (CD) stretch may elongate slightly with the mandrel as the mandrel is stretched. Restraining the log periphery reduces this tendency and thereby maximizes the relative movement of the mandrel and log. Loosely wound, low firmness logs made possible by the very lightweight winding mandrel have very low axial strength and stiffness and may still collapse, even under the reduced extraction force, if the periphery is not restrained.

Peripheral restraint alone is not adequate for most products, so a fixed plate is still utilized at the end face of the log. This plate ensures the interior of the log does not shift axially with the mandrel, relative to the periphery of the log, (telescope) as the mandrel is withdrawn.

Using an elastic mandrel ensures reasonable extraction forces without product damage when producing tightly wound coreless logs. It overcomes the issue of high interlayer pressure. Using an elastic mandrel with log end face and log peripheral restraint during mandrel extraction ensures low extraction forces without telescoping or crumpling when producing loosely wound, low density coreless logs. It overcomes their issues of low interlayer pressure (telescoping) and low column strength (crumpling).

The device that applies pressure on the log to restrain the periphery of the log must have its travel limited after it contacts the log surface (for instance, rod locks on pneumatic cylinders, or a servo actuator with feedback), or it will compress loosely wound, low density logs flat as the mandrel is withdrawn.

As explained at the beginning of this section, when rigid mandrels work properly, the log suddenly breaks free substantially simultaneously, as a unit, along its entire length. However, when the log is wound too tight, the actuator stalls. Typically a segment of the log adjacent to the restraining plate breaks free of the mandrel locally and crumples (axially collapses) because it cannot withstand the excessive compressive stress. It is the bunching of this paper into an accordion shape that causes the log to bind on the mandrel, stalling the actuator. This malfunction can be prevented by using the same peripheral restraint described above for elastic mandrels, thereby expanding the operating window of rigid mandrels to include tighter wound products.

In-Line Extraction of Mandrel

In state of the art coreless rewinders the log is supported by a trough, below, and restrained in the axial direction solely by a plate against its end face as either the mandrel is pulled out or the log is pushed off. In all cases the flexible member that communicates the force from the actuator to the mandrel (in the case of pulling) or the plate (in the case of pushing), be it chain, timing belt, cable, or other, is laterally offset from the mandrel centerline, so the extraction force (pulling) or the stripping force (pushing) produces large moment loads on the guide tracks for the clasp (pulling) or the plate (pushing). Substantial frames, brackets, and guide ways are required to oppose these large moment loads. This increases the cost and space required, and reduces the practical speed at which they operate. And it is a frequent complaint that the guide ways wear out prematurely.

The arrangement of the pulleys and path of the timing belt in this invention allows the extraction force to be placed substantially coincident with the mandrel centerline. This makes the moment load minimal, or substantially zero.

Having substantially no moment load allows the device supporting the mandrel clasp to be very light weight in construction because it must bear only tensile and compressive loads during operation, no bending loads. Its lighter weight allows it to operate at higher peak velocities and accelerations, allowing higher cycle rates to be attained for each extractor. It also makes the component parts less expensive.

Having substantially no moment load allows the frames, brackets, and guide ways to be made of lighter weight construction and more compact in size. Having each extractor more compact in size facilitates the utilization of multiple parallel extractors on a reasonable scale, for example that can be reached by an operator standing on the floor or a low platform. The lighter weight construction also makes the component parts less expensive. These improvements make the use of multiple parallel extractors practical, which makes possible, for the first time, very high cycle rate coreless rewinders.

Novel Mandrel Clasp

Whether the mandrel is withdrawn from a stationary log, or the log is pushed off a stationary mandrel, a clasp to securely hold the mandrel end that is exposed beyond the end of the log is required. The purpose of the clasp is to control the position of the mandrel along its longitudinal axis, relative to the position of the log. It may be called a chuck, a clasp, a means to cooperate with the end of the mandrel, etc.

Prior art in this immediate technical field (coreless tissue rewinding) is not capable of cooperating with a radially elastic mandrel of substantially uniform cross-section. Mandrels in this prior art have at least one surface that is transverse to the longitudinal axis of the mandrel, that communicates with the clasp. It may take the appearance of a lip, shoulder, interior or exterior annular ridge, knob, hook, or similar. Conical, or tapered, surfaces with their axis, or axes, parallel to the longitudinal axis of the mandrel could also be used, though they offer no real benefit, only a difference of preference, in that the mating surface(s) are oblique, rather than transverse, to the axis of the mandrel.

However, with a uniform cross-section mandrel (that cannot be permanently deformed by the clasp, due to the need to recirculate and reuse it) the forces must be transmitted solely by friction between surfaces concentric to the mandrel longitudinal axis (if curved) or tangent to surfaces concentric to the mandrel longitudinal axis (if flat). Note: this rather broad assertion assumes the means is a traditional contact method, not a non-contact method, for instance utilizing a linear induction motor, with a metallic mandrel, or a mandrel with metallic portion, driven axially by the motor.

The challenge of holding a radially compliant, uniform cross-section mandrel in this way is heightened by the fact that the mandrels are made from anti-friction materials to minimize the extraction forces—they are engineered to more easily slip out of things.

Prior art chucks designed to hold uniform cross-section cylindrical items from the outside, such as those used for chucking work pieces in machine shops, would crush the mandrel end before developing adequate axial holding force. An assumption inherent in these devices is that the cylindrical piece is relatively rigid. However, the elastic mandrel is not rigid enough to withstand the very high radial forces necessary to develop adequate axial friction forces.

Prior art chucks designed to hold uniform cross-section tubular items from the inside would either slip out, or permanently deform the mandrel end. An assumption inherent in these devices is that the cylindrical piece is relatively strong and rigid. However, the elastic mandrel is not strong and rigid enough to withstand the very high radial forces necessary to develop adequate axial friction forces. The end of the mandrel would yield, undergoing a permanent diameter increase, or rupture. Either way it would be damaged and not reusable. Note: the forces applied during stretching and/or extraction can be much higher than the tensile force induced by restraining the mandrel ends when it is pressurized, typically 50 to 150 pounds, thus the interior chuck used in the winding nest would be inadequate for many product formats.

Making the mandrel have a non-uniform cross-section to provide a surface transverse to the longitudinal axis of the mandrel for the clasp to cooperate with is a valid alternative. It can be done with a homogeneous mandrel by fusing a shape onto the mandrel at or near the end, hot working a feature into the mandrel at or near the end, cold working a feature into the mandrel at or near the end, machining a feature into the mandrel at or near the end, or similar. The feature may not technically possess a transverse surface, but instead a curved surface that performs similarly, such as a hole or holes through the tube wall, a conical or tapered shape, an annular bulge (interior or exterior), a hook, a spherical knob, or the like. It can be done with a nonhomogenous mandrel by co-extruding a different formulation polymer at or near the end, or adding dissimilar material, for instance metallic alloy, via sonic welding, mechanical fastening, bonding, adhesive, etc.

However, there is a huge drawback to making the cross-section of the mandrel non-uniform by putting such features at their ends. The huge drawback is far higher cost. Uniform cross-section mandrels of thermoplastic materials can be commercially extruded very economically. If procured in quantities of 1,000 to 2,000 the cost is less than 2% of the cost of a mandrel made of assembled components, such as those taught in the prior art. Keeping the mandrel homogenous and merely adding features at the end would be more economical than adding pieces of dissimilar material, but would still increase the cost by a factor of many times.

Other disadvantages include the following.

Higher mass and polar inertia would afford worse control at high web speeds.

Heavier mandrels would reduce the operating window of coreless surface winders relative to low firmness, loosely wound products.

Weight added at the mandrel ends would increase the likelihood of catastrophic machine damage during crashes at high speeds.

Mandrels will be less durable, especially if the added material is dissimilar, because it may separate under high loads or impact loads.

Mandrels may also be less durable due to stress concentrations at the added features.

Mandrels may not work in existing rewinders that also make products with cardboard cores because their geometry is not equivalent to a core.

Mandrels may not have uniform radial stiffness for their entire length, instead being stiffer at or near the ends, where the cross-section differs. This is a non-issue for rigid mandrels, used in specialty coreless rewinders, because being slightly stiffer than rigid is still rigid, i.e., about the same. But, it is a major drawback for mandrels intended to be radially elastic and useable in surface winders that need compression on the core (or mandrel) to control it, because altering the cross-section at the ends can radically increase the stiffness at the ends. If the radial stiffness is too high, it may damage the machine or the mandrel. If the higher stiffness is localized with respect to the longitudinal axis of the mandrel it may cause uneven wear and/or steer the mandrel to the side when running Mandrels will be more expensive to recycle if dissimilar material is used because the dissimilar material has to be separated.

Clearance is required to get the uniform cross-section mandrel into, or onto, the restraining means (clasp). The clearance has variability. Lower cost mandrels will have greater variability (manufacturing tolerance). If a clasp requires higher precision mandrels, then it is requiring higher cost mandrels. The standard tolerances quoted for normal commercial extrusion of HDPE mandrels with 1.700-inch OD×0.036-inch wall thickness are ±0.010 inches at the outside diameter and also ±0.010 inches at the inside diameter. This means the wall thickness itself may vary ±0.010 inches.

As mentioned above, extrusion of thermoplastic polymers to normal tolerances is a very economical way to make winding mandrels, especially if ordered in large quantities. But to take advantage of this opportunity, the clasp must accommodate the mandrel diameter variation and not damage the tube ends. It therefore has to open far enough to have clearance at the OD of the largest tubes and at the ID of the smallest tubes as well as close far enough to engage the OD of the smallest tubes and the ID of the largest tubes.

Listed below are the design requirements of the mandrel clasp:

Does not damage (permanently deform) the mandrel.

Accommodates the relatively large clearance range of normal commercially extruded polymer tube.

Can produce high axial holding force.

Transmits the axial holding force evenly to the mandrel cross-section to avoid localized high stress points that would cause the mandrel material to yield or tear.

Rapidly engages (locks) and disengages (releases).

Can disengage while under axial tensile load. This is requirement of the mechanical stretching method.

Swappable for maintenance and mandrel diameter (product format) changes.

Compact, to facilitate the utilization of multiple parallel extractors on a reasonable scale.

Lightweight, so it can be accelerated rapidly for high speed (high cycle rate) mandrel extraction.

Electric or pneumatic actuation (not hydraulic, which is prone to leak and susceptible to fire).

FIGS. 12-18 illustrate the preferred embodiment of a clasp 69 that can cooperate with a thin-walled elastic mandrel with uniform cross-section.

Figure 14:
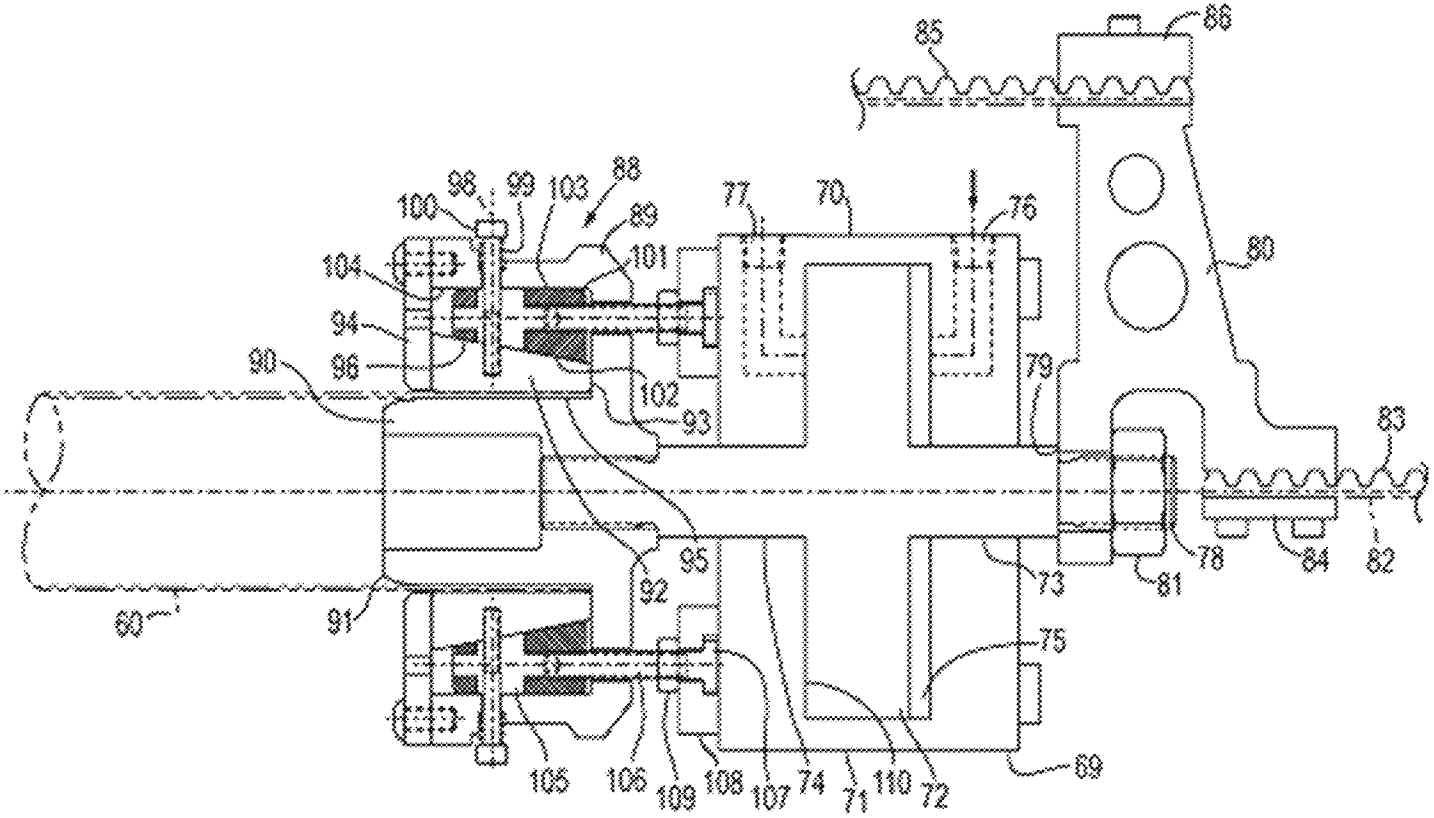
FIG. 14 is a side elevational sectional view of the clasp of FIG. 12 and a tubular mandrel before the mandrel is engaged by the clasp.

Referring to FIG. 14, a pneumatic cylinder assembly 70 includes a cylindrical body 71 and a piston 72 which includes right and left rod ends 73 and 74. The piston 72 is slidable within a bore 75 in the cylinder, and the bore communicates with a source of pressurized air through ports 76 and 77. The cylinder 71 is a short stroke, large bore cylinder.

The right rod end 73 is provided with screw threads 78 and an annular shoulder 79. A bracket 80 is secured against the shoulder 79 by a nut 81. One end 82 of a flexible timing belt 83 (see also FIG. 18) is secured to the bottom of the bracket 80 by a clamp 84 and the other end 85 of the timing belt is secured to the top of the bracket 80 by a clamp 86.

A clamping assembly 88 is mounted on the left rod end 74 and is adapted to clamp a tubular mandrel 60. The clamping assembly includes a cylindrical housing 89 and a cylindrical central prong or shaft 90 which is sized for insertion into the bore of the tubular mandrel. The prong has an abridged bullet nose 91 to ensure that it enters the mandrel even if the mandrel and the log which is wound on the mandrel are misaligned with the clasp 69. The diameter of the prong has a manufacturing tolerance. Its maximum diameter is specified so it is always less than the minimum possible diameter of the mandrel. Thus, every mandrel has radial clearance between its inside diameter and the prong. The clearance varies. The clearance is maximum when the mandrel inside diameter is at its upper tolerance limit and the prong diameter is at its lower tolerance limit.

Figure 13:
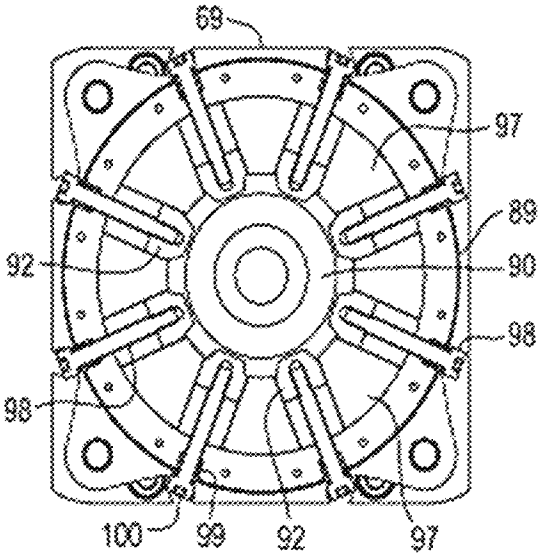
FIG. 13 is a sectional view taken along the line 13-13 of FIG. 12.
Figure 12:
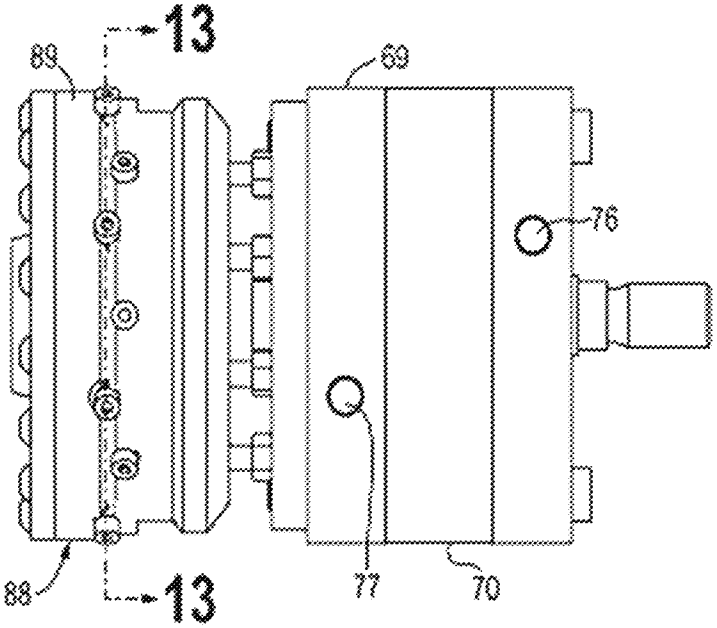
FIG. 12 is a top view of a clasp for engaging an end of a tubular mandrel.

A plurality (eight in the embodiment illustrated) of circumferentially spaced clamping blocks 92 (see also FIG. 13) are mounted within the cylindrical housing 89 for radial movement. The clamping blocks are confined for radial movement by a radially extending face 93 on the cylindrical housing 89 and an annular plate 94 which is bolted to the housing. Each of the clamping blocks includes an axially extending inner face 95 and an inclined outer wedge face 96. Referring to FIG. 13, the clamping blocks are separated by generally trapezoidally shaped spacers 97 which are secured to the housing 89. A radially extending bolt 98 is secured to each of the clamping blocks and extends through the housing 89. A compression spring 99 between the housing and the head 100 of the bolt resiliently biases the blocks radially outwardly to retract the blocks.

An actuating wedge 101 is mounted radially outwardly of each of the clamping blocks 92. Each of the actuating wedges includes an inclined inner wedge face 102 which engages the wedge face 96 of the associated clamping block and an axially extending outer face 103 which engages a cylindrical surface 104 of the housing 89. The engagement of the faces 103 and 104 ensures that the actuating wedges move axially within the housing 89. Each actuating wedge 101 is provided with a bore 105 through which a bolt 98 extends, and each actuating wedge is secured to the cylindrical body 71 by a bolt 106 which is screwed into the wedge. The head 107 of each bolt 106 is secured to the cylindrical body by a clamping plate 108 and a nut 109.

Referring to FIG. 13, the clamping blocks 92 are spaced radially outwardly from the cylindrical prong 90 to permit a tubular mandrel to be inserted between the prong and the blocks. FIG. 14 illustrates the end of a tubular mandrel 60 inserted over the prong 90. The piston 72 is in the disengaged position in which the piston engages the left face 110 of the bore 75 of the cylinder 71. The piston is maintained in the disengaged position by pressurized air which enters the port 76, and port 77 is vented.

Figure 15:
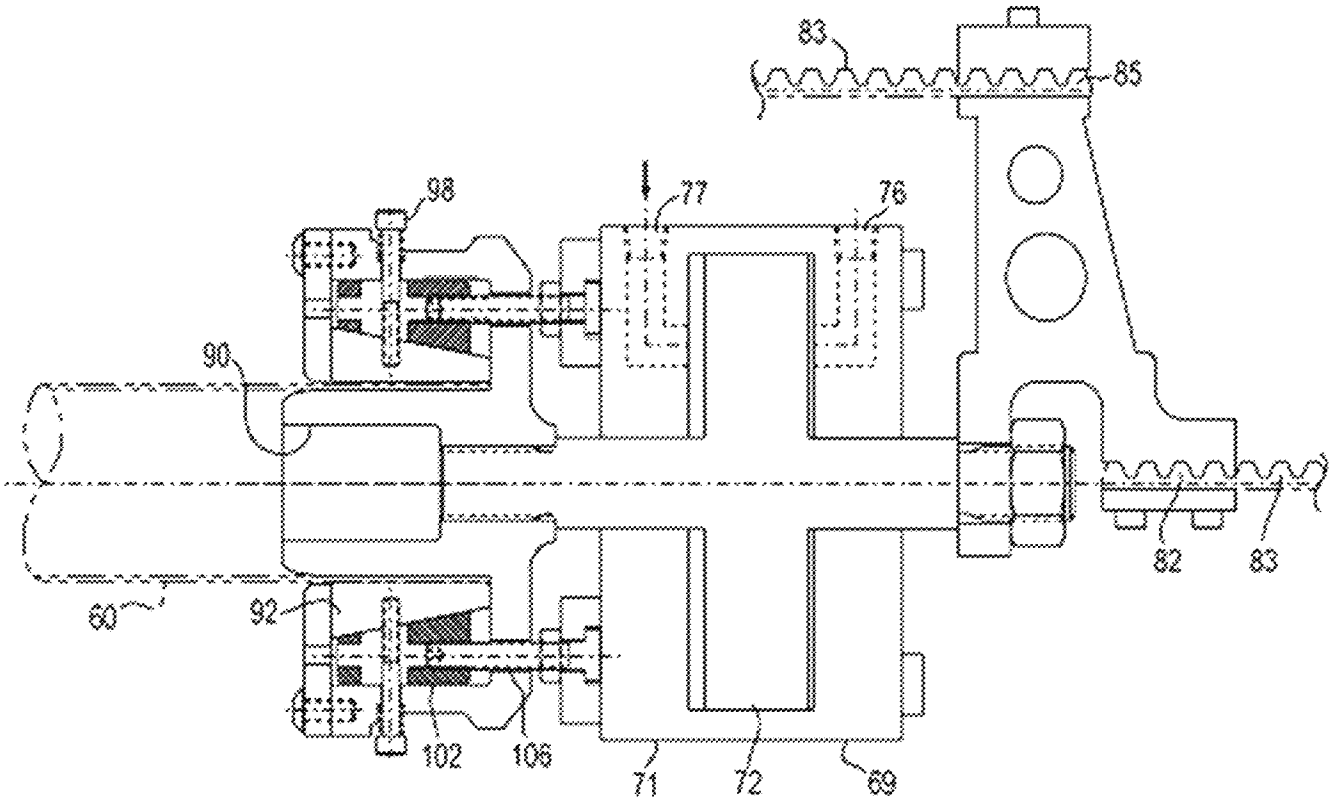
FIG. 15 is a view similar to FIG. 14 after the mandrel is engaged by the clasp.
Figure 16:
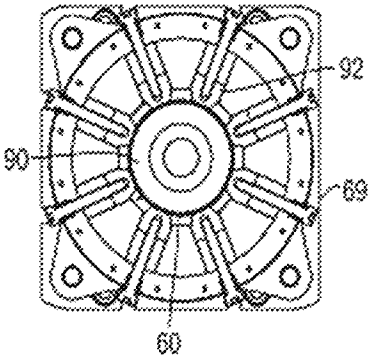
FIG. 16 is a sectional view similar to FIG. 13 showing the mandrel engaged by the clasp.

Referring to FIGS. 15 and 16, the mandrel is clamped or engaged by venting port 76 and pressurizing port 77. The pressurized air from port 77 moves the cylinder 71 to the left, and the bolts 106 move the actuating wedges 101 to the left and force the clamping blocks 92 radially inwardly to clamp the mandrel between the clamping blocks and the prong 90. The rigid prong 90 inside the mandrel provides internal support for the mandrel so the mandrel is not crushed.

When the cylinder is engaged at 60 psig the clamping blocks exert nearly 4,000 lbs on the mandrel. Therefore, if the coefficient of friction of the blocks on an HDPE Mandrel is 0.3, the holding force will be nearly 1,200 lbs. if this amount is not adequate, the coefficient of friction can be increased with friction coatings on the blocks and the internal prong, perhaps raising it to 0.5, and thereby the holding force at 60 psig, to nearly 2,000 lbs.

The device is very compact and very lightweight relative to its holding force. The whole unit, including the pneumatic cylinder, but excluding the timing belt, pulleys and motor that move it, is about 6 kg (13¼ lbs).

Figure 17:
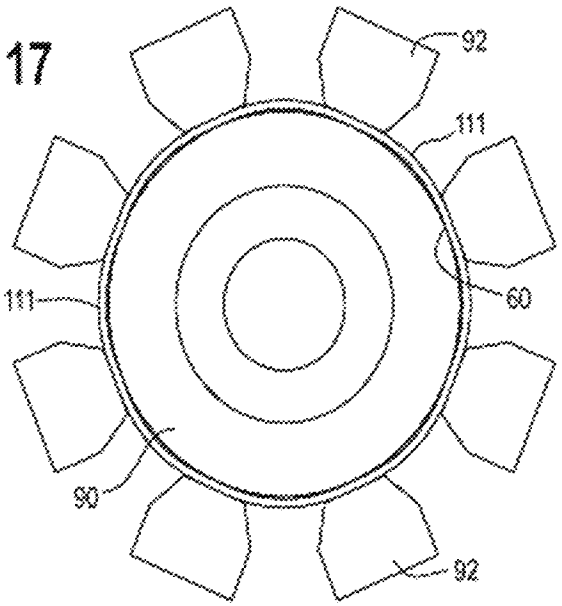
FIG. 17 is an enlarged fragmentary view of a portion of FIG. 16 showing the engagement of the mandrel by the clamping blocks of the clasp.

An especially novel feature is the way the clasp accommodates the necessary clearance and manufacturing tolerance by elastically deforming the end of the mandrel without permanently deforming it. The arrangement of the clamping blocks 92 was carefully conceived to avoid permanently deforming the mandrel. FIG. 17 shows how the mandrel 60 deforms when loaded by the clamping blocks 92 against the prong 90 inside the mandrel. The axial load is communicated through sixteen surfaces at the eight regions of substantially linear contact between the eight clamping blocks 92, the mandrel, and the prong 90. The mandrel only gently deforms in the regions between the blocks. The shape of the cross-section of the mandrel temporarily takes on the appearance of lobes or waves 111 between the clamping blocks. The maximum bending stress is at the inflection points. The magnitude of this stress is quite low because the radius of curvature of the lobes is large. When the clasp is withdrawn from the mandrel, the lobes or waves disappear, and the mandrel assumes its original shape.

The size of the mandrel in the embodiment illustrated is 1.700-inch OD×0.036-inch wall thickness. Eight clamping blocks 92 easily operate about its periphery. In fact, the same eight blocks can operate about the periphery of a mandrel as small as 1.000-inch OD. An obvious variant is that for smaller diameter mandrels the quantity of blocks can be reduced. The preferred embodiment has eight blocks to ensure good distribution of the force transmission, to avoid localized high stress points that could cause the mandrel material to yield or tear at very high axial forces, maximizing mandrel life, but fewer blocks can be used.

When eight clamping blocks are utilized the force is transmitted through sixteen surfaces at eight regions of substantially linear contact. It is referred to as sixteen surfaces because both the interior prong and exterior blocks are axially restrained. A version of the clasp may be made wherein only the prong inside, or the blocks outside, have axial restraint, but it would not be as efficient in force transmission.

Another optional variant is to replace the circular prong inside with a polygonal or star shape, or a circular shape with small flats cut on it. For instance, an irregular 16-sided polygon, with shorter segments to cooperate with the exterior blocks and longer segments between the exterior blocks, could be used. If the quantity and spacing of the blocks outside the mandrel is adjusted appropriately, a regular polygon, with all segments and interior angles uniform, could be used. A star or spline shape, with lobes or flats that cooperate with the exterior blocks, could be used. All these are but minor variants on the invention.

The preferred embodiment has a circular shaft inside the mandrel and flat blocks outside the mandrel. These shapes were chosen largely for ease of manufacture and operation. The surfaces outside the mandrel may be flat or convex, but should not be concave, or they would mark the mandrel. Flat is recommended because this, shape is easy to manufacture and ensures the width of the region of substantially linear contact is maximized. The surface, or surfaces, inside the mandrel may be convex or flat, but should not be concave, or it would mark the mandrel. A convex circular surface is recommended because this shape is easy to manufacture and ensures that angular misalignment between the elements inside and outside the mandrel will not damage the clasp, nor the mandrel, nor reduce the holding force. Using flat surfaces inside and outside the mandrel may be tempting in order to increase the width of the region of contact, making it a wider line, to transmit greater force. While this is certainly possible, it has the following drawbacks. First, all parts must be precisely aligned for every cooperating pair of flat surfaces to be parallel, otherwise the clasp, or mandrel, or both, may be damaged, and/or the holding force may actually be less. Second, the wider the flats on the interior surface are, the closer the flats must be to the longitudinal axis of the tube for the prong to fit inside the tube, so the farther the blocks at the exterior must travel and the greater the mandrel wall must deform. In conclusion, flat surfaces narrow enough to not introduce significant other problems were deemed not worth the added cost and complication.

For the clasp to carry full load, the clamping blocks 92 on the exterior of the mandrel must load evenly. Because they share a single actuator they must move substantially in unison, or be individually adjustable so that they all press the tube wall against the internal prong substantially simultaneously. In the preferred embodiment individual adjustments to the wedges 101 that move the blocks are provided to allow proper setup. Though the extruded polymer tubes have rather large tolerances and so may vary in ID, OD, and wall thickness from tube to tube and within a tube, it has been found that within any given cross-section the OD has good concentricity to the ID. However, if a preferred mandrel tube is found to lack concentricity, that is, the wall thickness is not substantially uniform about the entire perimeter, provision can be made for the clasp to accommodate this. Compliance may be added to the screws 106 that push the actuating wedges 101 forward, driving the clamping blocks down. This compliance may be a polyurethane washer, compression spring, or similar. The compliance may also be used to compensate for uneven wear of the wedges, if this is found to be a problem.

The preferred embodiment of the clasp does not possess a means to push the mandrel back out. It is expected that an external device, or pair of devices, will assist with drawing the mandrel out. For instance, after the clasp has withdrawn a majority of the mandrel length from a log, two clamps, one disposed closer to the operator side and the other disposed closer to the drive side, would actuate to lightly pinch the mandrel. The surfaces would be covered in a material that provides drag against further axial travel of the mandrel, but does not prohibit further axial travel nor mark the mandrel. After the mandrel end has withdrawn from the end of the log and the face plate adjacent thereto, these clamp devices would keep it from falling, maintaining the mandrel horizontal to the floor. At this point the clasp would be nearing its stopping position. Before stopping the clasp would release and the clasp would travel a little farther at slow speed to its stopping position. The drag imposed on the mandrel by the clamps would cause the mandrel motion to cease before the clasp motion, drawing the mandrel out of the clasp. The clamps would then simultaneously release, allowing the mandrel to fall into the return guides, or onto a conveyor. An alternate embodiment may possess an integrated means to push the mandrel back out of the clasp rather than utilizing an external device or devices.

An alternate embodiment is the implementation of a manually actuated device. This device may be hand-held and used to withdraw mandrels from relatively loosely wound logs, where the extraction forces are low. Because the forces are low the device can use fewer blocks at the mandrel periphery and more aluminum and plastic parts to be kept lightweight. The blocks may be loaded with cam levers or over-center lever latches instead of wedges to further reduce weight, cost, and complexity. The target customer would be in markets where labor cost is low relative to capital equipment cost. (Though it would be taxing to do it for hours, it is eminently feasible. The proof of concept of using thin-walled HDPE winding mandrels was done on a machine with manual mandrel extraction.)

A different embodiment that acts similarly would be to use a rigid ring outside the mandrel, with moving wedges, or blocks, inside. Instead of the mandrel wall segments between the blocks bulging outward, they would draw straighter, like chords running between the crowns of the blocks. The lobes (or wave crests) would be in-line with the wedges, rather than between them. The major disadvantage of this approach, relative to the preferred embodiment, is it does not work with small diameter mandrels. Even for moderate diameter mandrels the mechanisms inside the tube would have to be relatively intricate to fit.

Having moving elements both inside and outside the mandrel has the small diameter mandrel limitation described above, and also is not good for maintaining concentricity of the clasp to the mandrel. Also, it is far more complex. Also it is not necessary. If it worked perfectly the mandrel would not deform at all. If the mandrel wall deforms into lobes between the blocks (because the outside blocks over-travel) or the mandrel wall deforms into chords between the blocks (because the inside blocks over-travel) it would fall within the scope of this invention.

In the event a mandrel with radially stiff ends is used, such as a solid axially elastic mandrel 61, an axially elastic mandrel with rigid end caps, metallic alloy mandrel, or the like, the interior prong 90 is omitted and the clamping portion of the clasp can function like a conventional exterior chuck. Its other advantages, such as small size, light weight, large clamping force, and having the pulling force in the timing belt collinear with the longitudinal axis of the mandrel are retained.

Mandrel Extraction

Figure 18:
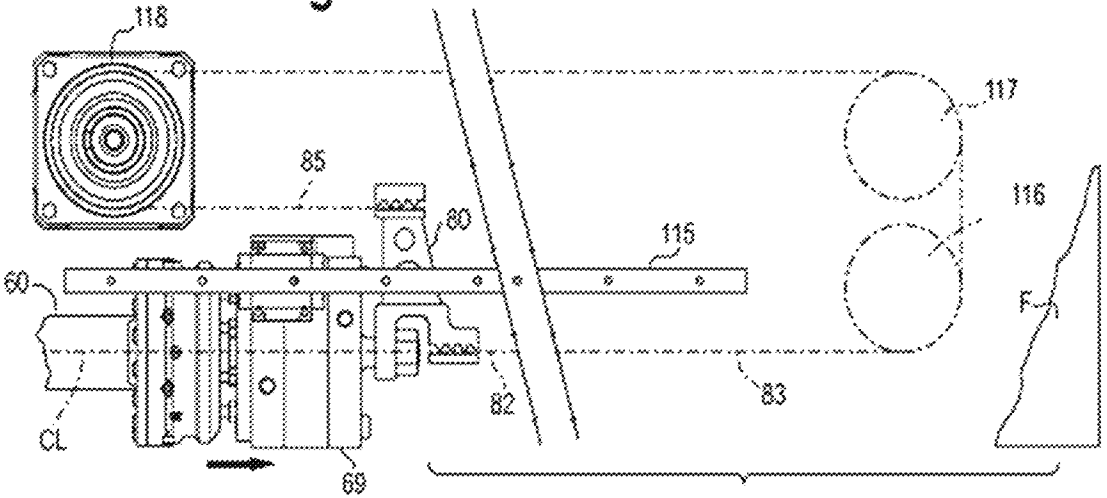
FIG. 18 is a side elevational view, partially broken away, showing the drive system for the clasp.

FIG. 18 illustrates how an axial pulling force is exerted on the clasp 69 and the mandrel 60 to extract the mandrel from the log. The clasp 69 is slidably mounted on a pair of guide rails 115 which are mounted on the frame F of the mandrel extractor assembly. The end 82 of the flexible timing belt 83 (see also FIGS. 14 and 15) is axially aligned with the centerline or axis CL of the mandrel. The timing belt extends around idler pulleys 116 and 117 which are mounted at fixed locations on the frame F and around a conventional belt driver or actuator 118 which is mounted on the frame. The other end 85 of the timing belt is attached to the top of the bracket 80. Actuation of the belt driver 118 causes the end 82 of the timing belt and the clasp 69 to move to the right, thereby exerting an axial pulling force on the mandrel.

FIGS. 19-28 illustrate the steps of the preferred method of extracting an elastic mandrel 60 from a log 66 when the mode of stretching the mandrel within the log by pulling both ends is employed. When the simple pulling mode is utilized to stretch and withdraw the mandrel, the left clasp and drive may be replaced with a simple linear actuator, such as a pneumatic cylinder, to push the log end face against the restraint plates 123 and 124. When adequate, it has the advantage of less cost and complexity. When the pushing-pulling method is utilized to stretch and withdraw the mandrel, the left clasp does not pull the mandrel, but only pushes it, and can be replaced with a simpler non-actuating device. Servo motion control is still recommended for proper timing. When adequate, it has the advantages of somewhat less cost and potentially higher cycle rate.

Figure 19:
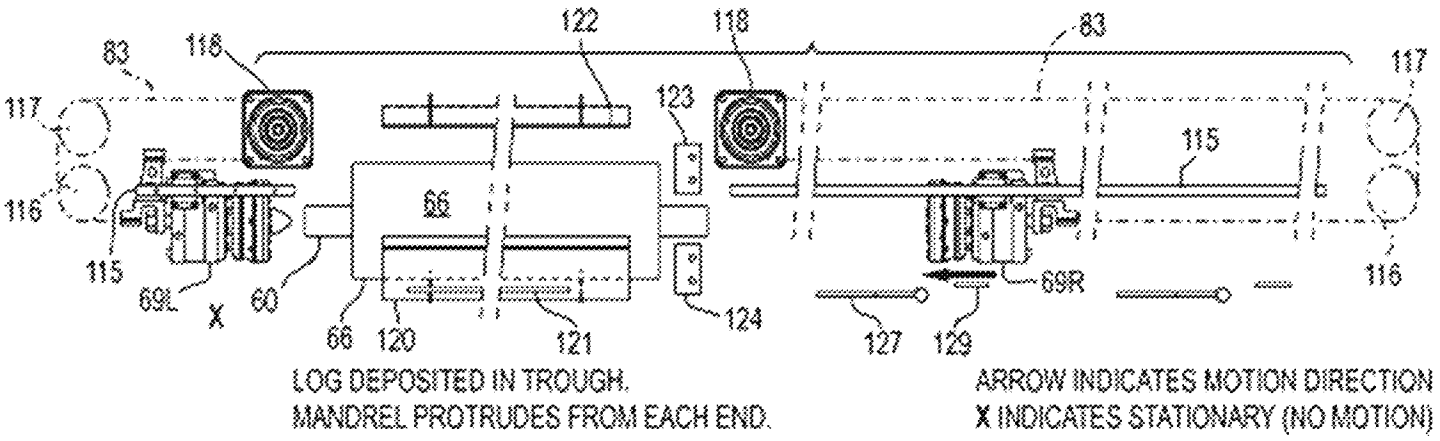

Referring first to FIG. 19, the log is supported in a log support trough 120 on the frame. A lower peripheral log restraint 121 is mounted on the trough. An upper peripheral log restraint 122 above the log is positioned to engage the top of the log.

A right (or operator side) clasp 69R is positioned to engage the right end of the mandrel 60, and a left (or drive side) clasp 69L is positioned to engage the left end of the mandrel. Log end face restraint plates 123 and 124 are positioned to engage the right face of the log.

Figure 20:
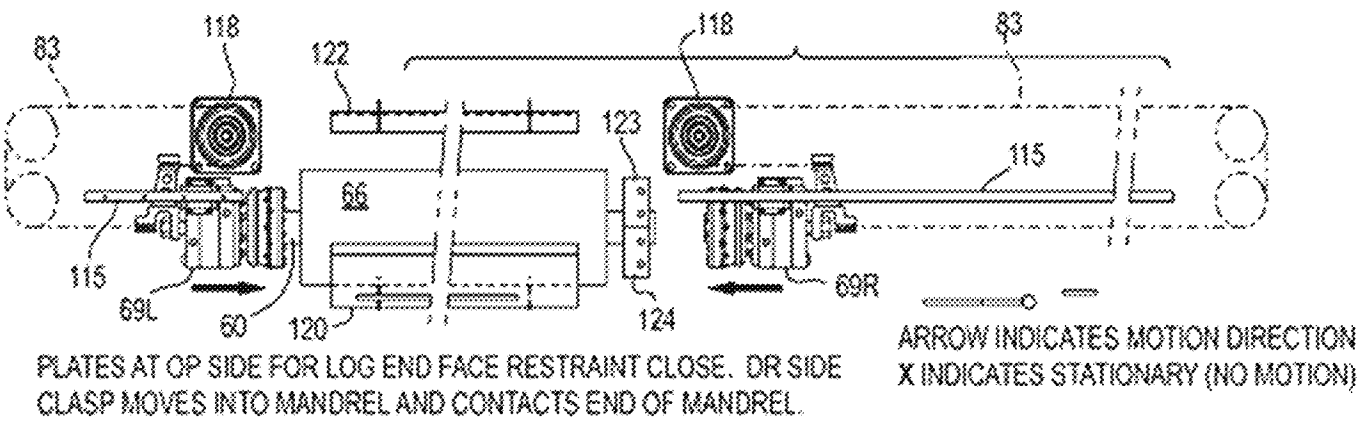

In FIG. 20 the left clasp 69L has moved to engage the left end of the mandrel. The log end face restraint plates 123 and 124 have closed about the right end of the mandrel. The right clasp 69R is moving to engage the right end of the mandrel.

Figure 21:
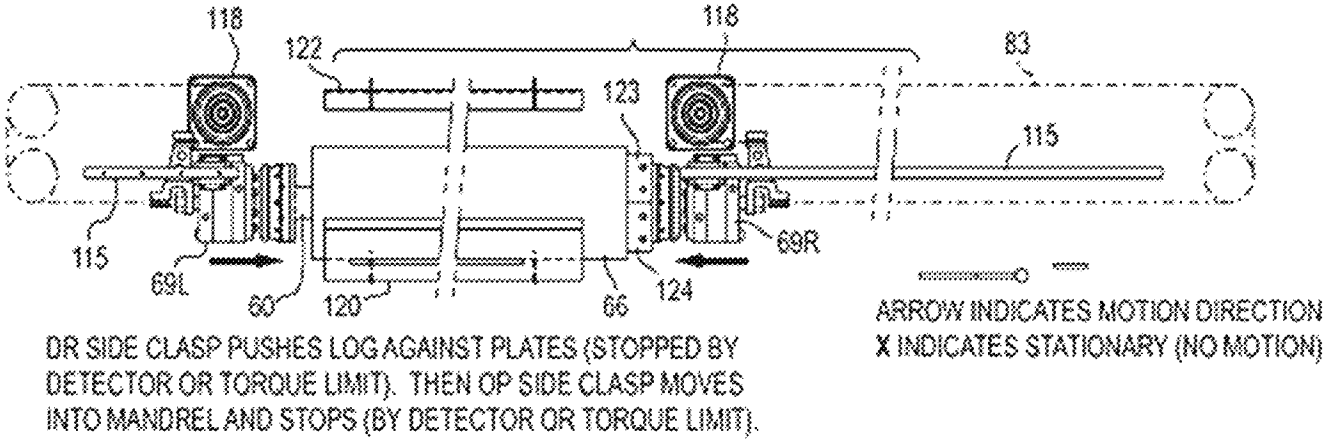

In FIG. 21 the left clasp 69L has moved to the right to push the log against the log end face restraint plates 123 and 124. The clasp is stopped by a detector or a torque limit. The right clasp 69R moves to engage the right end of the mandrel and is stopped by a detector or a torque limit.

Figure 22:
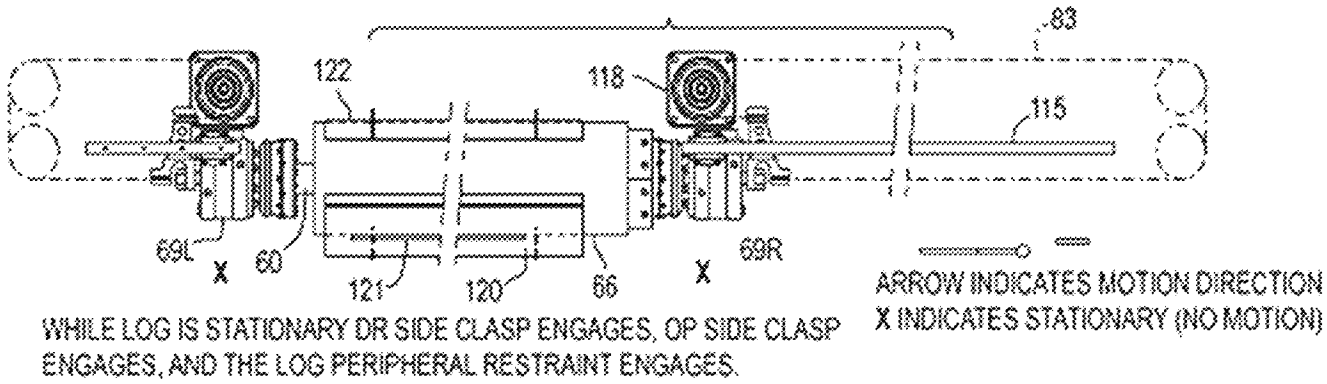

In FIG. 22, while the log is stationary, the left clasp 69L clamps the left end of the mandrel, the right clasp 69R clamps the right end of the mandrel, the upper peripheral log restraint 122 engages the top of the log, and the lower peripheral log restraint 121 engages the bottom of the log.

Figure 23:
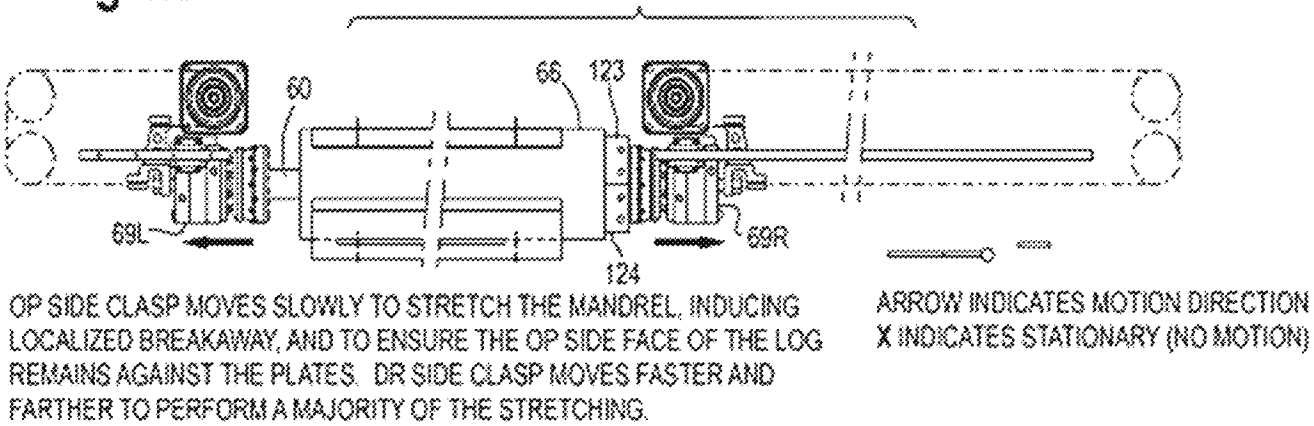

In FIG. 23 the right (operator side) clasp 69R moves slowly to the right to stretch the mandrel, inducing localized breakaway of the mandrel from the log, and to ensure the operator side face of the log remains against the log end face restraint plates 123 and 124. The left (drive side) clasp 69L moves faster and farther to the left to perform a majority of the stretching of the mandrel.

Figure 24:
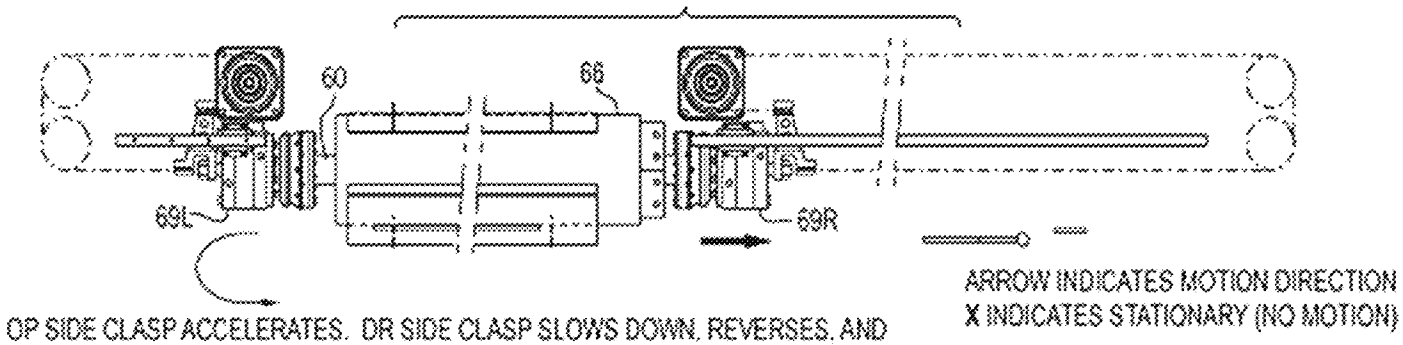

In FIG. 24 the right clasp 69R accelerates. The left clasp 69L slows down, reverses, and accelerates in the same direction as the right clasp. The mandrel 60 is now moving relative to the log 66, so the left clasp lets go of the mandrel.

Figure 25:
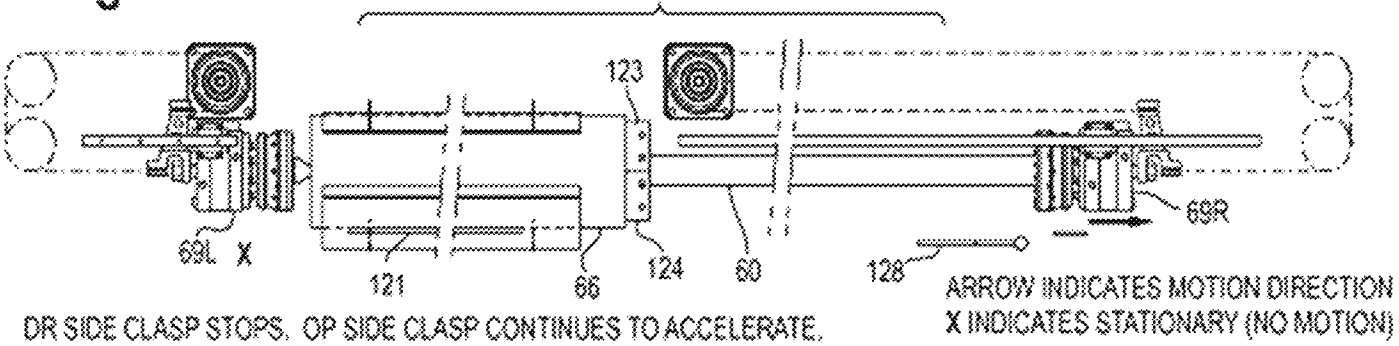

In FIG. 25 the left clasp 69L stops, and the right clasp 69R continues to accelerate, rapidly withdrawing the mandrel 60 from the log 66.

Figure 26:
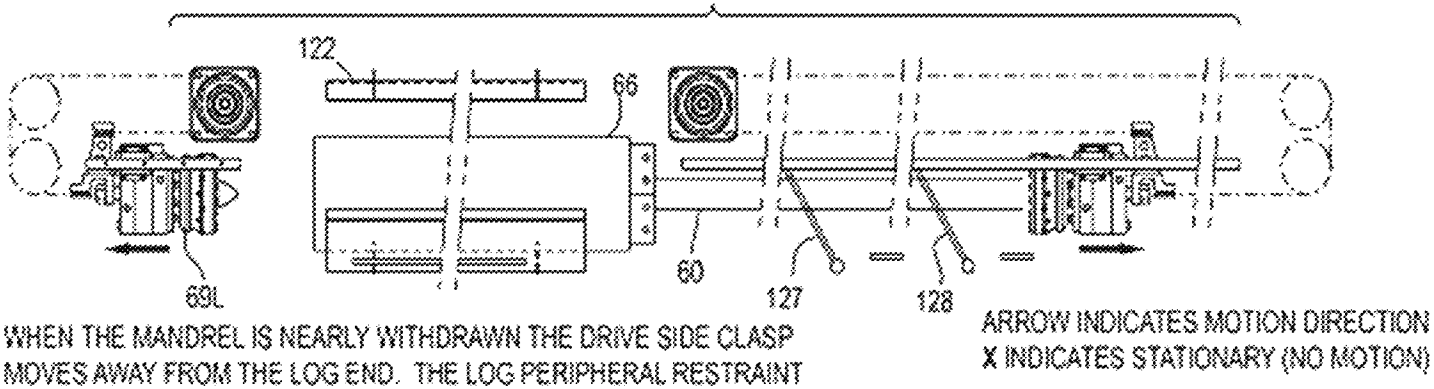

In FIG. 26, when the mandrel 60 is nearly withdrawn from the log 66, the left clasp 69L moves away from the left end of the log. The upper log peripheral restraint 122 disengages, the lower log peripheral restraint 121 disengages, and two mandrel clamps 127 and 128 pivot upwardly to lightly pinch the mandrel, thereby providing axial drag on the mandrel.

In FIG. 27 the left end of the mandrel 60 is fully withdrawn from the right end of the log 66. The right clasp 69R disengages from the mandrel and continues moving to the right, but more slowly. The axial drag provided by the clamps 127 and 128 causes the mandrel to cease moving, and the right clasp 69R withdraws from the mandrel. The clamps 127 and 128 hold the mandrel horizontal.

In FIG. 28 the log is discharged from the trough 120 so that the next log can enter. The mandrel 60 is dropped by the clamps 127 and 128 into return guides 129 for recirculation to the winding machine, or the mandrel could be deposited directly onto a conveyor for recirculation to the winding machine. The right clasp 69R begins returning to the left for the next log after the mandrel has moved out of the way.

Figure 29:
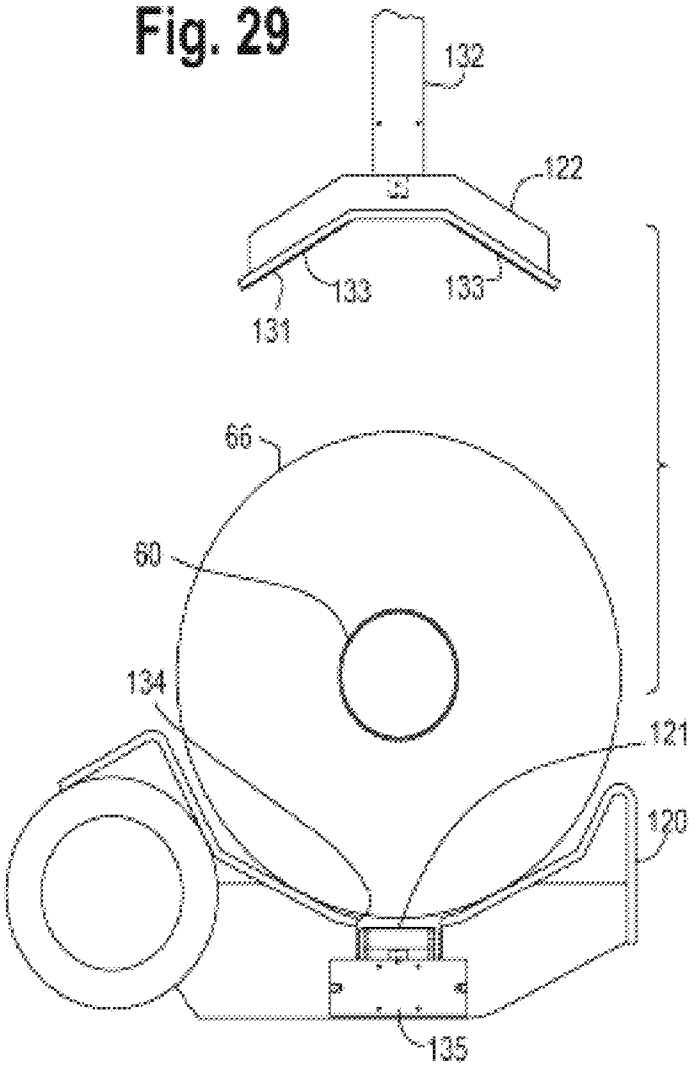
FIG. 29 is an end view of the peripheral restraint for a log wound on a mandrel with the upper and lower restraints not engaging the log.

FIG. 29 is an end view of the log 66, the upper peripheral restraint 122, the log support trough 120, and the lower peripheral restraint 121. The peripheral restraints are disengaged from the log. The upper restraint 122 includes a generally V-shaped cover 131 which is raised and lowered by an actuator 132. The inclined sides of the cover 131 which engage the log are provided with a rough surface 133. The trough 120 has a smooth surface which engages the log and is provided with an axially extending gap 134 in which the lower restraint 121 is mounted. The lower restraint has a rough surface for engaging the log and is raised and lowered by an actuator 135.

Figure 30:
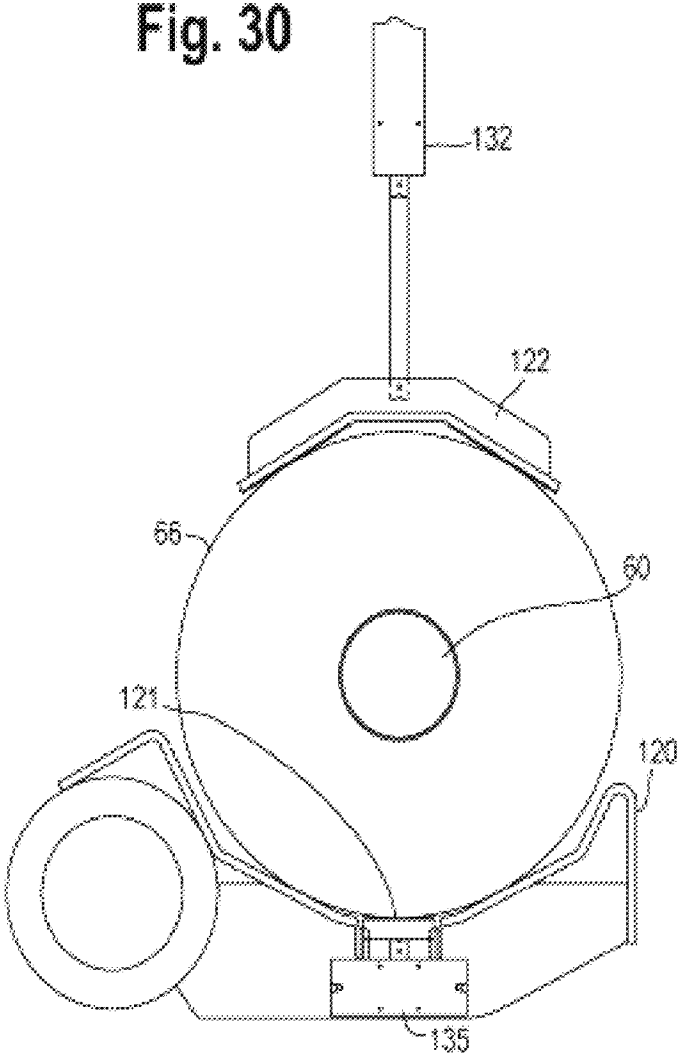
FIG. 30 is a view similar to FIG. 29 with the upper and lower restraints engaging the log.

In FIG. 30 the upper and lower restraints are pushed against the log 66 to restrain the log from moving axially while the mandrel is extracted. The force exerted by the restraints on the log is not sufficient to damage the surface of the log.

Figure 31:
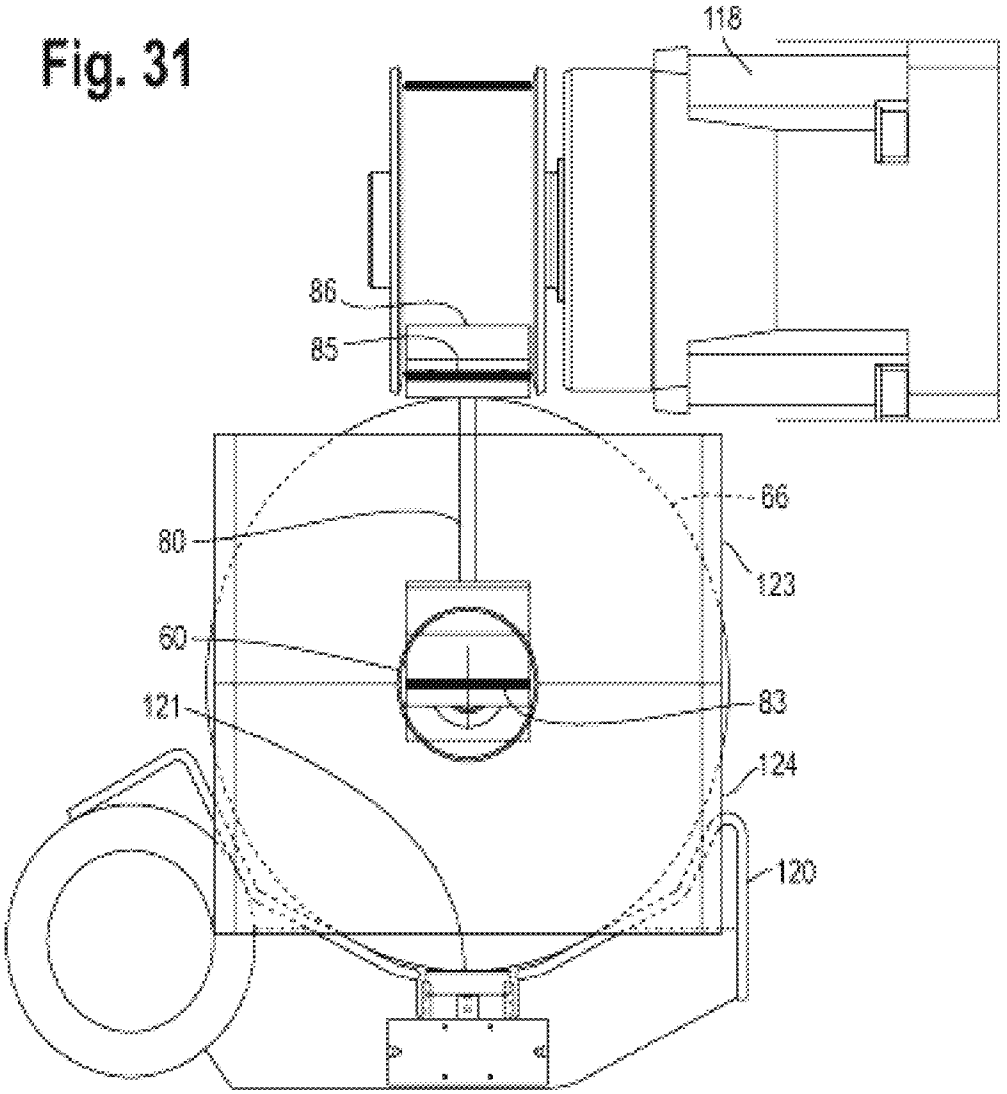
FIG. 31 is a view similar to FIG. 30 showing the end face restraint engaging the end of the log.

FIG. 31 is a view similar to FIG. 30 but also shows the end face restraint plates 123 and 124 and the timing belt 83 which is colinear with the centerline of the mandrel 60 so that the extracting force in the timing belt is axially aligned with the mandrel.

Figure 32:
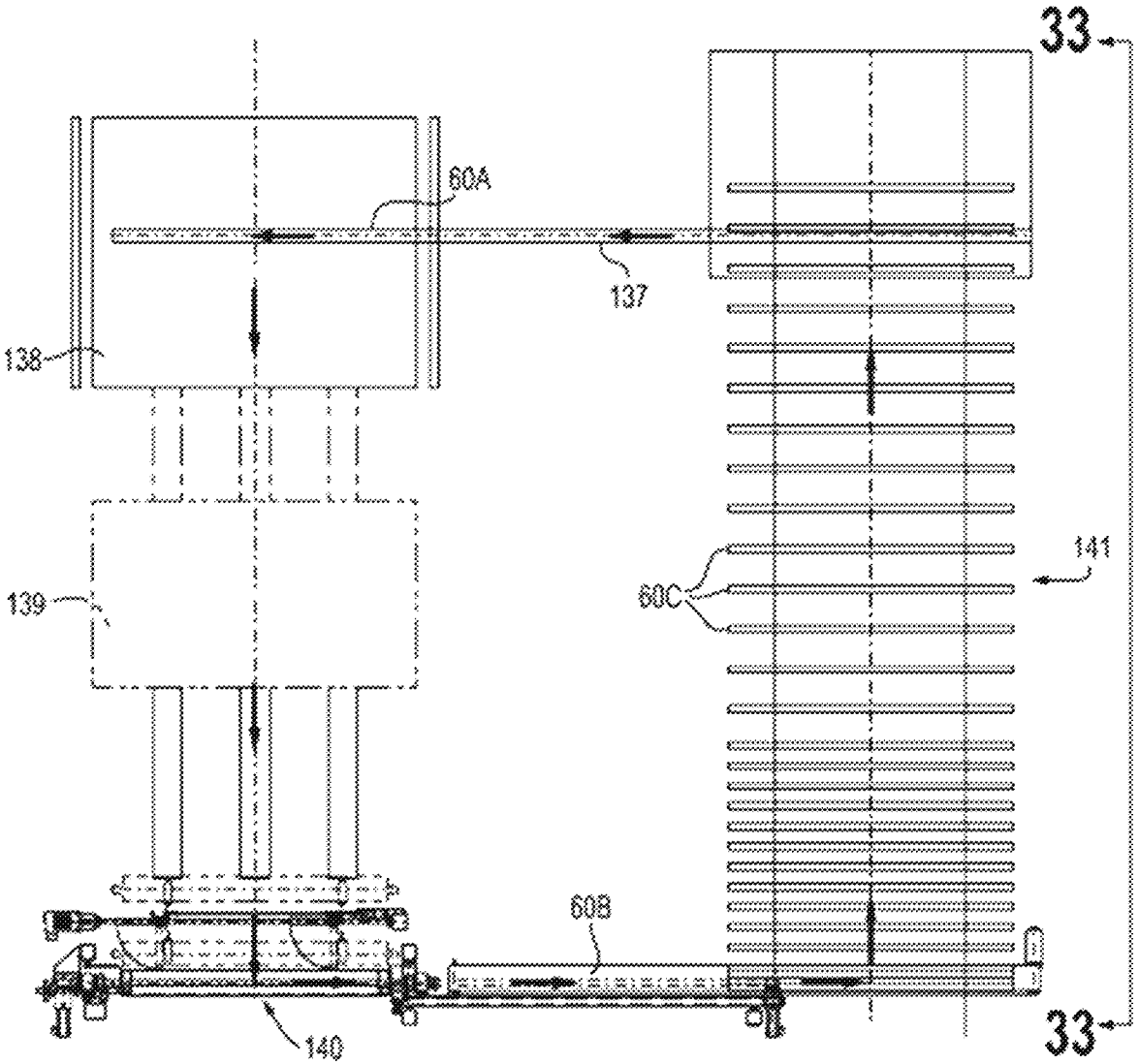
FIG. 32 illustrates a recirculation path for mandels which have been extracted from logs.

FIG. 32 illustrates a recirculation path for mandrels which have been extracted from logs and which are recirculated for reuse in winding new logs. A mandrel 60A is introduced by an infeed conveyor 137 into a conventional rewinder 138 for winding a log around the mandrel as previously described. The wound logs are discharged from the rewinder and delivered to a conventional tailsealer 139 for sealing the end or tail of the web of paper which is wound to form the log. The sealed logs are delivered to a mandrel extractor assembly 140 of the type which has been described with reference to FIGS. 19-28. An extracted mandrel 60B is delivered to a conveyor 141 for conveying the mandrel 60B with previously extracted mandrels 60C back to the rewinder 138.

Figure 33:
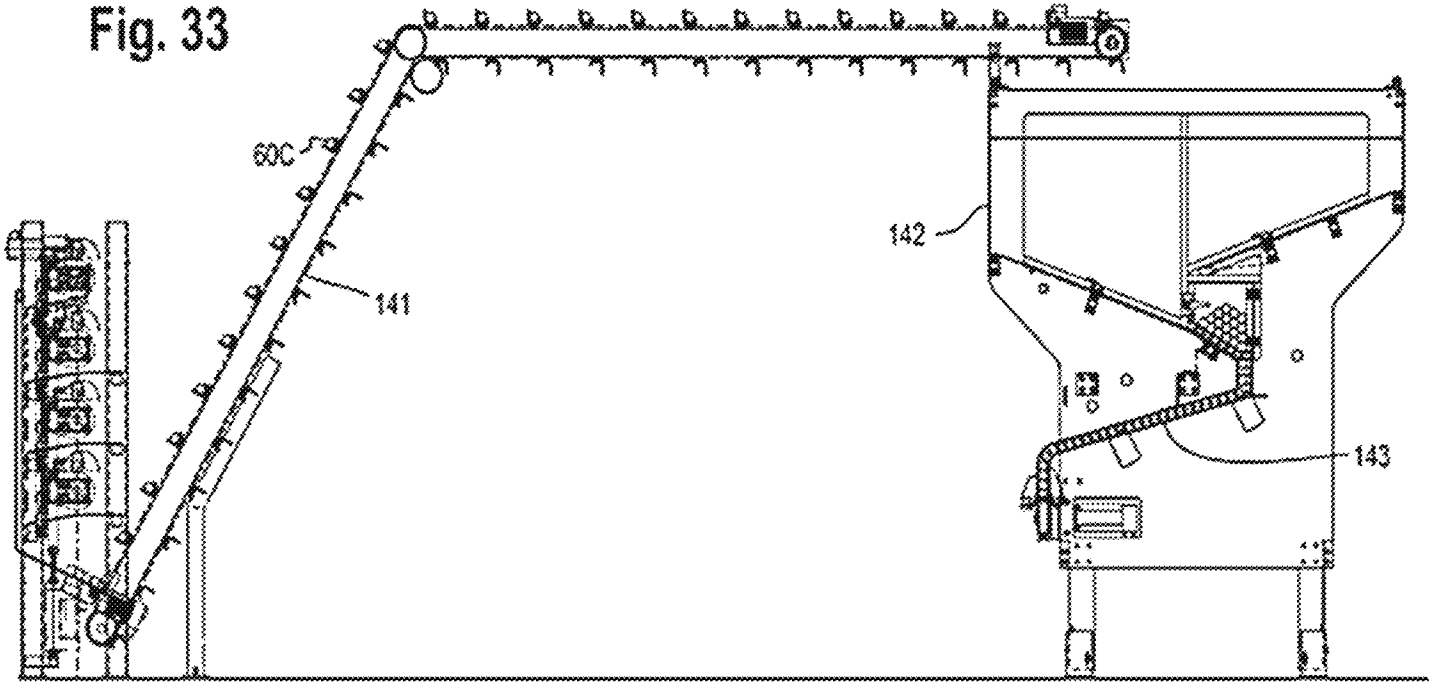
FIG. 33 is an end view of the recirculation path of FIG. 32.

FIG. 33 is an end view of the recirculation path of the mandrels. The conveyor 141 delivers the mandrels 60C to a hopper 142 which includes a discharge chute 143. The mandrels are fed by the discharge chute to the infeed conveyor 137.

Pressurized Expansion of the Mandrel During Winding

If for a given product format the extraction force is too great to use a radially compliant, thin-walled mandrel, even when the mandrel is elongated during extraction to minimize the breakaway force, the mandrel can be made with thicker walls, or even solid. However, this action would forfeit numerous advantages of the thin-walled mandrel.

Instead, its novel monocoque construction permits the alternative of inflating the mandrel while winding the log, then removing the internal fluidic pressure later in the winding process, or after winding is complete, allowing the mandrel to deflate and return nearly to its original size, before the log is pushed off or the mandrel is pulled out. This method may be employed instead of stretching of the mandrel within the log by pulling both ends during extraction. However, because the former operates during winding and the latter operates during extraction, they are not mutually exclusive and both can be employed to achieve greater reduction of the peak extraction force together than either does alone.

Paraphrased excerpts of the explanation of monocoque on Wikipedia are shared below. They are available at the following web site.

http://en.wikipedia.org/wiki/Monocoque

Monocoque is a construction technique that supports structural load by using an object's external skin, as opposed to using an internal frame or truss that is then covered with a non-load-bearing skin or coachwork. The term is also used to indicate a form of vehicle construction in which the body and chassis form a single unit.

The word monocoque comes from the Greek for single (mono) and French for shell (coque). The technique may also be called structural skin or stressed skin. A semi-monocoque differs in having longerons and stringers. Most car bodies are not true monocoques, instead modern cars use unitary construction which is also known as unit body, unibody, or Body Frame Integral construction. This uses a system of box sections, bulkheads and tubes to provide most of the strength of the vehicle, to which the stressed skin adds relatively little strength or stiffness.

The same characteristics of HDPE that produce a large axial elongation and significant diametral reduction when a modest axial force is applied also serve to produce a large diametral increase when a modest internal pressure is applied. A modest internal pressure induces stresses well below the yield strength of the material so that the mandrel returns to its original size within a reasonable period of time. Again, attributes that signify these requisite characteristics are present include glass transition temperature below the service temperature and a large value for yield strength divided by elastic modulus.

Mechanically expansible mandrels have been used to accomplish a similar effect in coreless rewinders, but they invariably are complex assemblies composed of many intricate parts wherein the expanding parts that contact the inside of the product are essentially a shell around the elements within the mandrel that bear the flexural and axial loads. The result is an expensive and heavy device that cannot be used as a recirculating mandrel in a coreless surface rewinder.

Fluidically inflatable mandrels have been used to accomplish this effect in coreless rewinders, but they invariably are also complex assemblies composed of many parts wherein the inflated portion that contacts the inside of the product is either a skin wrapped about, or a tire set upon, the elements within the mandrel that bear the flexural and axial loads. Here too the result is an expensive and heavy device that cannot be used well as a recirculating mandrel in a coreless surface rewinder.

By contrast, the monocoque design of this invention retains all the advantages of the thin-walled, radially elastic, axially elastic mandrel, because the inflation is executed by straining the same shell that carries all the loads. It is lower cost, lower mass, lower polar inertia, causes less damage during high speed crashes, etc.

Further advantages include the following. No seams to mark nor catch on the product internal diameter, as the mechanically expansible mandrels have. The inflation is uniform for the entire length of the mandrel, unlike the units with elastic skins that will bulge more at the midpoints and less at the ends. Also, the monocoque design will retain the same concentricity between OD and ID when inflated as when deflated. It happens naturally with the monocoque design, but would be an extreme challenge if a rigid mandrel with inflatable skin was used in a production width surface rewinder.

Figure 41:
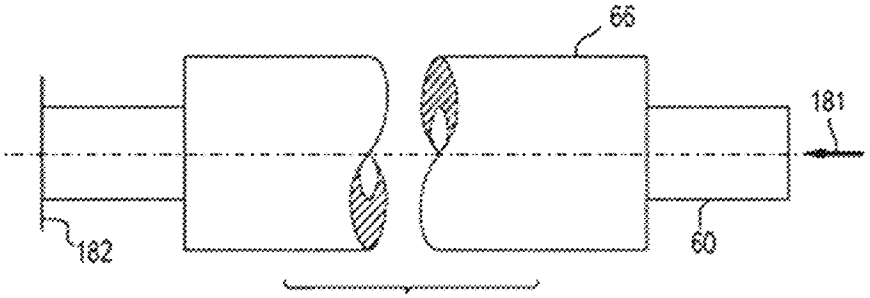
FIG. 41 illustrates the concept of pressurizing the mandrel during winding.

FIG. 41 illustrates a log 66 which is wound on a tubular mandrel 60 while the interior of the mandrel is pressurized by gas or fluid as indicated by the arrow 181. The other end of the mandrel may be closed as indicated by the cap or plate 182 or may also be pressurized. The fluid, preferably pneumatic, can be supplied to the interior of the elastic mandrel by means similar to those taught in U.S. Pat. No. 2,520,826. The fluid can be delivered to, and vented from, both ends of the mandrel when rapid pressurization and/or depressurization is required.

The objective of U.S. Pat. No. 2,520,826 is to temporarily increase the radial stiffness of the cores, so they are not crushed by the caging rollers, which may apply a high nip force. The means is pressurizing the winding cores. It makes no mention of withdrawing these cores or otherwise producing coreless product. Nor does it mention an increase to the core diameter due to the pressurization.

Because the wall of the mandrel is thin relative to the diameter of the mandrel the hoop stress within the wall can be calculated with Barlow's formula. The explanation of Barlow's formula provided below was taken from *HDPE Physical Properties* by Marley Pipe Systems. It can be found at the following web site.

http://www.marleypipesystems.co.za/images/downloads/hdpe_pressure_pipe/HDPE_physical-properties_v002.pdf The internationally accepted method for calculating circumferential hoop stress is derived from Barlow's formula and is as follows:

$$\sigma=p(d-t)/2t$$

where:

p=internal pressure (MPa)

t=minimum wall thickness (mm)

d=mean external diameter (mm)

σ=circumferential hoop stress in wall of pipe (MPa)

An example of pressurizing a HDPE mandrel with 1.700-inch OD×0.036-inch wall thickness will be provided to illustrate the magnitude of the diameter change that can be achieved is significant to the process.

Internal pressure of 61 psig induces hoop stress of 1,410 psi. This stress level is well below the material yield strength of 4,000 psi. The amount of diameter increase that corresponds to this level of stress depends on the elastic modulus and the stress-strain curve. The linear relationship of Hooke's Law indicates the diameter increase will be 0.016 inches. Due to the nonlinearity of the HDPE stress-strain curve, and the effect of load duration (creep), the diameter increase is likely to be about 50% greater than this, or about 0.024 inches.

Internal pressure of 76 psig induces hoop stress of 1,756 psi. This stress level is still well below the material yield strength of 4,000 psi. The linear relationship of Hooke's Law indicates the diameter increase will be 0.020 inches. Due to the nonlinearity of the HDPE stress-strain curve, and the effect of load duration, the diameter increase is likely to be about 50% greater than this, or about 0.030 inches.

The amount of diameter increase when the pressure is applied is approximately equal to the amount of diameter decrease after the pressure is removed. Diameter reductions of these magnitudes, from log winding to mandrel extraction, can significantly reduce the extraction forces.

It is desirable to inflate the mandrel very early in the wind, before many wraps of paper are put onto the mandrel, because the wraps of paper may constrain the mandrel inflation. If the inflation is done before the rider roll is in contact, the wraps of web are relatively few, and not very tight, so the mandrel can increase in diameter and the wraps of web can stretch slightly, if necessary. Inflation can certainly be done after rider roll contact, but it may produce less mandrel diameter growth.

There is a secondary effect of inflating the elastic mandrel with internal pressure—if the ends are not restrained in the axial direction, the mandrel shortens. This is due to the Poisson effect and can be quantified using Poisson's ratio. If pressurized to 61 psig the HDPE mandrel examined above would undergo axial strain of −0.4% (Hooke's Law) to −0.6% (1.5×Hooke's Law). If pressurized to 76 psig it would undergo axial strain of −0.5% (Hooke's Law) to −0.75% (1.5×Hooke's Law). For a 110-inch long mandrel these strain values correspond to length reduction of 0.44, 0.66, 0.55, & 0.83 inches, respectively.

This reduction in mandrel length within the log should not pose a problem for the process, as long as adequate length protrudes from the ends of the log for extraction. It may even be beneficial, because the mandrel will start elongating of its own volition after the internal pressure is removed, thereby assisting the progressive breakaway between mandrel and log that minimizes the peak extraction force.

But, what if the ends are axially restrained, so the mandrel cannot shorten, or cannot shorten as much? Tensile force, and therefore tensile stress, develops within the wall of the mandrel. As taught in U.S. Pat. Nos. 7,293,736 and 7,775,476 having tensile force acting within 'the long, slender core can assist with controlling lateral vibration within the log. Tensile force can also be effective in this regard when the long, slender item is an elastic mandrel instead of a cardboard core. A significant difference is that instead of chucks pulling on the tube, as with the prior art, the inflated elastic mandrel pulls on the chucks.

Of course, if it is axially restrained, the elastic mandrel may not inflate to as large of diameter. However, this is controlled by variable fluid (pneumatic) pressure, that is simple to regulate, and therefore simple to experiment with and optimize.

The means taught in U.S. Pat. No. 2,520,826 for coupling to the ends of the core may be modified to ensure sealing at both minimum and inflated diameters, and also to retain their grip on the mandrel ends to oppose the axial tensile force developed within the mandrel.

Depending on how the mandrel ends are engaged, the pressure within the mandrel can tend to make the mandrel undergo axial shortening or lengthening. Depending on how the mandrel ends are restrained, the tendency of the mandrel to axially shorten or lengthen may induce tension or compression stresses within the mandrel. There are numerous combinations of ways to engage the mandrel ends (for pressurization) and to restrain the mandrel ends (for control) to produce various effects.

Interaction between the log ID and mandrel OD also influences if, and how much, the mandrel actually changes length. For instance, tighter wound logs with greater interlayer pressure offer greater resistance to axial movement of the mandrel within the log.

Transfer Adhesives

U.S. Pat. No. 6,752,345 describes in lines 26-42 of column 2 various ways to transfer web onto winding mandrels without using high tack transfer glue typically used with cores. These methods are employed because high tack glue makes the extraction of the mandrel from the log more difficult. Lines 43-48 of column 2 explain that these methods are simply not reliable enough to run high speed. Vacuum transfer and web tucking can also be added to the list of comparatively poor methods, for reasons described in the background section of this document.

Other benefits of using transfer glue include the following.

- Transfer glues of low and moderate viscosity penetrate the web and seal the internal tail to the adjacent web wrap. This prevents the internal tail from unraveling during handling and transit, a major quality issue, because the roll cannot be mounted in a standard dispenser if it has internally unwound, closing the hole.
- A machine that can quickly and easily switch between production with cores and without cores is far more practical if transfer glue is used for both. Providing alternate transfer means for the coreless production is higher cost, more maintenance, greater complexity, and requires more crowding of components, making it harder to work on.
- Perfume scent can be put in the transfer glue. It is very common in some markets to scent bath tissue. It is usually done by spraying or dripping perfume on the cores. This cannot be done with coreless products. An attractive alternative is to put the perfume scent into the transfer glue. No additional application equipment is required.
- A secondary benefit is that less perfume can be used, relative to when running with cores, which is a cost savings. Perfume is usually put on the external diameter of the cores, so it is wrapped inside the finished product. Perfume in the transfer glue of coreless product would be exposed to the atmosphere, so reduced quantity of perfume can produce the same aroma.

Commercially available, off-the-shelf formulations of transfer (pickup) adhesives can be used with the elastic mandrels. And these adhesives can be applied with existing applicator methods. This is no surprise, because it is the same glue as used in the past applied to mandrels that behave much like a cores. Another possibility is to use lower wet tack tail-tie adhesive. Of course, special formulations specifically tailored to coreless production can be developed as well.

All the glues discussed below can be applied to the elastic mandrels with an extrusion application system. The extrusion application system can be adjusted to work with higher or lower viscosity glue. It works best with glue having viscosity in the range of 3,000 to 18,000 cps.

Diverse and numerous options are available regarding the transfer glue. The following information is provided to demonstrate feasibility of this approach. The examples are specific, but it is to be understood they are not limiting.

The adhesives can be sorted into three general categories: clean, waxy, and gummy.

A. Clean Adhesives

Examples are Henkel Seal 118T and Henkel Seal 3415. Both are tail-tie adhesives, used to seal closed the outer tail of a finished tissue or towel log. Tail-tie adhesives have very good wetting and penetration, so are excellent at sealing the internal tail when used as transfer adhesive. They also are excellent at transferring bath tissue, due to its high absorbency, at high web speeds.

Seal 118T has nameplate viscosity of 4,500 cps. Seal 3415 has nameplate viscosity of 6,000 cps.

The most remarkable thing about using these glues on HDPE mandrels is how clean the mandrels emerge when extracted from the log. They are pristine, without an indication that transfer glue was ever on them. If the glue is still wet when the mandrel emerges, it is merely a very fine, thin film that rapidly disappears without a trace when exposed to the atmosphere. The log interior sustains no damage, and the adhesive does not add substantially to the magnitude of the extraction force.

These adhesives require no special measures, nor washing, to keep the mandrels clean in recirculation.

B. Waxy Adhesives

Examples are Henkel Tack 3338 and Henkel Tack 5511MH. Both are high tack pickup (web transfer) adhesives frequently used when transferring bath tissue or kitchen towel webs on cores. It may be desirable to use them to achieve higher reliable transfer speeds, especially for heavier and/or less absorbent substrates.

Tack 3338 has nameplate viscosity of 9,000 cps. Tack 5511MH has nameplate viscosity of 18,000 cps.

A small amount of residue is left behind on extracted HDPE mandrels when these glues are used. The amount of residue is less for the lower viscosity glue and greater for the higher viscosity glue. If the glue is still wet when the mandrel emerges, it dries fairly rapidly when exposed to the atmosphere, with the lower viscosity glue drying faster and the higher viscosity glue taking longer. For both the dried residue is waxy, possessing no tack. It can be easily wiped away with a dry cloth or dry tissue. In fact, if it was possible to extract it twice from the log, all the residue would be wiped off by the second pass.

These glues have not been tested in extended production, so it is not known whether the small amount of zero tack, waxy residue left on the mandrels is a problem for recirculation. If it does not foul the machine, it is acceptable. Any residue left behind from one log will be wiped off when the mandrel is extracted from its next log, so residue on the mandrels will immediately reach an equilibrium level, not continue escalating. Contamination deposits in the recirculation system and rewinder could continue escalating, however. If this is a problem an automated dry wiping or cleaning device could be installed within the recirculation path. The fact that the residue can be wiped off without water or other solvent makes this combination of mandrel material and glue very attractive relative to the prior art.

As with the clean tail-tie adhesives, the log interior sustains no damage. These adhesives do increase the magnitude of the extraction force by a minor amount.

C. Gummy Adhesives

An example is Henkel Tack 6K74. This is a high tack pickup adhesive frequently used when transferring bath tissue or kitchen towel webs on cores. It was formulated to have long open time, which means it remains tacky for a long time, even as it dries. Some glues that have long open times remain tacky indefinitely when put on a hard surface that has no absorbency. It is not known that these glues offer any significant advantage relative to the category of pickup glues that dry waxy and also have high tack.

A small amount of residue is left behind on extracted HDPE mandrels when this glue is used. The amount of residue left behind is depends strongly upon the amount of glue applied. In all tests the glue was still wet when the mandrel emerged. It was still tacky and it did not dry quickly. In fact, generally it remained tacky, with a gummy feel, for a relatively long time (longer than 10 minutes in one test).

Though this glue has not been tested in extended production, so it is not known for certain that the small amount of gummy residue left on the mandrels would foul the machine, it is expected to cause problems, so something must be done about it. Because the glue remains gummy for a relatively long time it cannot be wiped away with a dry cloth or dry tissue. However, it can—because it is water soluble—be very easily wiped off with a wet cloth or wet tissue. The residue could be washed off manually. Or the cleaning could be automated by the installation of washers within the recirculation path.

Whether the log interior sustains minor damage or no damage depends largely on the strength or weakness of the substrate itself. In most cases logs will sustain no damage when secured by the end face and periphery, as described in the section on log restraint. This adhesive increases the magnitude of the extraction force by a greater amount than the adhesives that dry waxy.

Clean Mandrel Extraction

The market desires a simple, low cost coreless system that exhibits good glue hygiene. A system wherein the log itself wipes the mandrel clean and no automatic nor manual cleaning is required would be ideal.

As explained in the previous section, when clean tail-tie adhesives are used on HDPE mandrels, the extraction force is relatively low, neither the log nor mandrel sustains any damage, and the mandrel remains completely clean. It is an outstanding solution to what had been a complex and thorny issue.

However, it may be advantageous for some products or substrates, or perhaps converters insist on it due to their own preferences, to use other adhesives that may be waxy, gummy, or otherwise just not as clean. The methods taught below were developed to deal with this situation, and thereby increase the selection of glues that run with good hygiene—clean mandrels, clean extractor, clean recirculation system, clean rewinder. Though the methods were developed primarily to accommodate use of 'problem' transfer glues, they certainly can be employed with any transfer glue.

Most modern surface winders have a line of transfer glue along the length of the core, parallel to the longitudinal axis of the core, not rings of transfer glue about the circumference of the core. This arrangement is beneficial for using less glue per core, having less glue contamination in the machine, and having higher quality, more reliable web transfers. The line may be continuous or broken by gaps. Methods of applying such glue lines are taught in U.S. Pat. Nos. 5,040,738 and 6,422,501. Lines 26-44 in column 4 of U.S. Pat. No. 5,040,738 explain some advantages of the single glue line.

Figure 34:
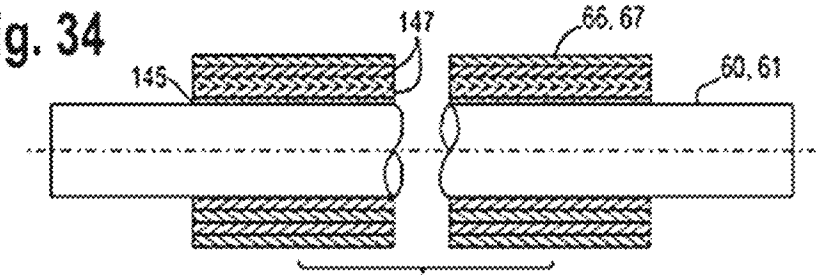
FIG. 34 is a fragmentary sectional view of a wound log and a mandrel showing an axial stripe of adhesive or glue attaching the first layer of winding to the mandrel.

FIG. 34 is a cross sectional view of a log 66 or 67 which is wound on either a tubular mandrel 60 or a solid mandrel 61. An axial line of adhesive 145 is applied to the mandrel before winding. The log is formed by a plurality of layers or wraps 147 of paper, and only a few of the layers are illustrated. The adhesive 145 secures the first layer of paper to the mandrel.

It is preferable that mandrels for coreless production utilize this same longitudinal glue line to retain its numerous advantages. However, when the mandrel is extracted (or log pushed off) in the longitudinal direction, disposition of the transfer glue in a single line parallel to the longitudinal axis of the mandrel causes glue that remains in the interface between the mandrel and log, because it has not been absorbed by the web, to smear, as the free glue and glued web all move in the same direction. If instead, some unglued dry web passed over the free glue in the line to disperse it, the glue would be spread thinner and be largely absorbed by the web or transferred to the web, rather than simply smearing down the length of the mandrel.

The method consists of rotating the mandrel within the log before it is extracted, or as it is extracted. The relative rotation smears the free glue and glued web about the circumference of the mandrel OD and log ID instead of axially along the length of the mandrel. This action transfers more free glue to the log, promotes absorption of more free glue by the web, and disperses the free glue line so any residual glue on the mandrel is an extremely thin film that will not transfer as contamination to machine elements in the extractor, recirculation system, rewinder, etc.

This relative rotation may be executed at any time after the web transfer is complete. It can be accomplished by holding the log and rotating the mandrel, or by holding the mandrel and rotating the log. Practically, holding the mandrel and rotating the log should be simpler to implement, if it is done after winding of the log is complete.

FIGS. 37-40 illustrate an apparatus for rotating a log relative to the mandrel before the mandrel is extracted in order to smear or disperse the axial line of adhesive around the circumference of the mandrel. A log 66 or 67 with a mandrel 60 or 61 is supported by a pair of lower rollers 170 and 171 which are rotatably mounted in roller bearings 172 which are mounted in a frame 173. An upper roller 174 is similarly rotatably mounted in a pair of roller bearings 172 which are mounted in a movable portion 173*a* of the frame. A timing pulley 175 is mounted on the left or drive side of each of the upper and lower rollers for rotating the rollers by means of a driven timing belt.

Right and left mandrel clasps 69R and 69L are slidably mounted on linear guides 176 which are mounted on the frame. Each of the clasps is movable axially relative to the log by an actuator 177.

Figure 39:
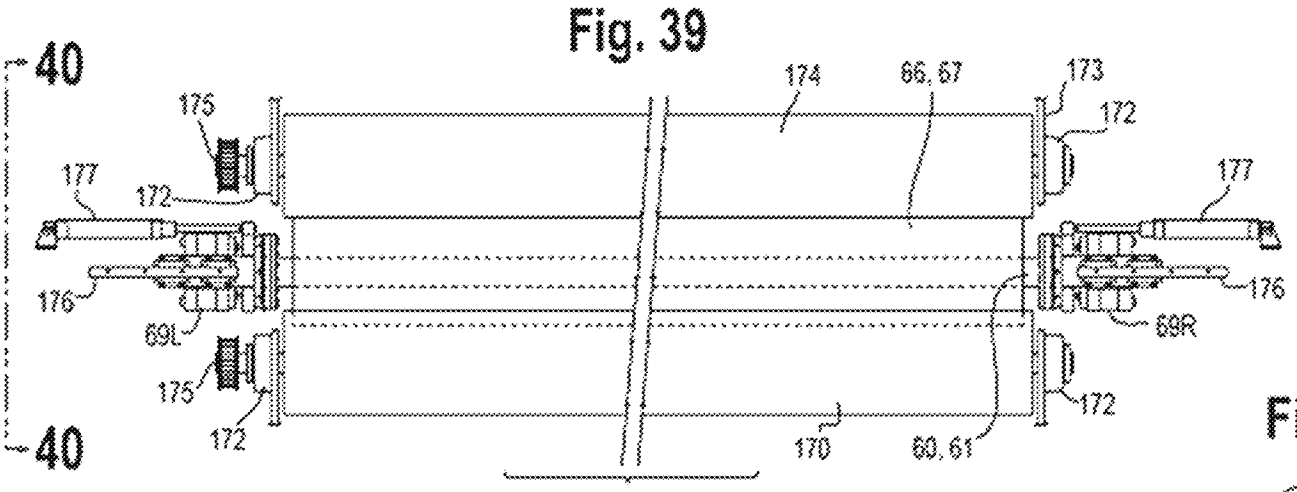
FIG. 39 is a view similar to FIG. 37 showing the clasps and the upper roller engaged.
Figure 40:
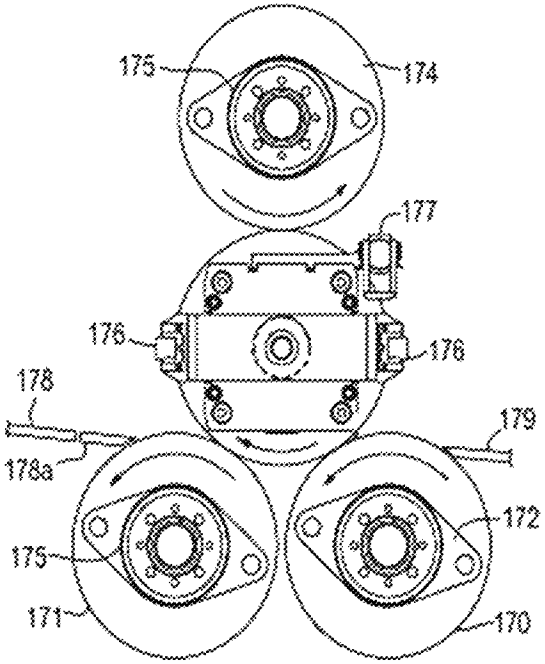
FIG. 40 is an end view taken along the line 40-40 of FIG. 39.

A log is moved onto the two lower rollers 170 and 171 by rolling down an infeed table 178 (FIG. 40). The upper roller 174 is then moved down into engagement with the log, and the right and left clasps 69R and 69L are moved into engagement with the mandrel 60, 61 as shown in FIG. 39. The mandrel 60 or 61 is held stationary by the clasps while the log is rotated by the driven upper and lower rollers 171, 172, and 174. The torque necessary to initiate relative rotation may be reduced by having the clasps 69L and 69R stretch the mandrel. If this is done the actuators 177 may be relocated in-line with the mandrel 60,61 to minimize moment load on the linear guides 176.

After the log is rotated sufficiently to smear the adhesive around the surface of the mandrel, the clasps and upper roller are disengaged, and the log is rolled down a discharge table 179 (FIG. 40). The log can be discharged by pivoting the left roller 171, with a portion of the infeed table 178*a*, about the right roller 170.

Alternatively, the relative rotation of mandrel to log can be accomplished while the log is still in the winding nest, by forcing the mandrel to rotate faster or slower than the log would cause the mandrel to rotate based on the log being driven solely by the rolls at its periphery.

Advantages of executing the relative rotation in the winding nest are listed below.

- The transfer glue has had less drying time, so relative rotation is easier to initiate.
- Because relative rotation is easier to initiate, there is less chance of damage to the product and mandrel.
- It can be accomplished by adding brakes or motors to the core position guides, which may be supplied anyway for other reasons, such as controlling log telescoping, so it can be far less expensive to implement.
- It can be used to influence the winding of the log, as explained below.

Advantages of initiating the relative rotation early in the cycle, if it is executed in the winding nest, are listed below.

- The transfer glue has had the least drying time, so relative rotation is easier to initiate.
- The contact pressure between the log and mandrel is less, due to fewer web wraps about the mandrel, so relative rotation is easier to initiate.
- Because relative rotation is easier to initiate, there is less chance of damage to the product and mandrel.
- As explained earlier in this document, once relative movement has been initiated, it requires less force (or torque) to maintain it, so starting it when easier is better.

The relative rotation can be brief, or continued through much of the wind cycle duration. Some reasons it may be preferable to keep it brief are listed below.

- The relative rotation may be executed early in the wind, for a brief period, before the mandrel is pressurized, and thus increased in diameter, which raises the contact pressure between the log and mandrel.
- The relative rotation may be executed late in the wind, for a brief period, after the mandrel has depressurized, and thus decreased in, diameter, reducing the contact pressure between the log and mandrel.
- The relative rotation may be executed for only a portion, or portions, of the winding cycle if the friction of the relative motion generates excessive heat and threatens to weaken or damage the mandrel.

A reason to continue through a majority of the wind cycle period is that it can then be used to influence the log characteristics, assisting with making the wind tighter or looser.

When the mandrel is rotated relative to the log it transmits a torque to the log interior, due to friction between the mandrel and log inside diameter. If the mandrel is made to rotate slower than the log would drive it, the mandrel slips backward and supplies a negative torque to the log interior. If the mandrel is made to rotate faster than the log would drive it, the mandrel slips forward and supplies a positive torque to the log interior. The positive torque would tend to assist in winding the log tighter and smaller, the negative torque would tend to assist in winding the log looser and larger.

This is effectively a center-surface winder with the center drive operating in torque mode through a form of slip clutch. As such it is not entirely new. But, the fact that slipping occurs between a surface of the mandrel and a surface of the log, specifically the OD of the mandrel and the ID of the log, is novel.

Center-surface winders have one, or more, driven drums and a drive to the core, or mandrel, where the center drive may be directly to the core, or to the core via a mandrel within the core. The U.S. Pat. No. 1,437,398 (Cameron), U.S. Pat. No. 2,090,130 (Kittel), U.S. Pat. No. 2,385,692 (Corbin), U.S. Pat. No. 5,639,045 (Dorfel), U.S. Pat. No. 6,199,789 (Celli), U.S. Pat. No. 7,293,736 (Recami), U.S. Pat. No. 7,775,476 (Recami), & U.S. Pat. No. 7,942,363 (Gelli) teach center-surface winding.

Cameron '398 has two embodiments. The first, that they call a "center rewind," is described in lines 30-43 on page 2. It is today commonly referred to as a single drum center-surface winder. The second, that they call a "surface rewind," is described in lines 47-54 on page 2. It is today commonly referred to as a 2-drum center-surface winder. The rewinder operates with a mandrel inside a row of adjacent coaxial cores. The problem they claim to solve is present on prior art of both types, though they state in several places that, in their experience, it is worse on single drum center-surface winders.

The machine is intended for winding firm rolls composed of low bulk paper. Loosely wound rolls are considered defective because the layers can shift internally and may collapse during handling after winding is complete; and, they are problematic operationally, due to interweaving of the slit strips.

Loosely wound rolls occur when the driven winding shaft rotates too slowly, relative to the surface driving drums, for a given paper caliper. This can happen on slitting rewinders because the web strips in areas of thinner caliper make rolls smaller in diameter than the adjacent rolls, but the cores of all the rolls share the same angular velocity because they are mounted on a common shaft. This is explained in lines 64-80 on page 1.

An important distinction is that, though these rolls are smaller than their brethren on the same mandrel, they are larger (more voluminous) than they should be because they are too loosely wound. And the reason they are too loosely wound is that their cores are being driven at slower speed than they should be. In a roundabout way this teaches that negative torque applied to the log center assists in winding a log looser and larger.

Their invention is a mandrel that allows each core to slip relative to the mandrel. It is like each core has its own friction clutch so they can rotate at different speeds than the mandrel and each other. Thus each roll rotates at a unique angular velocity so the peripheral speed of all the rolls is uniform and matched to the feed rate of the web. This is effectively an automatic trimming of the center drive speed to achieve uniform firmness and compactness among the rolls.

An important aspect of the solution is that the invention causes the cores of the formerly loosely wound rolls to rotate at a higher angular velocity than their brethren on the same mandrel, which makes the rolls wind tighter and smaller (more compact). In a roundabout way this teaches that positive torque applied to the log center assists in winding a log tighter and smaller.

The mandrel rotation operates under torque control via drive train through a slip clutch and the individual cores operate under further (secondary) torque control, via their own individual slipping. The mechanisms that provide for slipping of the cores relative to the mandrel are described in lines 7-78 on page 3. The slipping elements in the torque transmission from the center drive to the winding rolls are flat surfaces transverse to the longitudinal axis of the mandrel and cores. Slipping between the core OD and log ID is not taught, nor logical. Furthermore, there is no mention of coreless rewinding.

Kittel '130 describes a 2-drum center-surface winder. A stated special object of the invention is to produce "rolls of substantially uniform compactness" (lines 7-8 on page 1). Claim 4 on page 2 summarizes the correct speed of the center drive to accomplish this, defining what may be termed a matched speed that applies neither positive nor negative torque to the wind, rather only the driving torque necessary to rotate the roll:

> "A combination center and surface winder comprising backing rolls, a take-up roll riding on said backing rolls and having a center drive shaft, constant surface speed drive gearing to said backing rolls and variable speed drive gearing to said center shaft, including self-compensating gearing for automatically driving said center shaft at a speed to maintain constant surface speed of the take-up roll at the points of riding engagement with the backing rolls."

There is no mention of slipping between the mandrel and product rolls nor of slipping between the core OD and product ID. Furthermore, there is no mention of coreless rewinding.

Corbin '692 describes a machine that operates as a 3-drum center-surface winder until the cage rollers withdraw, after which it operates as a single drum center-surface winder. It is the combination of a surface winder and turret winder with no mandrels. The cores are supported and driven via chucks at each end. Each pair of chucks has a slip clutch (items 88 and 89, FIG. 11) as the slipping element in the torque transmission from the center drive to the winding rolls. Slipping between the core OD and log ID is not taught, nor logical.

There is casual mention of coreless rewinding in lines 23-28 of column A on page 1. It states, "in the absence of a core [the rolls would be wound] directly upon a suitable mandrel which may subsequently be withdrawn from the finished roll." However, nothing is taught regarding this suitable mandrel. No remarks upon its geometry, material composition, nor how it would be used are provided. Furthermore, none of the daunting challenges to successful coreless rewinding is mentioned, nor instruction given as to how they can be overcome.

Dörfel '045 describes a 3-drum center-surface winder. At least one of the chucks is optionally rotationally driven as explained in lines 9-15 of column 5. It teaches a benefit of center-surface winding in lines 4-8 of column 5:

> "A center drive of this type reduces the torque to be transferred onto the reel 13 by the king rolls 11 and 12. This measure in particular makes possible an improved structure of the reel, i.e., a superior predetermination of the reel density."

There is no mention of slipping between the mandrel and product rolls nor of slipping between the core OD and product ID. Furthermore, there is no mention of coreless rewinding.

Celli '789 describes a 3-drum center-surface winder. The rewinder operates with a mandrel inside a single core, or row of adjacent coaxial cores if the web is slit into strips. There is no mention of slipping between the mandrel and product rolls nor of slipping between the core OD and product ID. Lines 15-16 of column 2 state "The winding mandrel is preferably expandable, in a manner known per se." This is almost certainly a mechanically expansible mandrel of the type that is a complex assembly composed of many intricate parts, thought its nature is not explicitly stated. Lines 7-11 of column 2 state "because there is only one mandrel and it is not recycled around the machine, as happens in some currently used rewinders, the size and weight of the mandrel can actually be made considerable in order to increase its strength." This is the opposite of the lightweight elastic mandrel of the present invention.

There is casual mention of coreless rewinding in lines 34-36 of column 2. It states, "Theoretically the machine could perform winding directly on the axial mandrel, which is then extracted from the finished reel so that the finished reel has no winding core." However, nothing is taught regarding details of the mandrel. No remarks upon its geometry, nor material composition, are provided. Furthermore, none of the daunting challenges to successful coreless rewinding is mentioned, nor instruction given as to how they can be overcome.

Recami '736 and '476 describe a 2-drum center-surface winder. The cores are supported and driven via chucks at each end. Each chuck is driven by a motor. Slipping between the core OD and log ID is not taught, nor logical. Furthermore, there is no mention of coreless rewinding.

Gelli '363 describes a 3-drum center-surface winder. The cores are supported and driven via chucks at each end. Each chuck is driven by a motor. Slipping between the core OD and log ID is not taught, nor logical. Furthermore, there is no mention of coreless rewinding.

Lastly, the present invention is different from all the prior art in that the primary purpose of the relative rotation is to disperse transfer glue so that a clean mandrel can be removed from the log. A secondary purpose may be to influence the wind structure of the log, by increasing or decreasing its tightness, and this is different from all the prior art because the method of applying positive or negative torque to the log interior is sliding friction between the OD of the mandrel and the ID of the log, which is novel.

Brakes are adequate for making the mandrel go slower (phase in reverse relative to the log) and may be easier to implement, due to their light weight and small size. Motors are required for making the mandrel go faster (phase forward relative to the log) and can also be used to make it go slower, as brakes can.

This method is unlikely to be necessary for the 'clean' transfer adhesives, but it may be utilized anyway, and may actually be advantageous for some substrates, some product formats, or if an especially large quantity of transfer glue is applied. This method renders most, or all, of the 'waxy' transfer adhesives acceptable. When dispersed to such a thin film, the small amount of residue will not transfer to other machine components as contamination.

It is not known how effective it may be for the 'gummy' transfer adhesives. Certainly it can help, though for some product formats and substrates it may damage the log by altering the wind profile adversely, or even tearing the sheet, as the ever tacky glue resists shearing and spreading. Nonetheless, the fact that this method renders the 'waxy' glues usable without mandrel washing is a tremendous benefit. The 'waxy' high tack glues are just as tacky and effective at transferring heavy and/or low absorbency webs as the 'gummy' high tack glues, so the spectrum of products can be accommodated, even if the spectrum of glues used with cores cannot.

Any of the prior art center drive mechanisms which have been discussed can be used to rotate the mandrel relative to the log to provide clean mandrel extraction.

Static Electricity

HDPE and other polymers possess high electrical resistivity. Winding mandrels made of these materials develop and hold static electrical charges. The charges attract dust vehemently. For most of the rewinder this is a minor issue, because dust generated in the converting processes is nearly everywhere. However, if transfer adhesive is applied by extrusion, the dust must be dealt with at the extruder, or the applicator (which touches the mandrel) will strip the dust off With each cycle a little more dust may accrete until the applicator is partially or fully blocked, so frequent cleaning would be required.

Dust can be kept from accreting on the extruder by blowing the dust off the surface of the mandrel in-line with the extruder, just upstream of the extruder. This can be done effectively with a high velocity air stream. Using dry air for this purpose is the preferred embodiment because it is effective and also very simple.

Alternatively, a dry brush or wiper or the like could be used. The brush or wiper may be metallic or other electrically conductive material and grounded to assist with temporarily removing the static charge. This device may be combined with the air stream to dissipate the dust and keep the device clean. Alternatively, it may be combined with suction, or a vacuum system, in extremely dusty environments.

Alternatively, an electrical conducting fluid may be applied to the mandrel, upstream of the glue applicator. This may be atomized and delivered via air stream, or applied via a brush, wiper, or the like. Drawbacks, relative to a dry system, are greater system complexity, a consumable fluid added to the process, and the fact that fluid may wet nearby surfaces that will then collect ambient dust, making matters worse. The fluid should be non-corrosive so it does not rust nearby surfaces. It must be completely nontoxic, preferably FDA approved for food contact, because small amounts will be left on the finished product. Lastly, it must disperse readily so it does not itself foul the mandrel or machine components in the recirculation system. The drawbacks are daunting and numerous. A possible justification to follow this course anyway would be if such a fluid also helps transfer residual glue on the mandrel to the inside diameter of the log during relative rotation and/or extraction by reducing the shear strength of the transfer glue adhesion to the mandrel.

Figure 35:
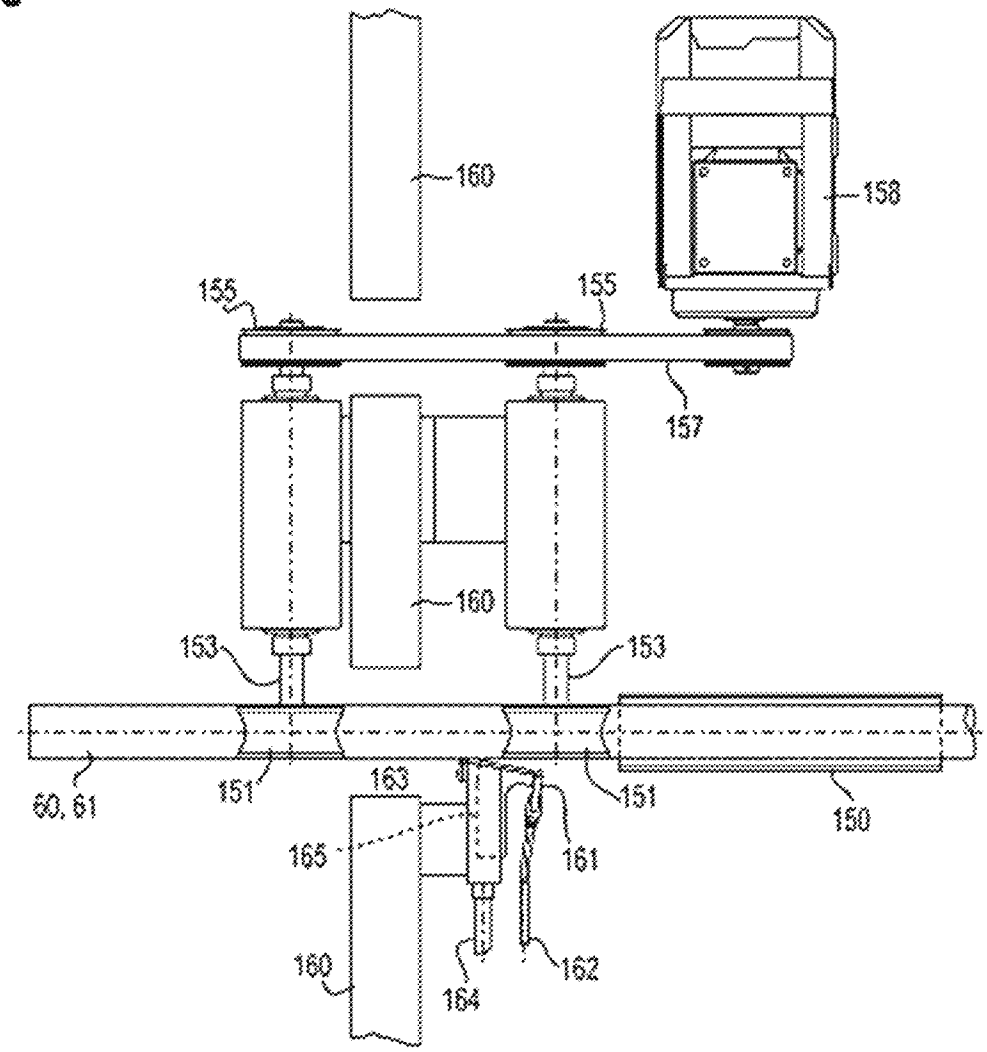
FIG. 35 is a top view of an apparatus for applying an axial strip of adhesive or glue to a mandrel.
Figure 36:
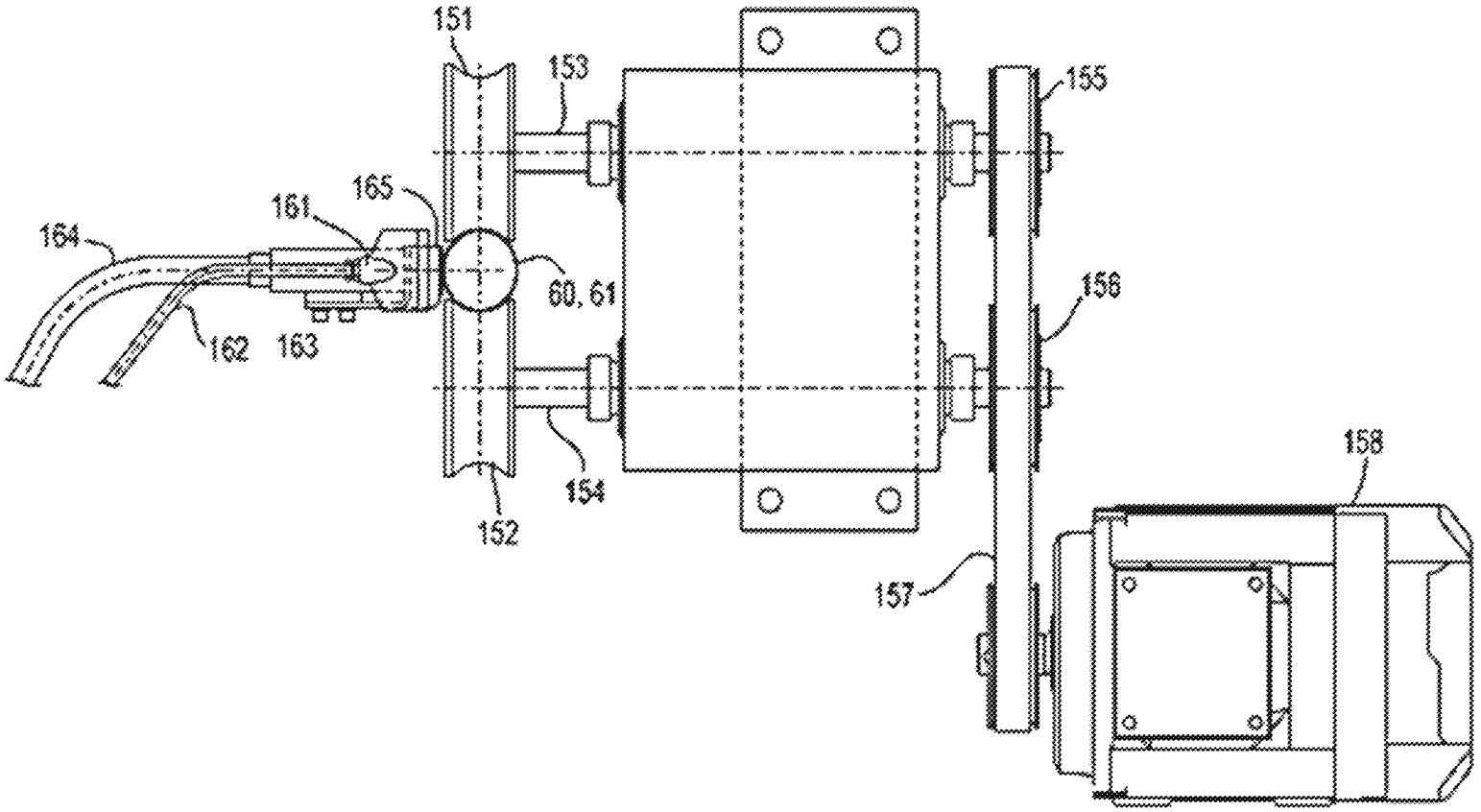
FIG. 36 is an end view of the apparatus of FIG. 35.
Figure 37:
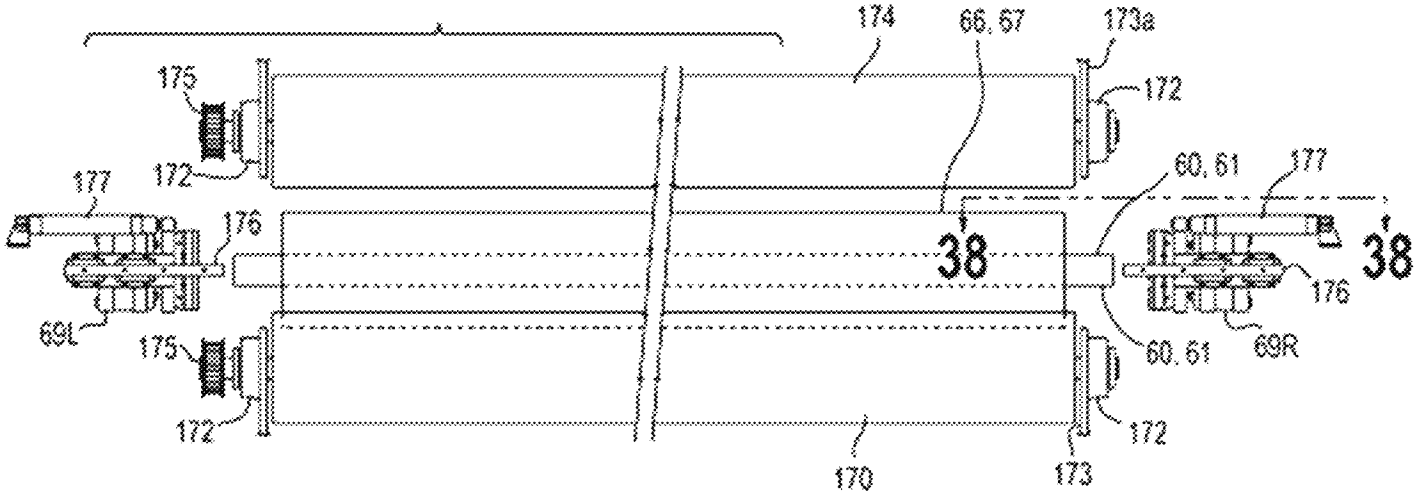
FIG. 37 is a fragmentary view of an apparatus for rotating a log about a stationary mandrel showing the clasps and the upper roller disengaged.
Figure 38:
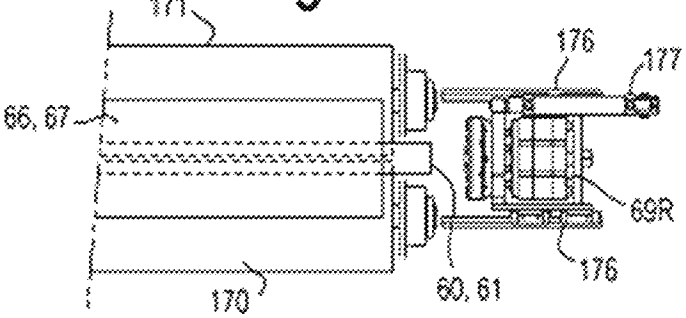
FIG. 38 is a fragmentary view taken along the line 38-38 of FIG. 37.

FIGS. 35 and 36 illustrate an apparatus for removing dust from the mandrel and applying an axial line of adhesive to the mandrel. They depict the preferred embodiment of a high velocity air stream. The mandrel 60 or 61 is fed over an infeed trough 150 and advanced by upper and lower pairs of driven feed wheels 151 and 152. The feed wheels are mounted on upper and lower pairs of axles 153 and 154, and upper and lower pulleys 155 and 156 are mounted on the other ends of the axles. The pulleys are rotated by a timing belt 157 which is driven by a motor 158. The foregoing components are mounted on the frame 160 of the device for feeding the mandrels to a rewinder.

An air nozzle 161 is mounted on the frame and is connected to air line 162 for supplying pressurized air to the nozzle. An adhesive applicator 163 is mounted the frame downstream of the air nozzle and is connected to a glue line 164 for supplying glue or adhesive to the applicator. A mandrel guide 165 ensures the leading end of the mandrel is brought smoothly into contact with the applicator 163. As the mandrel is advanced by the feed wheels, the air nozzle 161 blows off dust and other debris from the mandrel before adhesive is applied by the applicator 163.

While in the foregoing specification detailed descriptions of the invention have been set forth for the purpose of illustration, it will be understood that many of the details described herein may be varied considerably by those skilled in the art without departing from the spirit and scope of the invention.

I claim:

1. A clasp for engaging an end of a tube, the clasp comprising:

a shaft having a generally cylindrical outer surface, the outer surface being adapted to be inserted into a bore of a tube;

a housing being adapted to house a plurality of clamping blocks, the clamping blocks being spaced circumferentially around the shaft within the housing, the plurality of clamping blocks being moveable between a disengaged position and an engaged position, wherein in the disengaged position the plurality of clamping blocks are spaced radially outwardly from the outer surface of the shaft at a distance sufficient such that a tube is insertable between the shaft and the clamping blocks, and wherein in the engaged position, the plurality of clamping blocks are positioned radially inward of the disengaged position toward the shaft, and wherein in the engaged position and when a tube is disposed between the clamping blocks and the shaft, the plurality of clamping blocks presses the tube against the shaft; and at least one actuator engageable with at least one clamping block of the plurality of clamping blocks to move the at least one clamping block between the disengaged position and the engaged position.

2. The clasp of claim 1 wherein the at least one actuator is slidingly engageable with the at least one clamping block along complimentary wedge-shaped surfaces such that axial movement of the at least one actuator causes radial movement of the at least one clamping block between the disengaged position and the engaged position.

3. The clasp of claim 2 further comprising a cylinder with a piston mounted in the cylinder for sliding movement of the piston relative to the cylinder, the cylinder being operatively connected to the at least one actuator with a link such that axial movement of the cylinder causes axial movement of the at least one actuator.

4. The clasp of claim 3 wherein the piston is operatively connected to the shaft in a manner such that pressurizing the cylinder causes the cylinder to move axially relative to the shaft.

5. The clasp of claim 1 wherein the clasp is operatively connected with a pulling member, the pulling member being configured to exert an axial pulling force on the clasp.

6. The clasp of claim 1 wherein each of the clamping blocks includes a flat clamping surface configured to engage the outer surface of the tube in the engaged position.

7. The clasp of claim 1 further comprising a plurality of spacers, each of the spacers being positioned circumferentially about the shaft between the clamping blocks.

8. The clasp of claim 1 wherein the clasp is slidably mounted on a frame and moveable relative to the frame in a direction substantially parallel to the shaft.

9. The clasp of claim 8 wherein in the clasp is moveable relative to the frame between a tube engagement position in which the clasp is adjacent to a restraint configured to engage an axial face of an object mounted on a tube, and a tube disengagement position in which the clasp is spaced from the restraint.

10. A clasp apparatus for engaging an end of a tube, the clasp comprising:

a housing having a center shaft and a plurality of clamping blocks spaced circumferentially around the shaft within the housing, the plurality of clamping blocks being moveable between a disengaged position and an engaged position, wherein in the disengaged position the plurality of clamping blocks are spaced radially outwardly from an outer surface of the shaft at a distance sufficient such that a tube is insertable between the shaft and the clamping blocks, and wherein in the engaged position, the plurality of clamping blocks are positioned radially inward of the disengaged position toward the shaft, and wherein in the engaged position and when a tube is disposed between the plurality of clamping blocks and the shaft, the plurality of clamping blocks presses the tube against the shaft; and an actuator for each clamping block disposed in the housing, the actuator having a tapered surface that cooperates with a tapered surface of the respective clamping block, the actuator being configured to slide axially relative to clamping block along the complimentary tapered surfaces to move the clamping block between the disengaged position and the engaged position.

11. The clasp of claim 10 further comprising a cylinder, the cylinder having an internal bore with a piston adapted and configured for sliding movement in the bore of the cylinder, one of the cylinder and the piston being operatively connected to the actuators.

12. The clasp of claim 11 wherein the cylinder is slidable relative to piston such that axial movement of the cylinder causes axial movement of the actuators.

13. The clasp of claim 12 wherein the piston is operatively connected to the shaft in a manner such that pressurizing the cylinder causes the cylinder to move axially relative to the shaft.

14. The clasp of claim 13 wherein the clasp is operatively connected with a pulling member, the pulling member being configured to exert an axial pulling force on the clasp.

15. The clasp of claim 10 wherein in the clasp is slidably mounted on a frame and moveable relative to the frame in a direction substantially parallel to the shaft.

16. The clasp of claim 15 wherein the clasp is moveable relative to the frame between a tube engagement position in which the clasp is adjacent to a restraint configured to engage an axial face of an object mounted on a tube, and a tube disengagement position in which the clasp is spaced from the restraint.

17. A clasp apparatus for engaging an end of a tube, the clasp comprising:

a housing having a center shaft and a plurality of clamping blocks spaced circumferentially relative to the shaft, the plurality of clamping blocks being moveable between a disengaged position and an engaged position, wherein in the disengaged position the plurality of clamping blocks are spaced radially away from the shaft at a distance sufficient such that a tube is insertable between the shaft and the clamping blocks, and wherein in the engaged position, the plurality of clamping blocks are positioned radially away from the disengaged position toward the shaft, and wherein in the engaged position and when a tube is disposed between the plurality of clamping blocks and the shaft, the plurality of clamping blocks presses the tube against the shaft; and at least one actuator engageable with at least one clamping block of the plurality of clamping blocks to move the at least one clamping block between the disengaged position and the engaged position.

18. The clasp apparatus of claim 17 wherein the clamping blocks are disposed supercircumjacent to the shaft within the housing.

19. The clasp apparatus of claim 17 wherein in the disengaged position the plurality of clamping blocks are spaced radially outwardly from an outer surface of the shaft at a distance sufficient such that a tube is insertable between the shaft and the clamping blocks, and wherein in the engaged position, the plurality of clamping blocks are positioned radially inward of the disengaged position toward the shaft, and when in the engaged position and when a tube is disposed between the plurality of clamping blocks and the shaft, the plurality of clamping blocks presses the tube against the outer surface of the shaft.

* * * * *